US011786774B2

(12) United States Patent
Ellis

(10) Patent No.: US 11,786,774 B2
(45) Date of Patent: Oct. 17, 2023

(54) MULTI-FUNCTION EXERCISE MACHINES WITH MECHANICAL PUSH AND PULL RESISTANCE

(71) Applicant: Product Design Innovations, LLC, Ocala, FL (US)

(72) Inventor: Joseph K. Ellis, Ocala, FL (US)

(73) Assignee: Product Design Innovations, LLC, Ocala, FL (US)

( * ) Notice: Subject to any disclaimer, the term of this patent is extended or adjusted under 35 U.S.C. 154(b) by 137 days.

(21) Appl. No.: 17/185,130

(22) Filed: Feb. 25, 2021

(65) Prior Publication Data

US 2022/0266083 A1 Aug. 25, 2022

(51) Int. Cl.

| | |
|---|---|
| ***A63B 21/00*** | (2006.01) |
| ***A63B 21/22*** | (2006.01) |
| ***A63B 21/005*** | (2006.01) |
| ***A63B 23/12*** | (2006.01) |
| ***A63B 23/04*** | (2006.01) |
| ***A63B 23/02*** | (2006.01) |
| ***A63B 17/02*** | (2006.01) |

(52) U.S. Cl.

CPC ..... *A63B 17/02* (2013.01); *A63B 21/0056* (2013.01); *A63B 21/00069* (2013.01); *A63B 21/154* (2013.01); *A63B 21/157* (2013.01); *A63B 21/225* (2013.01); *A63B 21/4029* (2015.10); *A63B 21/4034* (2015.10); *A63B 21/4035* (2015.10); *A63B 21/4047* (2015.10); *A63B 23/0205* (2013.01); *A63B 23/0405* (2013.01); *A63B 23/1209* (2013.01); *A63B 23/1281* (2013.01); *A63B 2225/102* (2013.01)

(58) Field of Classification Search

CPC ..... A63B 21/154–157; A63B 21/225–227; A63B 17/02; A63B 21/00069; A63B 21/0056; A63B 21/4029; A63B 21/4034; A63B 21/4035; A63B 21/4047; A63B 23/0205; A63B 23/0405; A63B 23/1209; A63B 23/1281; A63B 2225/102; A63B 2022/0051; A63B 2022/0053; A63B 2022/0676; A63B 22/0664; A63B 2022/206; A63B 22/203; A63B 23/03575; A63B 23/0494

See application file for complete search history.

(56) References Cited

U.S. PATENT DOCUMENTS

| | | | |
|---|---|---|---|
| 4,900,013 | A | 2/1990 | Rodgers |
| 4,984,986 | A | 1/1991 | Vohnout |
| 5,072,929 | A | 12/1991 | Peterson |
| 5,090,694 | A | 2/1992 | Pauls |

(Continued)

*Primary Examiner* — Andrew S Lo

(74) *Attorney, Agent, or Firm* — Laurence P. Colton; SMITH TEMPEL BLAHA LLC

(57) ABSTRACT

Exercise machines having a user support and at least one user engagement actuator assembly wherein motion of the at least one user engagement actuator assemblies is resisted in both the push and pull directions by the resisted rotation of a one-direction flywheel that is operatively engaged with a braking mechanism. The resistance of the push direction can be less, greater, or equal to the resistance of the pull direction. Each user engagement actuator assembly can be configured to create various unique push and pull exercise stations. Multiple exercise stations can be mounted on each machine that can be operated independently or concurrently.

24 Claims, 40 Drawing Sheets

(56) References Cited

U.S. PATENT DOCUMENTS

| | | | | |
|---|---|---|---|---|
| 5,147,265 | A | 9/1992 | Pauls | |
| 5,195,937 | A | 3/1993 | Engel | |
| 5,302,161 | A | 4/1994 | Loubert | |
| 5,354,251 | A | 10/1994 | Sleamaker | |
| 5,356,356 | A | 10/1994 | Hildebrandt | |
| 5,496,241 | A | 3/1996 | Sellers | |
| 6,004,244 | A | 12/1999 | Simonson | |
| 8,888,661 | B2 | 11/2014 | Ellis | |
| 9,700,753 | B1 | 7/2017 | Boatwright | |
| 10,220,247 | B2 | 3/2019 | Ellis | |
| 10,786,701 | B1 * | 9/2020 | Ellis | A63B 23/03525 |
| 11,413,494 | B1 * | 8/2022 | Habing | A63B 21/225 |
| 11,524,206 | B2 * | 12/2022 | Ellis | A63B 21/00069 |
| 2002/0016237 | A1 | 2/2002 | Schmidt | |
| 2007/0037667 | A1 | 2/2007 | Gordon | |
| 2008/0051260 | A1 | 2/2008 | Simonson | |
| 2008/0280736 | A1 | 11/2008 | D'Eredita | |
| 2010/0144496 | A1 | 6/2010 | Schmidt | |
| 2013/0337981 | A1 | 12/2013 | Habing | |
| 2017/0319941 | A1 | 11/2017 | Smith | |
| 2018/0111019 | A1 | 4/2018 | Ellis | |
| 2018/0147436 | A1 | 5/2018 | Ellis | |
| 2019/0105526 | A1 | 4/2019 | Boatwright | |
| 2019/0134451 | A1 | 5/2019 | McCall | |
| 2022/0219036 | A1 * | 7/2022 | Anderson | A63B 21/154 |

* cited by examiner

MULTI-FUNCTION EXERCISE MACHINES WITH MECHANICAL PUSH AND PULL RESISTANCE

BACKGROUND OF THE INVENTION

Technical Field

This invention relates to the general technical field of exercise, physical fitness and physical therapy equipment and machines. This invention relates more specifically to the field of multi-function exercise machines with a mechanical push and pull resistance system.

Prior Art

Strength training machines are available in various configurations and for all of the major muscle groups. Most strength training machines have a single function and provide resistance in only one direction, for example an arm curl machine for strengthening a user's biceps or a chest press machine for strengthening a user's pectoral muscles. Generally, the exercise function of these machines is resisted with gravity-based weights connected to a user engagement feature by a flexible component such as a cable or belt such that the exercise is resisted when the weight is being lifted and is not resisted when the weight is being lowered.

Some weight training machines provide more than one function, but most first require the user to perform a number of repetitions of one function, for example a leg extension, which is a push direction exercise, and then require the user to reconfigure some of the adjustable components of the machine prior to performing a number of repetitions of the opposite pull direction exercise, such as a leg curl exercise. This is because the machine only provides resistance in one direction.

Hydraulically resisted exercise machines can provide push and pull resistance and many of these machines are configured with a dual function such as a vertical push to strengthen a user's shoulder muscles and a reciprocating vertical pull to strengthen a user's back muscles. However, these machines have several shortcomings, for example they provide a jerky feel when the actuator component changes direction to move in the reciprocating direction because the fluid in the resistance cylinder has to be moved in the opposite direction. Also, these machines cannot be mechanically configured with a push direction resistance ratio that is different from the pull direction resistance ratio at the same resistance setting for the push and pull. This is a deficiency because most of these combinations of reciprocating exercises engage two different sets of muscles that do not have the same strength capabilities. For example, a user's quadriceps, which are engaged in a leg extension motion, are much larger and stronger than a user's hamstrings, which are engaged in the reciprocating leg curl motion.

Other exercise machines offer computer-controlled resistance mechanisms that can be preprogrammed electronically to manipulate and control electro-mechanically generated resistance to the exercise motion while the user is operating the machine and these machines require electrical motors, electricity, computer hardware, and computer software making the products very costly to manufacture and repair. These machines also have to be plugged into an electrical outlet, which increases operating cost and limits the placement of these machines in a home or exercise facility because of the need to be near an electrical outlet. Also, the electrical cords can become a hazard.

Many people say they do not have the time to exercise regularly and that most exercise machines are complicated to operate. The present invention allows each user to get the most efficient full body workout in the least amount of time with simple to operate mechanically resisted machines that are durable and cost effect to manufacture and maintain.

BRIEF SUMMARY OF THE INVENTION

The present invention provides a series of exercise machines wherein each machine includes a user support and one or more user engagement actuator assemblies that each create an exercise station that is resisted in both the push direction and the reciprocating pull direction. The machines create the push and pull resistance with a mechanically operated device that does not require electricity or any electronic componentry. Each user engagement actuator assembly includes two rigid drive links and at least one user engagement component such as one or more handles and or pads and or foot platforms and at least one pivoting actuator lever. Each user engagement actuator assembly is operatively connected to a resistance assembly that includes a one-direction flywheel engaged with a manually adjusted braking mechanism for creating resistance to the push and pull exercise motions.

Each user engagement actuator assembly also is operatively connected to a drive train assembly with two rigid drive links and the drive train assembly transfers the force generated by the user to a resistance assembly to rotate a resisted one-direction flywheel. The drive train assembly includes at least two one-direction clutch bearings to allow the resisted flywheel to rotate in one direction only while each user engagement actuator assembly moves in a reciprocating motion. If the resisted flywheel was connected to the user engagement actuator assembly such that the resisted flywheel changed rotational directions when the user engagement actuator changed from a push to a pull direction, this would create a very jerky motion machine that would not only be unpleasant to work out on but could also cause injuries as the user would have to stop the rotational momentum of the resisted flywheel with the user engagement actuator prior to moving the user engagement actuator in the opposite direction.

In preferred embodiments, the drive train assembly includes a one-direction flywheel booster pulley mounted on an axle to increase the rotational speed of the flywheel to cause the resistance assembly to work more smoothly and efficiently. The drive train assembly can be mechanically configured such that the amount of resistance to movement of a user engagement actuator in a push direction can be relatively equal to the amount of resistance to movement of said user engagement actuator in a pull direction at a fixed resistance setting, or the drive train can be mechanically configured such that the amount of resistance to movement of a user engagement actuator in a push direction can be unique to the amount of resistance to movement of said user engagement actuator in a pull direction at a fixed resistance setting. This creates a push and reciprocating pull exercise motion wherein the resistance is higher for a stronger muscle group and lower for a weaker muscle group at a fixed resistance setting. It would be impractical for a user to change the resistance setting between each push and reciprocating pull exercise repetition and it would be impractical and cost prohibitive to create a computer controlled electro-mechanical apparatus to control the push and pull resistance ratios. Therefore, the optimized push and pull resistance ratios for each muscle group mechanically configured into the drive train of the invention allows the user to properly challenge each muscle group in the least amount of time at a fixed resistance setting.

In certain embodiments multiple push and pull exercise stations can be mounted on one machine and each push and pull exercise station cooperates with a common one-direction flywheel resistance assembly to offer multiple push and pull exercises from a single user support to optimize space efficiency and offer a full body workout with a single machine. In the multiple push and pull exercise stations embodiment of the invention, the user can operate one of the exercise stations while the other exercise stations are not being operated, or the user can operate multiple exercise stations concurrently. For example, the user could operate a leg extension and leg curl station and concurrently operate a biceps curl and triceps extension station. Concurrently operating multiple exercise stations increases the intensity of the workout and reduces the time required for the workout.

All preferred embodiments of the invention include a flywheel axle. In certain embodiments, the drive train includes a drive axle for each user engagement actuator assembly. In other embodiments, the drive train includes a drive axle for each user engagement actuator assembly and a one-direction flywheel booster pulley axle. In other embodiments, the drive train axles are eliminated and the user engagement actuator assembly is operatively connected to the one-direction flywheel axle.

In certain embodiments of the invention, an exercise station can include a left side user engagement actuator assembly and a right side user engagement actuator assembly for exercising identical left and right side muscle groups. For example, a left side biceps curl and triceps extension user engagement actuator assembly and a separate right side biceps curl and triceps extension user engagement actuator assembly.

In all preferred embodiments of the invention each user is optimizing their time by getting both a resisted push motion and a resisted reciprocating pull motion with each exercise repetition. Also, the one-directional flywheel of the current invention creates a smooth and uninterrupted resistance to the exercise motion. In all preferred embodiments, the user can manually adjust the resistance to the rotation of the one-directional flywheel to a preferred fixed resistance setting. In certain embodiments, the user can operate multiple push and pull exercise stations without leaving the user support which is convenient and time efficient. In certain embodiments, one or more of the exercise stations are mechanically configured such that the resistance ratio of the push exercise motion is unique to the resistance ratio of the pull exercise motion at a fixed resistance setting to create a safe and efficient workout where each muscle group is properly challenged.

DETAILED DESCRIPTION OF PREFERRED EMBODIMENTS

Figure 1:
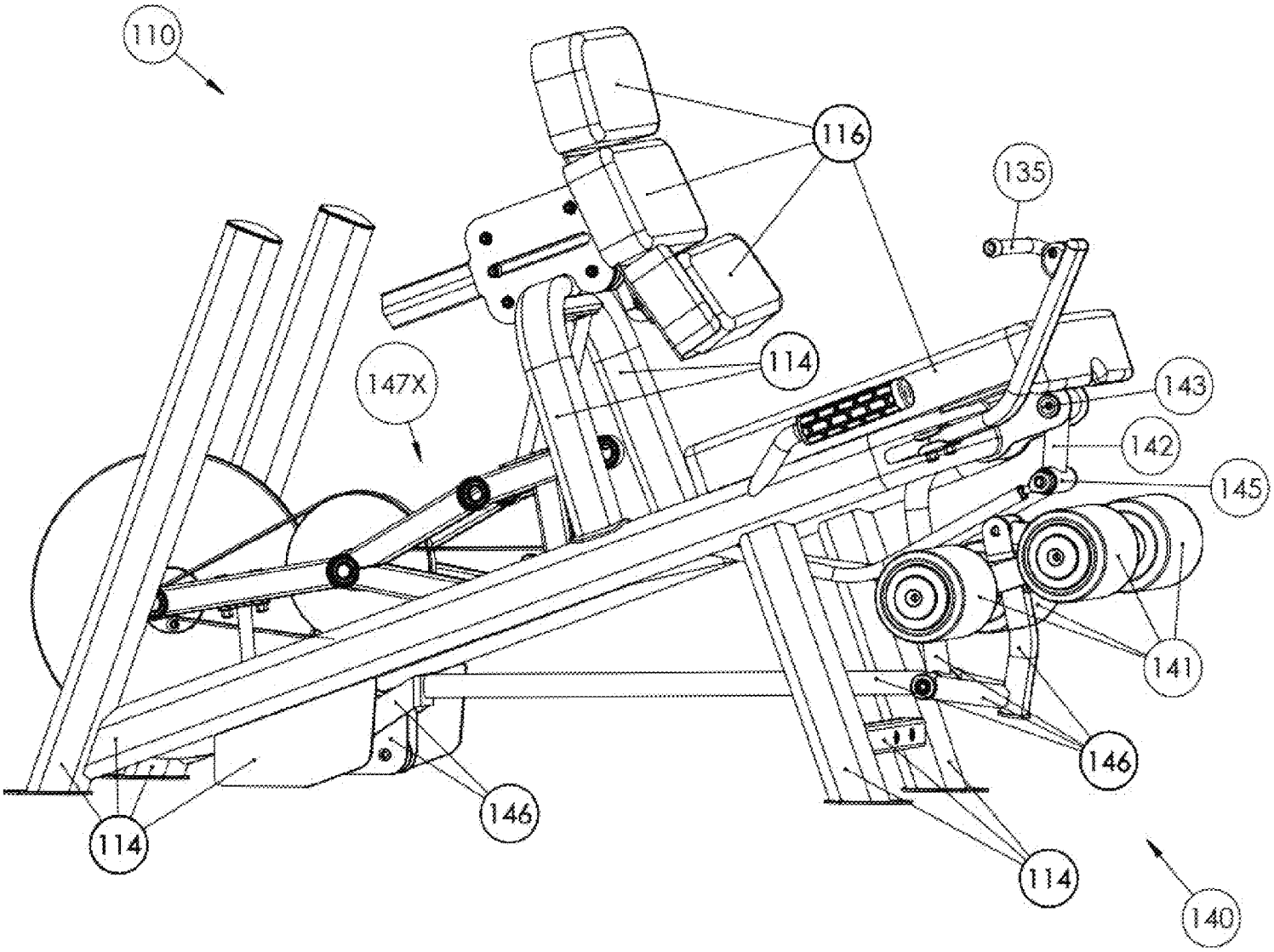
FIG. 1 is a perspective view of a leg extension and leg curl station embodiment of the invention.
Figure 2:
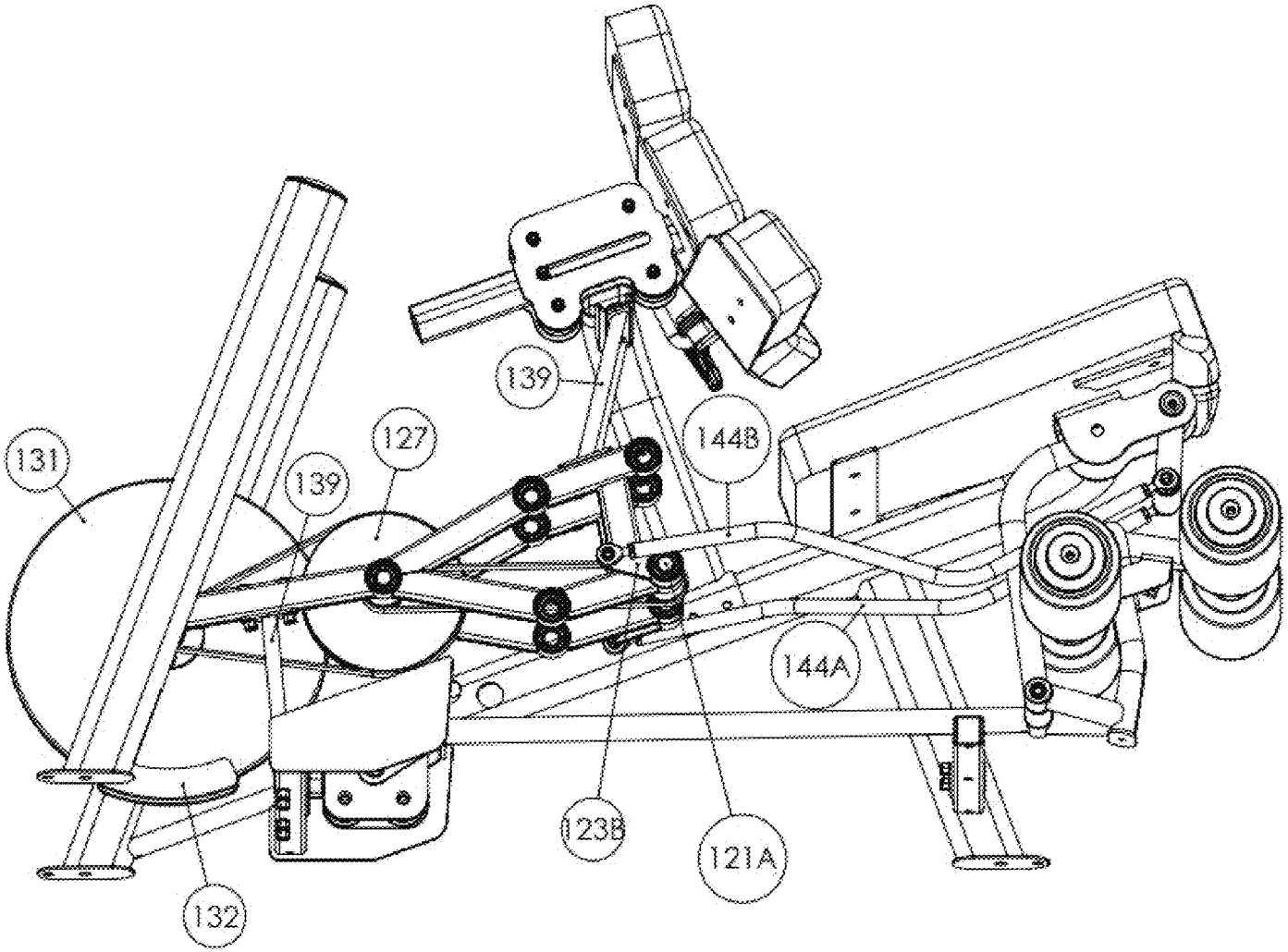
FIG. 2 is a side view of the leg extension and leg curl station embodiment of the invention shown in FIG. 1. Some components are removed to provide an unobstructed view of other components.
Figure 3:
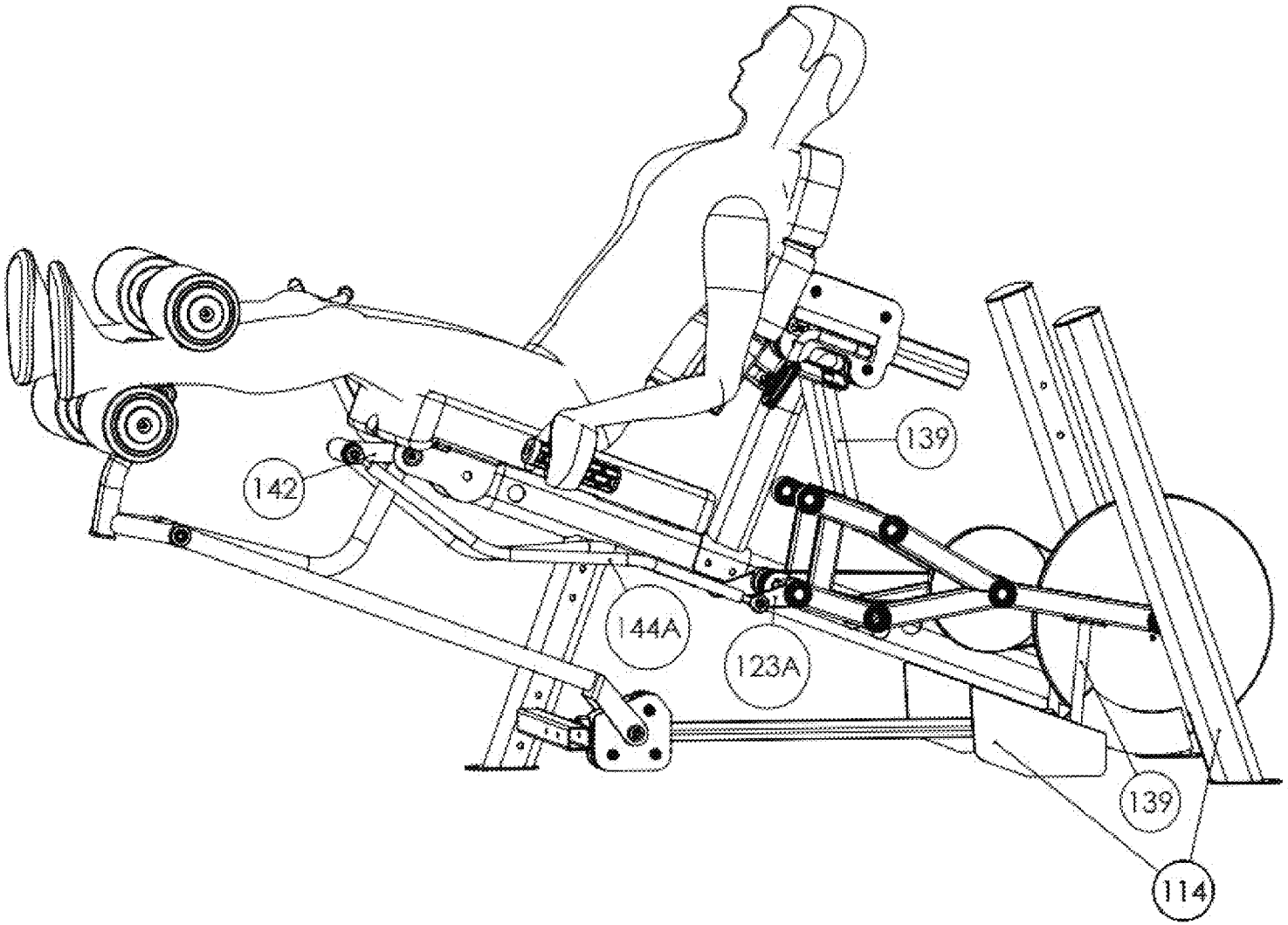
FIG. 3 is perspective view of the leg extension and leg curl station embodiment of the invention shown in FIG. 1. Some components are removed to provide an unobstructed view of other components.
Figure 4:
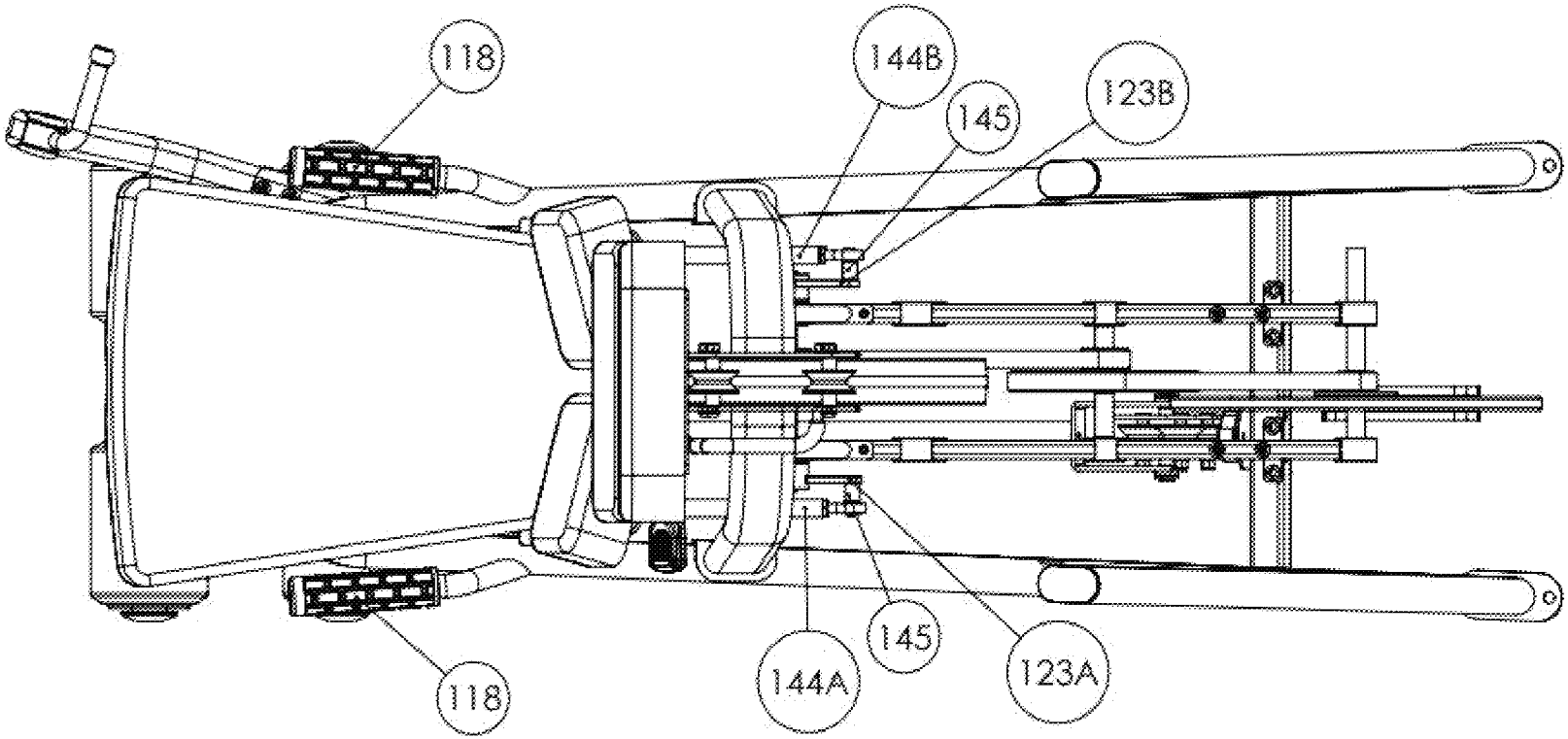
FIG. 4 is an overhead view of the leg extension and leg curl station embodiment of the invention shown in FIG. 1.

Exemplary preferred embodiments are disclosed below in connection with the attached drawings. In some of the attached drawings, a portion of the machine frame or some components may be removed in certain views to provide a better view, clarity, and explanation of certain components and how they may cooperate with other components.

Throughout this specification, various terms will be used to describe various components or features. For examples:

The term "user engagement actuator assembly" will include all of the components moved by the user during an exercise motion that guide the user's motion and transfer the user's force to other components and assemblies on the machine.

The term "user support" will refer to any component on the machine the user contacts that supports the user's weight while operating the machine.

The term "drive train" will refer to a components assembly that transfers the force from the user engagement actuator assembly to the resistance assembly of the machine.

The term "engage" will refer to the user contacting a movable component on the machine or an operational component or assembly acting upon another operational component or assembly of the machine.

The term "exercise station" will include all of the components on the machine that create a particular push and pull exercise motion.

The term "multi-station" will refer to a combination of exercise stations and the components on the machine that create those exercise motions.

The term "resistance assembly" will refer to all of the components that work together to provide resistance to the movements of the user engagement actuator assembly.

The term "one-direction clutch bearing" will refer to a bearing that engages and rotates an axle in a first direction but disengages and freely rotates on the movement of the same axle in the opposite direction.

The term "bearing" will refer to a bearing of any kind, including the actual rotational component and its housing that mounts it on the machine.

The term "one-direction clutch bearing pulley" will refer to a pulley that is mounted on the housing of a one-direction clutch bearing such that the pulley and the one-direction clutch bearing cooperate as one.

The term "forward end or forward section" of a machine, component, or assembly will refer to the end of the machine, component, or assembly that is proximal to the end of the machine the user is facing when operating the machine.

The term "rearward end or rearward section" of a machine, component, or assembly will refer to the end of the machine, component, or assembly that is opposite to the end of the machine the user is facing when operating the machine.

Referring now to FIGS. 1-36, every preferred embodiment of the machine 110 is supported by machine frame components 114. Machine frame components 114 can be made of various rigid materials capable of supporting machine 110 and user U with metal being the most common material. Preferred embodiments of each exercise station can cooperate with any one of three types of drive train assemblies.

Each type of drive train will be identified with an X or Y or Z. Each drive train will also be identified by the exercise station or stations it cooperates with. For example, a leg station drive train assembly 147 configured as a type X drive train will be identified as a leg station drive train assembly 147X, a multi-station drive train assembly 197 configured as a type Y drive train will be identified as a multi-station drive train assembly 197Y, and a hip station drive train assembly 170 configured as a type Z drive train will be identified as a hip station drive assembly 170Z. Each type of drive train is supported by a drive train frame 115. Drive train frame 115 components can be constructed of various materials capable of housing and supporting each drive train with metal being the most common material. Each drive train frame 115 is rigidly connected to machine 110 with drive train support tubes 139.

Every preferred embodiment of machine 110 has a user support. In certain embodiments, the user support is made up of one or more user support pads 116 and in other embodiments the user support is one or more user support standing platforms 117. In certain embodiments two or more stationary grip handles 118 are rigidly connected to the machine frame 114 so that user U can secure themselves on the user support during operation of machine 110.

Every preferred embodiment of machine 110 includes a unique user engagement actuator assembly that creates an exercise station. Each unique exercise station will be described in further detail herein, but each station includes at least one user engagement component, at least one pivoting actuator lever, at least two rigid drive links, at least four rigid drive link connectors and multiple actuator assembly components. Each user engagement actuator assembly is configured such that at least one user engagement component is operatively connected to and drives at least one pivoting actuator lever, which is operatively connected to and drives two rigid drive links that are operatively connected to and propels a drive train or resistance assembly.

FIGS. 1-37 illustrate views of embodiments of the invention that utilize a drive train X or drive train Y or drive train Z. In certain preferred embodiments as best illustrated in the isolated views of FIGS. 5, 6, 11, 12, 13, 17, 18, 21, 22, and 23, a drive train X is comprised of at least one one-direction drive pulley axle 121 and a drive pulley 122 that is rigidly mounted on each one-direction drive pulley axle 121. Two one-direction clutch bearings 125 are operatively mounted on each one-direction drive pulley axle 121, an axle drive flange 123 is mounted on each one-direction clutch bearing, and each axle drive flange 123 connects the drive train X with a user engagement actuator assembly with a rigid drive link. Each one-direction drive pulley axle 121 is mounted on the drive train frame 115 with at least two axle bearings 124.

In these embodiments, a common one-direction flywheel booster pulley axle 126 is also mounted on drive train frame 115 with at least two axle bearings 124, a flywheel booster pulley 127 is rigidly mounted on the one-direction flywheel booster pulley axle 126, and at least one guide pulley 129 is rigidly mounted on the one-direction flywheel booster pulley axle 126. Each guide pulley 129 mounted on one-direction flywheel booster pulley axle 126 is many times smaller in diameter than flywheel booster pulley 127. Each drive pulley 122 is connected to the one-direction flywheel booster pulley axle 126 with a drive belt 128 and a guide pulley 129.

Drive train frame 115 is rigidly connected to machine frame 114 with drive train support tubes 139. Drive train X can house one or multiple one-direction drive axles 121 that are each connected to a unique user engagement actuator assembly to create one or multiple exercise stations that can be mounted on one machine 110.

Included in every preferred embodiment of machine 110 is a resistance assembly 130 that is operatively connected to each user engagement actuator assembly. The resistance assembly 130 is comprised of a one-direction flywheel axle 138 and a flywheel 131 is rigidly mounted on one-direction flywheel axle 138, a set of resistance magnets 132 are mounted on machine frame 114 and are operatively engaged with flywheel 131, and a resistance magnets adjustment lever 135 is operatively connected to resistance magnets 132. As illustrated in FIGS. 1-37, the one-direction flywheel axle 138 is mounted on drive train frame 115 with at least two axle bearings 124. As illustrate in FIGS. 38, 39, and 40, one-direction flywheel axle 138 is mounted on machine frame 114 with at least two axle bearings 124. In all preferred embodiments of machine 110, flywheel magnets 132 can be manually adjusted to a fixed setting of resistance force with resistance magnets adjustment lever 135. Although the resistance assembly 130 is represented as a flywheel resisted by magnets, the flywheel could alternatively be resisted by air displacement fan blades, fluid displacement paddles, or various friction devices, and the level of resistance force of each of these alternative resistance components can be manually adjusted by the user to a fixed amount of resistance setting.

FIGS. 1-26 all illustrate preferred embodiments of the invention wherein resistance assembly 130 is operatively connected to a drive train assembly X such that a drive belt 128 connects flywheel booster pulley 127 with a guide pulley 129 that is rigidly mounted on one-direction flywheel axle 138. Said guide pulley 129 that is rigidly mounted on one-direction flywheel axle 138 is many times smaller in diameter than flywheel booster pulley 127. This creates a mechanical configuration wherein the operative connection of each drive pulley 122 to one-direction flywheel booster pulley axle 126 combined with the operative connection of flywheel booster pulley 127 to one-direction flywheel axle 138 causes the rotational speed of flywheel 131 to be greatly multiplied relative to the rotation speed of each drive pulley 122 such that the resistance assembly 130 operates more effectively.

Figure 27:
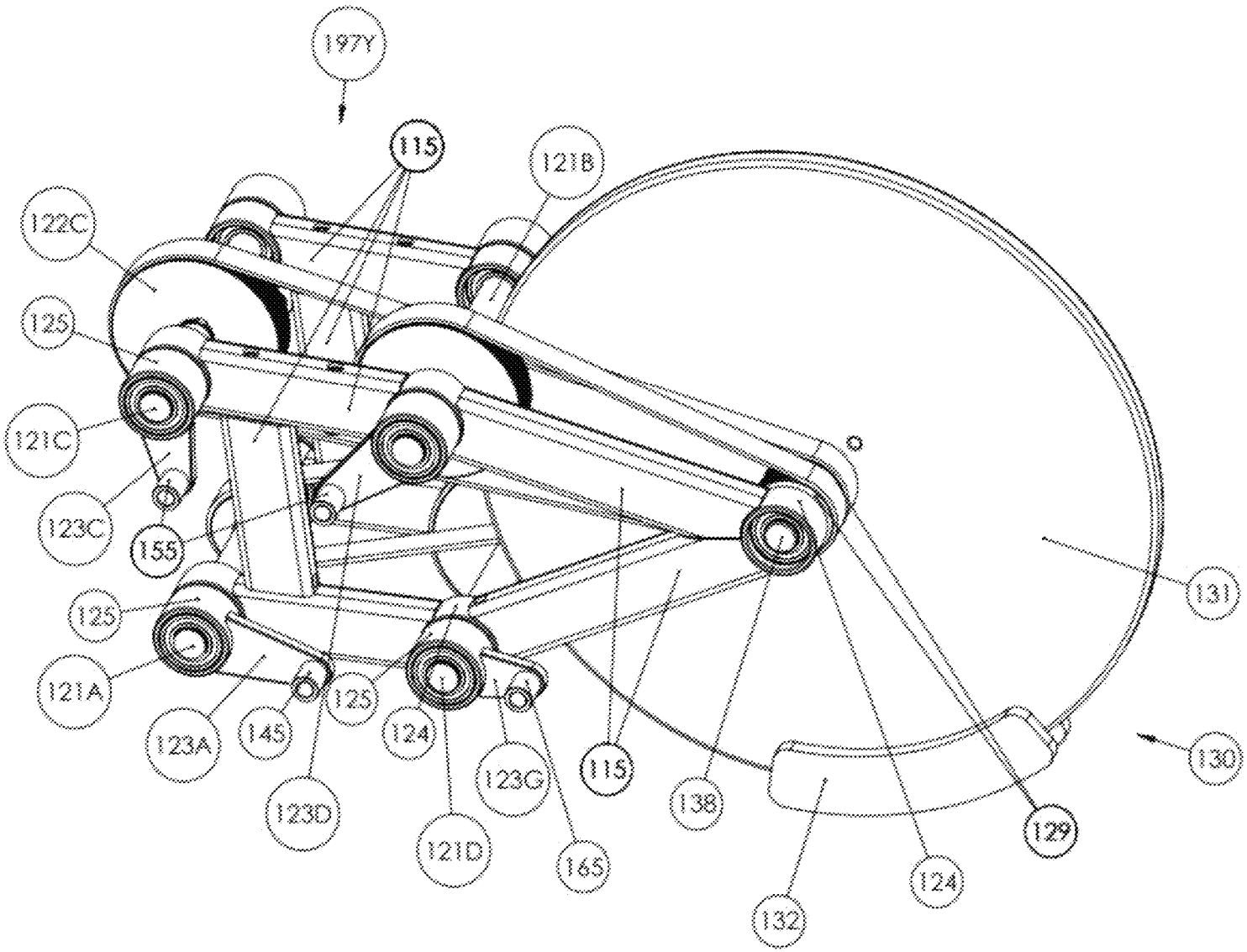
FIG. 27 is an isolated perspective view of an alternative embodiment of the drive train assembly and resistance assembly of the multi-stations embodiment of the invention shown in FIG. 19.
Figure 28:
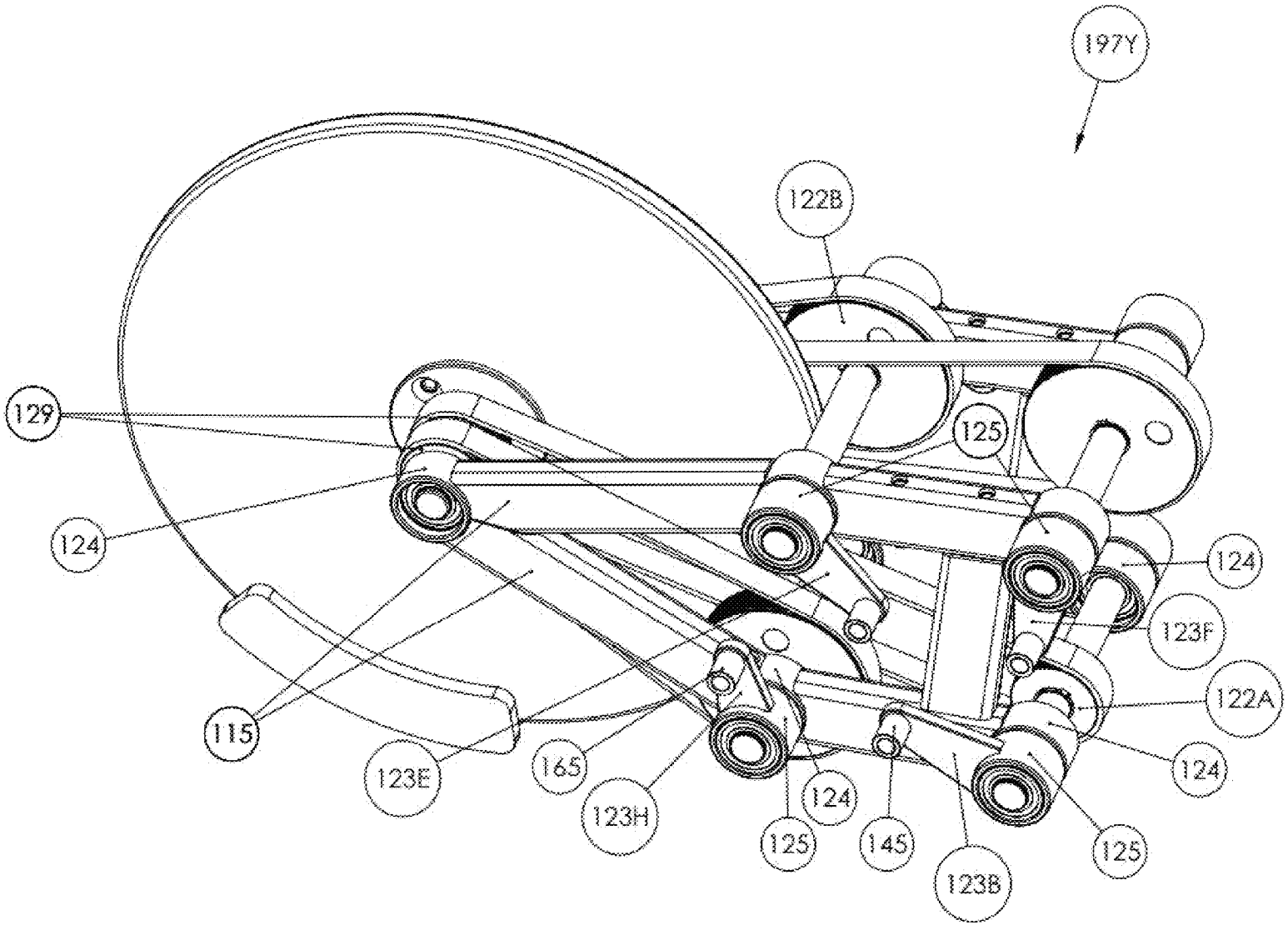
FIG. 28 is another isolated perspective view of the alternative embodiment of the drive train assembly and resistance assembly of the multi-stations embodiment of the invention shown in FIG. 19.
Figure 29:
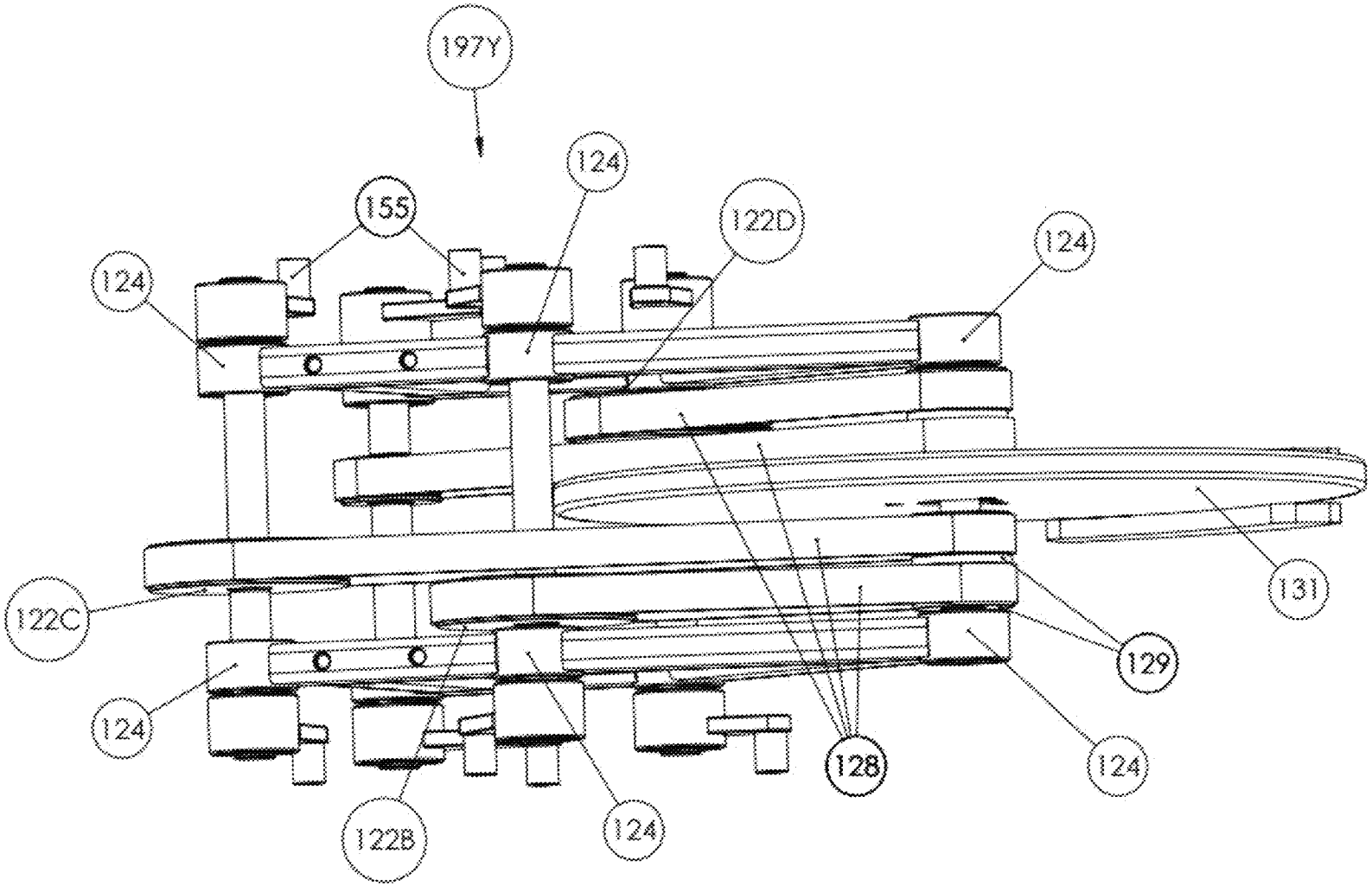
FIG. 29 is another isolated overhead view of the alternative embodiment of the drive train assembly and resistance assembly of the multi-stations embodiment of the invention shown in FIG. 19.
Figure 30:
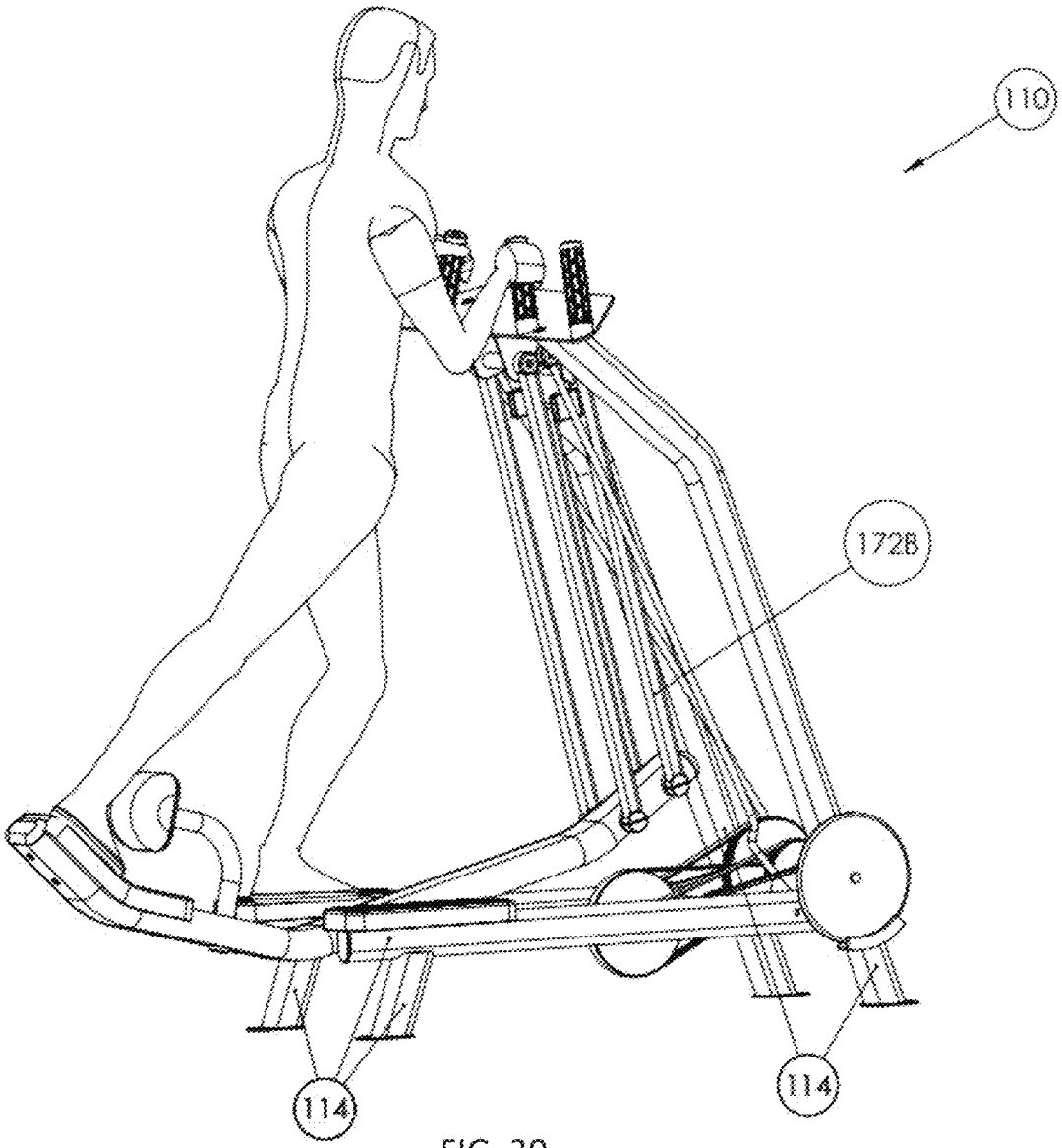
FIG. 30 is a perspective view of a glute press and hip pull station embodiment of the invention.
Figure 31:
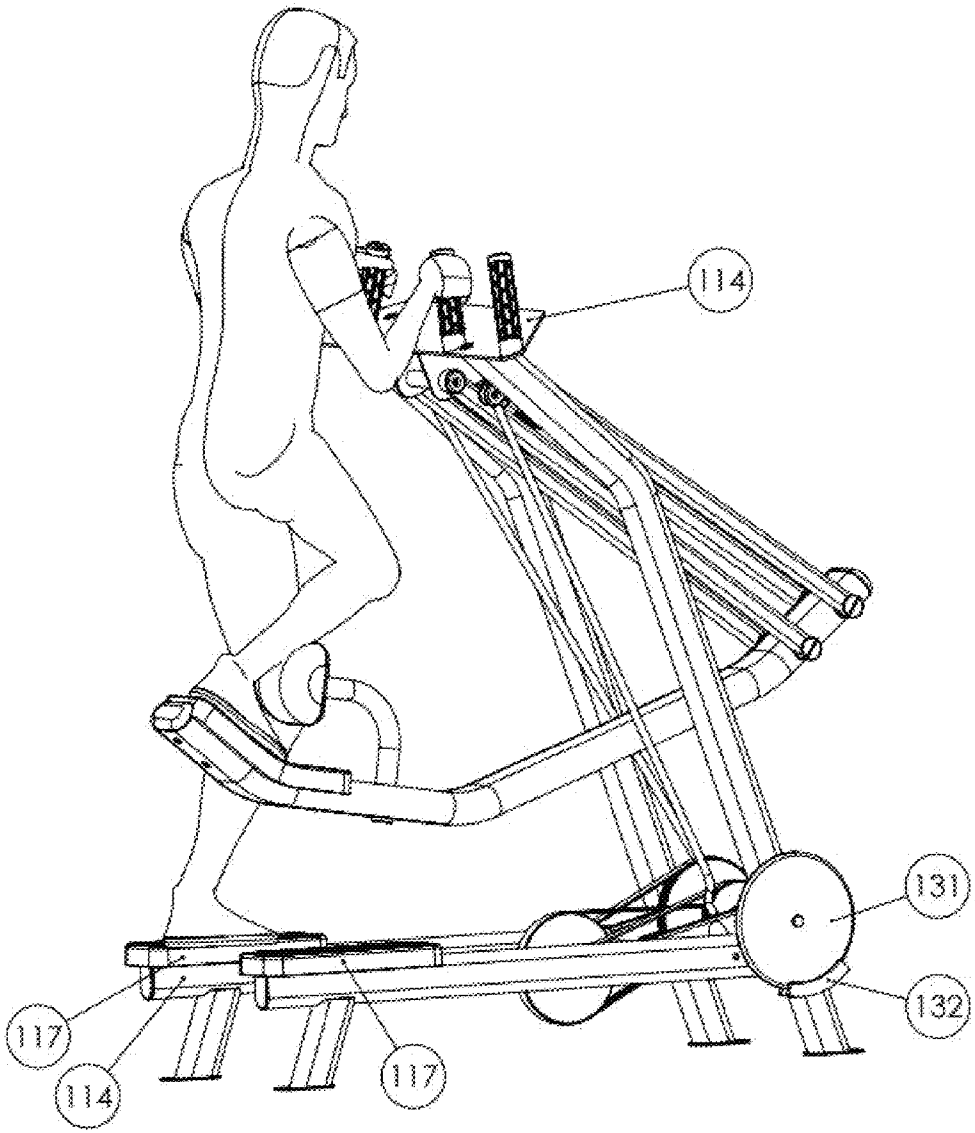
FIG. 31 is another perspective view of the glute press and hip pull station embodiment of the invention shown in FIG. 30.
Figure 32:
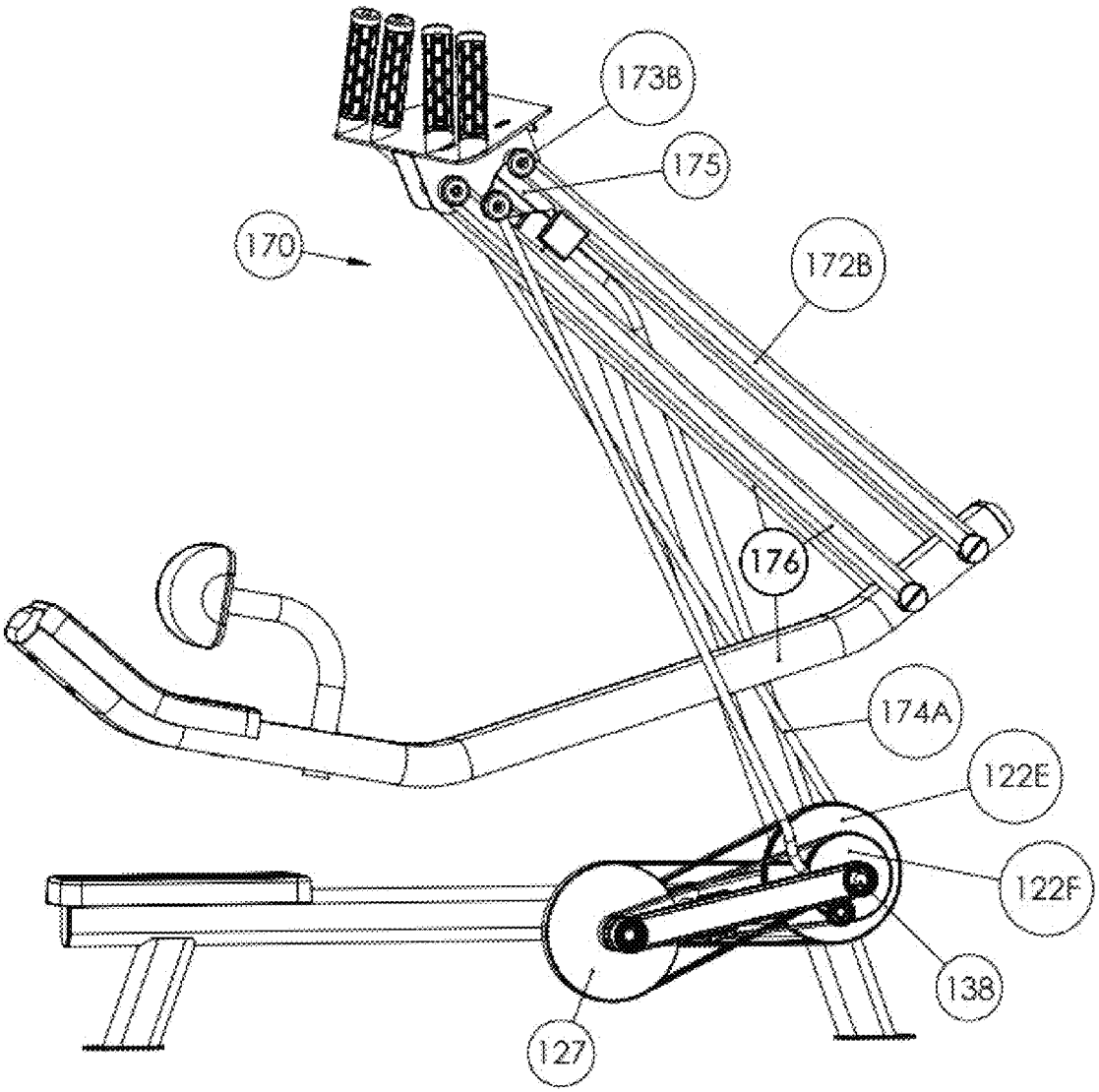
FIG. 32 is another perspective view of the glute press and hip pull station embodiment of the invention shown in FIG. 30. Some components are removed to provide an unobstructed view of other components.
Figure 33:
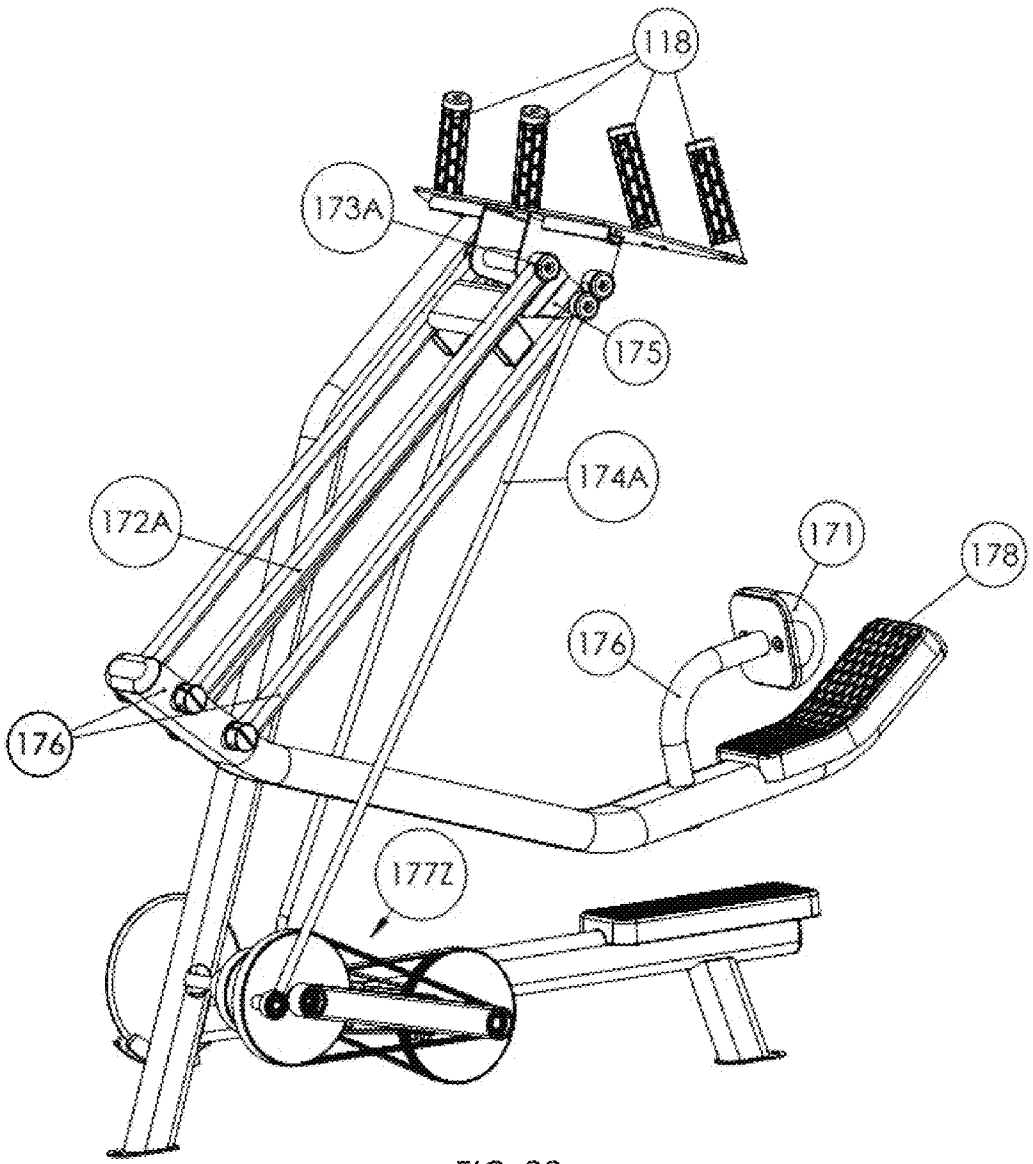
FIG. 33 is another perspective view of the glute press and hip pull station embodiment of the invention shown in FIG. 30. Some components are removed to provide an unobstructed view of other components.
Figure 34:
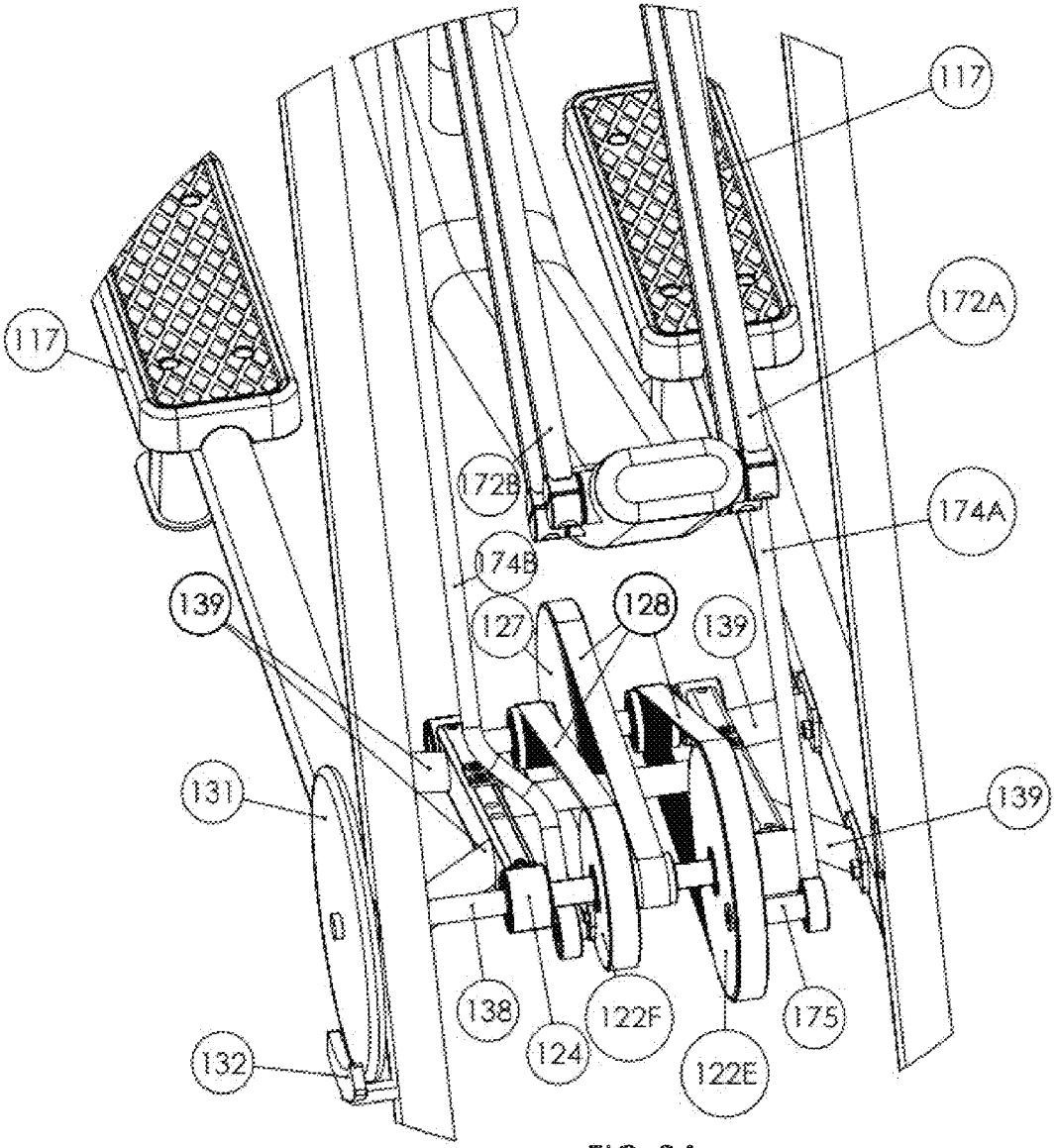
FIG. 34 is a close up view of the drive train assembly and resistance assembly of the glute press and hip pull station embodiment of the invention shown in FIG. 30.
Figure 35:
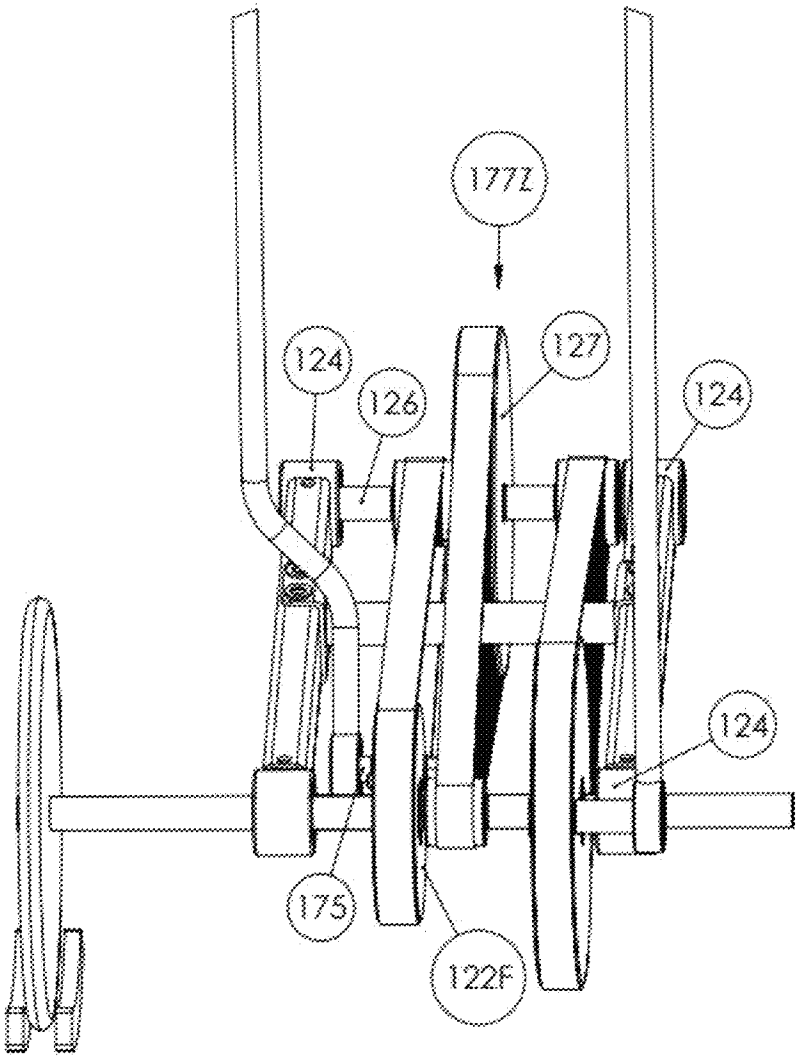
FIG. 35 is an isolated front view of the drive train assembly and resistance assembly of the glute press and hip pull station embodiment of the invention shown in FIG. 30.
Figure 36:
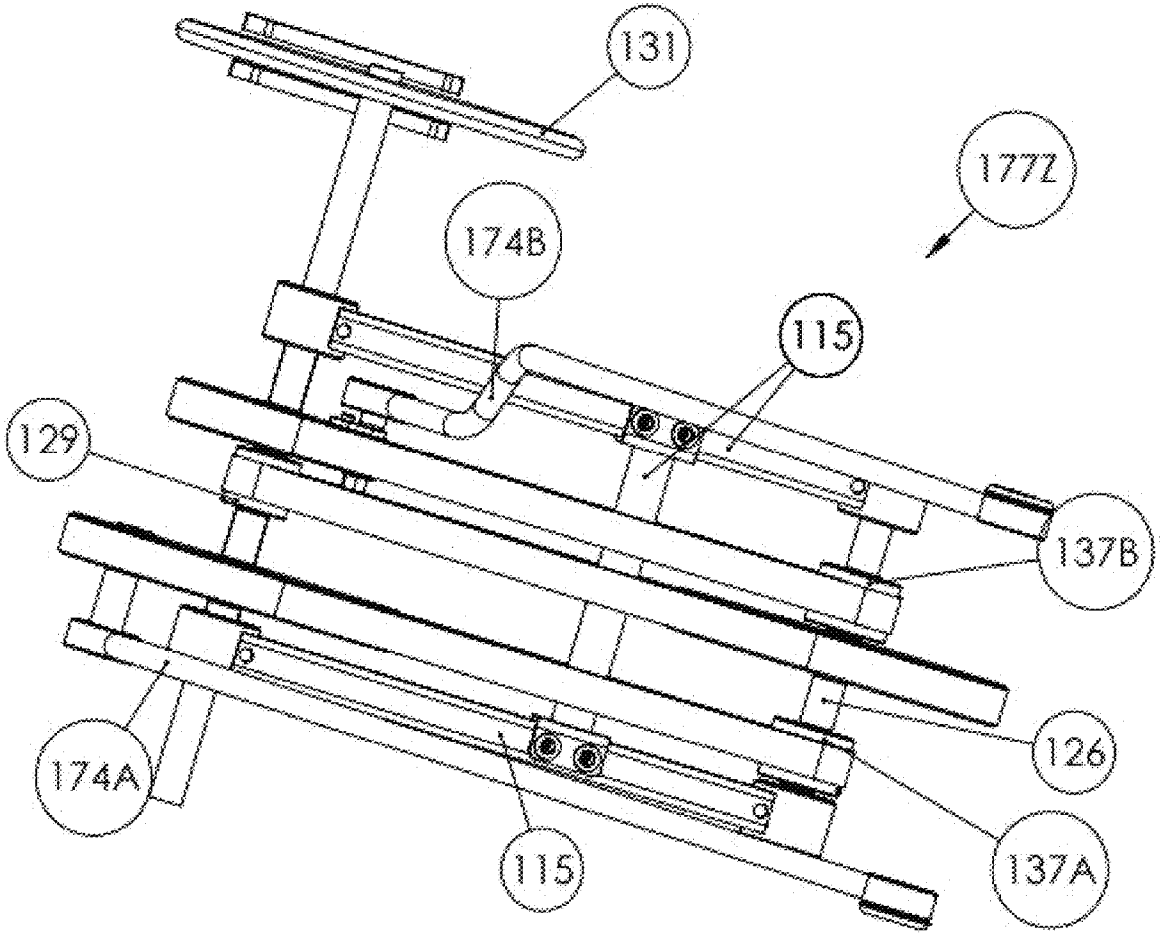
FIG. 36 is an isolated overhead view of the drive train assembly and resistance assembly of the glute press and hip pull station embodiment of the invention shown in FIG. 30.

FIGS. 27, 28, and 29 illustrate preferred embodiments of an alternative drive train assembly Y that can cooperate with any exercise station embodiment of the invention or of any combination of exercise stations embodiments of the invention. The components and configuration of drive assembly Y are the same as drive train assembly X with the exception that one-direction flywheel booster pulley axle 126 and flywheel booster pulley 127 are eliminated such that each drive pulley 122 is connected directly to one-direction flywheel axle 138 with a drive belt 128 and a guide pulley 129 that is rigidly connected to one-direction flywheel axle 138. Drive train Y can house one or multiple one-direction drive pulley axles 121 that can each be operatively connected to a unique user engagement actuator assembly to create one or multiple exercise stations that can be mounted on one machine 110.

FIGS. 30-37 illustrate another preferred drive train assembly of the invention. This drive train assembly Z will cooperate with various user engagement actuator assembly exercise stations of the invention, but in an exemplary embodiment is illustrated herein as cooperating with a hip station user engagement actuator assembly 170 that exercises a user's hip and glute muscles. Drive train assembly Z is comprised of a one-direction flywheel booster pulley axle 126 mounted on a rearward end of drive train frame 115 with at least two axle bearings 124, a flywheel booster pulley 127 is rigidly mounted on one-direction flywheel booster pulley axle 126, and a first one-direction clutch bearing pulley 137A and a second one-direction clutch bearing pulley 137B are operatively mounted on one-direction flywheel booster pulley axle 126.

A one-direction flywheel axle 138 is mounted on a forward end of drive train frame 115 with at least two axle bearings 124, a flywheel 131 is rigidly mounted on one-direction flywheel axle 138, and a guide pulley 129 is rigidly mounted on one-direction flywheel axle 138. A first drive pulley 122E and a second drive pulley 122F are rotatably mounted on one-direction flywheel axle 138 such that drive pulley 122E and drive pulley 122F can rotate independently in a forward or rearward direction on one-direction flywheel axle 138 relative to the one-directional rotation of one-direction flywheel axle 138. Flywheel booster pulley 127 is connected to guide pulley 129, which is rigidly mounted on one-direction flywheel axle 138 with a drive belt 128, one-direction clutch bearing pulley 137A is connected to drive pulley 122E with a drive belt 128, and one-direction clutch bearing pulley 137B is connected to drive pulley 122F.

Drive train frame 115 is rigidly connected to machine frame 114 with drive train support tubes 139. The mechanical configuration of drive train Z causes the rotational speed of flywheel 131 to be greatly multiplied relative to the rotational speed of drive pulleys 122E and 122F such that the resistance assembly 130 operates more effectively.

Figure 38:
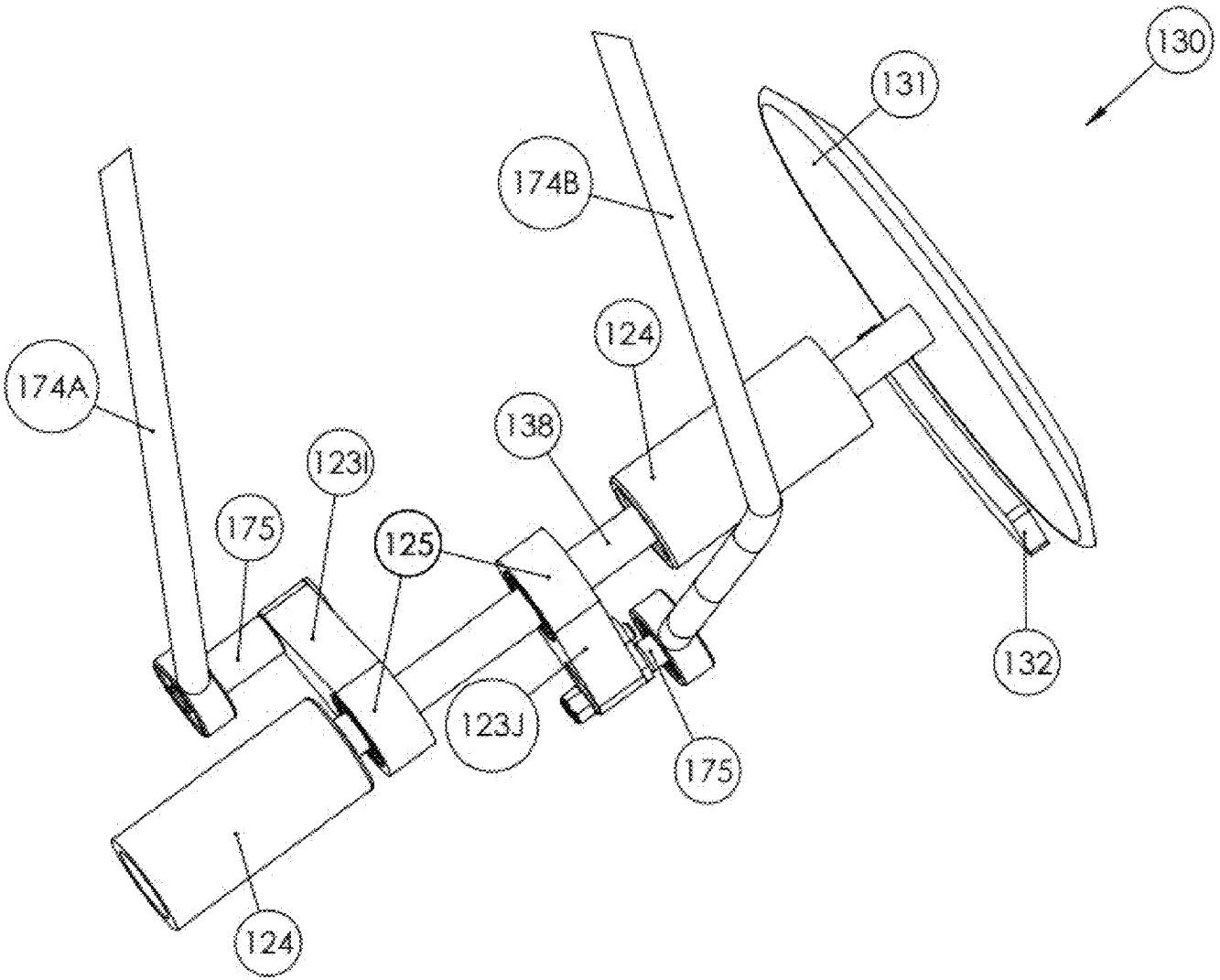
FIG. 38 is an isolated overhead view of an alternative embodiment of the resistance assembly of the glute press and hip pull station embodiment of the invention shown in FIG. 30.
Figure 39:
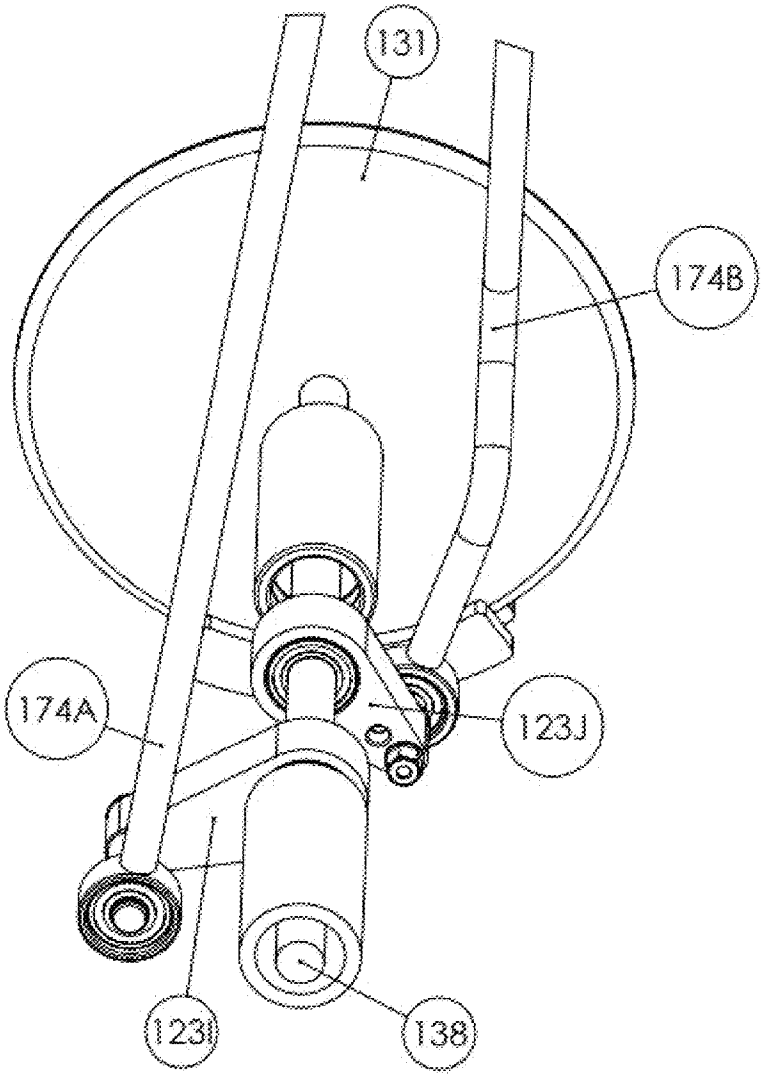
FIG. 39 is an isolated perspective view of the alternative embodiment of resistance assembly of the glute press and hip pull station embodiment of the invention shown in FIG. 30.
Figure 40:
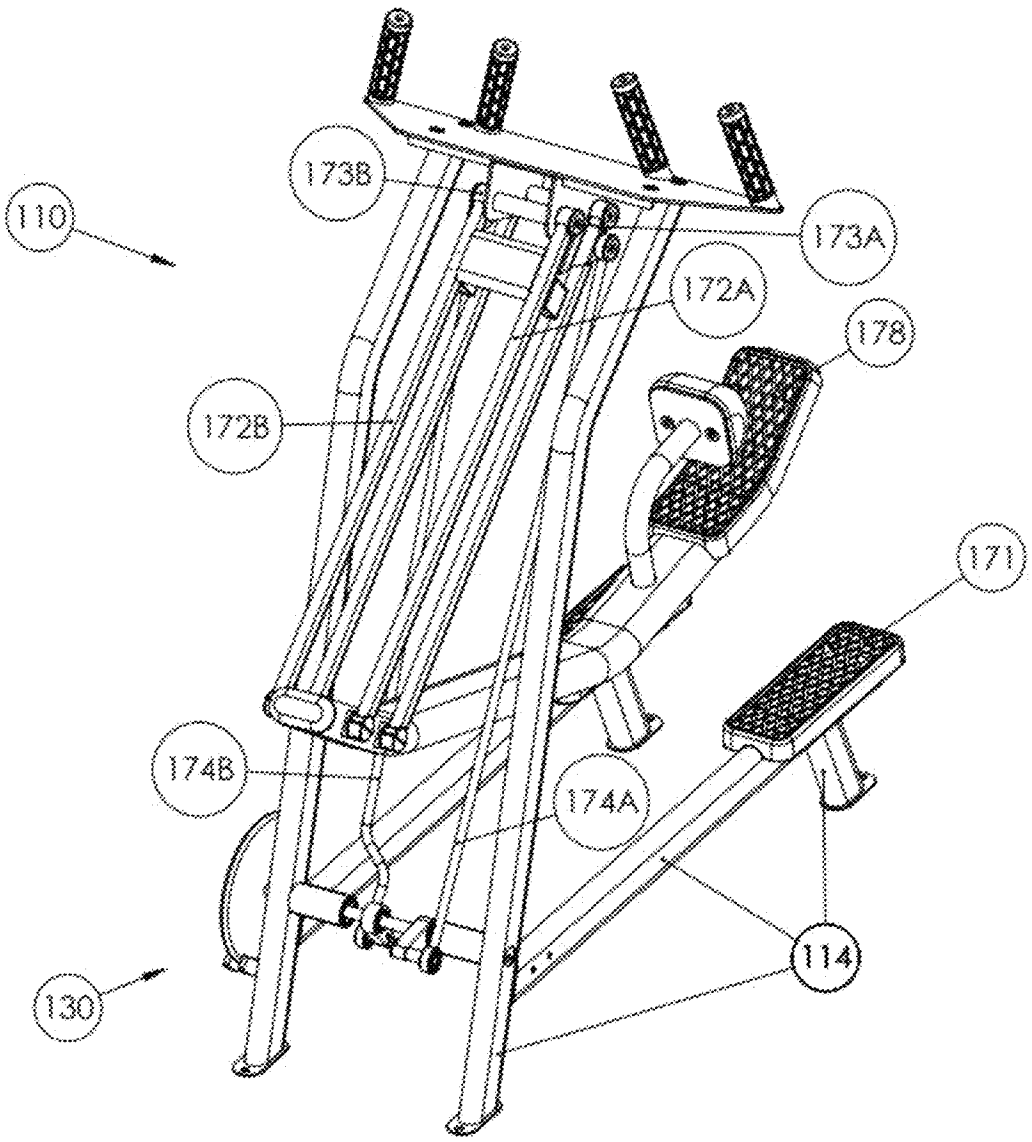
FIG. 40 is a perspective view of the alternative embodiment of the glute press and hip pull station of the invention shown in FIG. 30.

FIGS. 38-40 illustrate an alternative embodiment of the invention wherein the drive train assembly is eliminated and the user engagement actuator assembly directly cooperates with the resistance assembly 130. In this embodiment of the invention, the resistance assembly 130 will directly cooperate with various user engagement actuator assembly exercise stations, but in an exemplary embodiment herein is illustrated as cooperating with a hip station user engagement actuator assembly 170 that exercises a user's hip and glute muscles. In this embodiment, the one-direction flywheel axle 138 is mounted on the machine frame 114 with at least two axle bearings 124, a flywheel 131 is rigidly mounted on one-direction flywheel axle 138, a set of resistance magnets 132 are mounted on machine frame 114 and operatively engaged with flywheel 131, and a resistance magnets adjustment lever 135 is operatively connected to resistance magnets 132. A first one-direction clutch bearing 125 is operatively mounted on one-direction flywheel axle 138, a second one-direction clutch bearing 125 is operatively mounted on one-direction flywheel axle 138, an axle drive flange 123I is rigidly mounted on the first one-direction clutch bearing 125, and an axle drive flange 123J is rigidly mounted on the second one-direction clutch bearing 125.

One of the most important features of the invention is the mechanical manipulation of the ratio of resistance to the push motion relative to the ratio of the resistance to the reciprocating pull motion of each user engagement actuator assembly. This will be described in detail for each exercise station herein.

Figure 5:
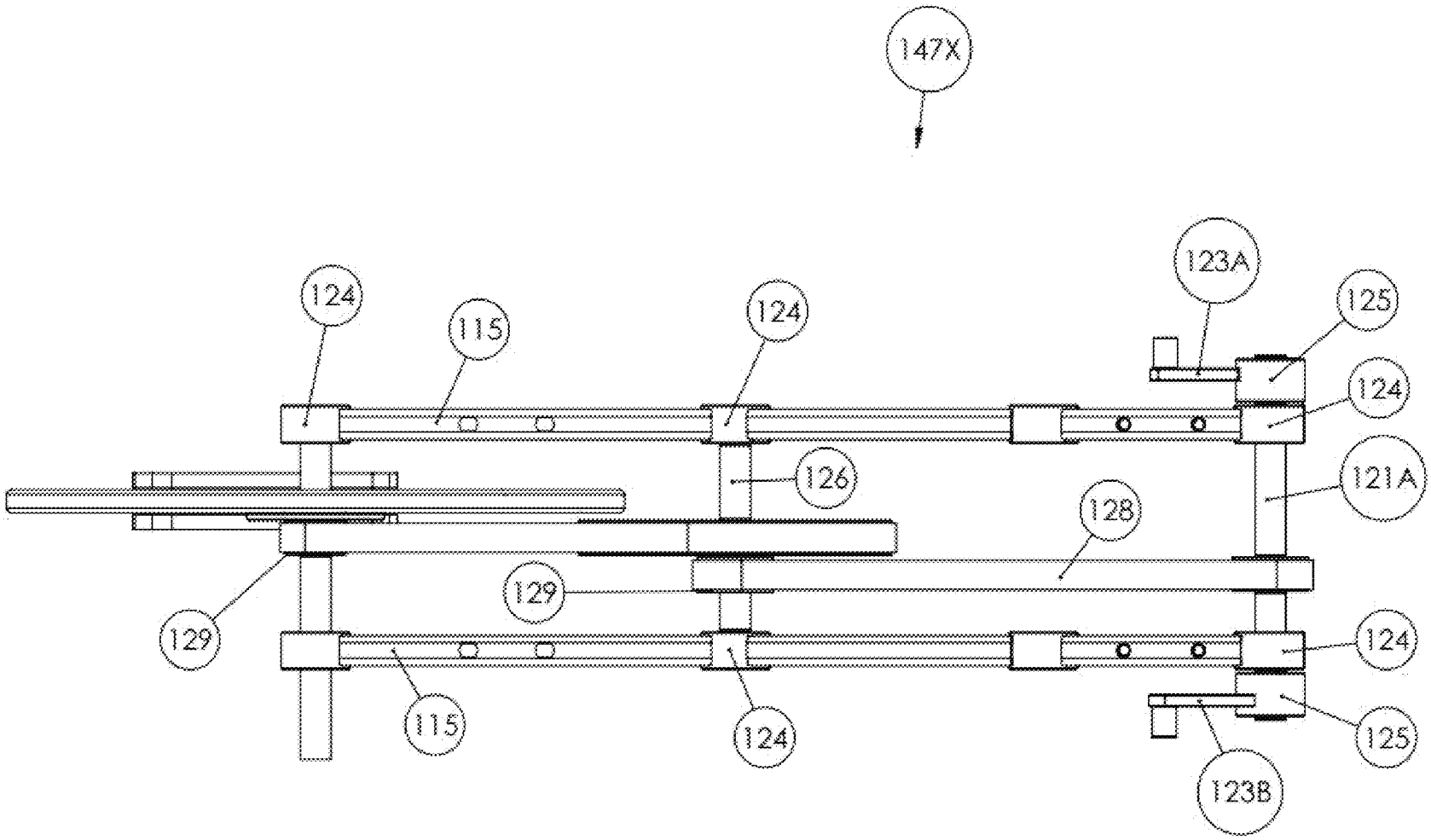
FIG. 5 is an isolated overhead view of the drive train assembly and the resistance assembly of the leg extension and leg curl station embodiment of the invention shown in FIG. 1.
Figure 6:
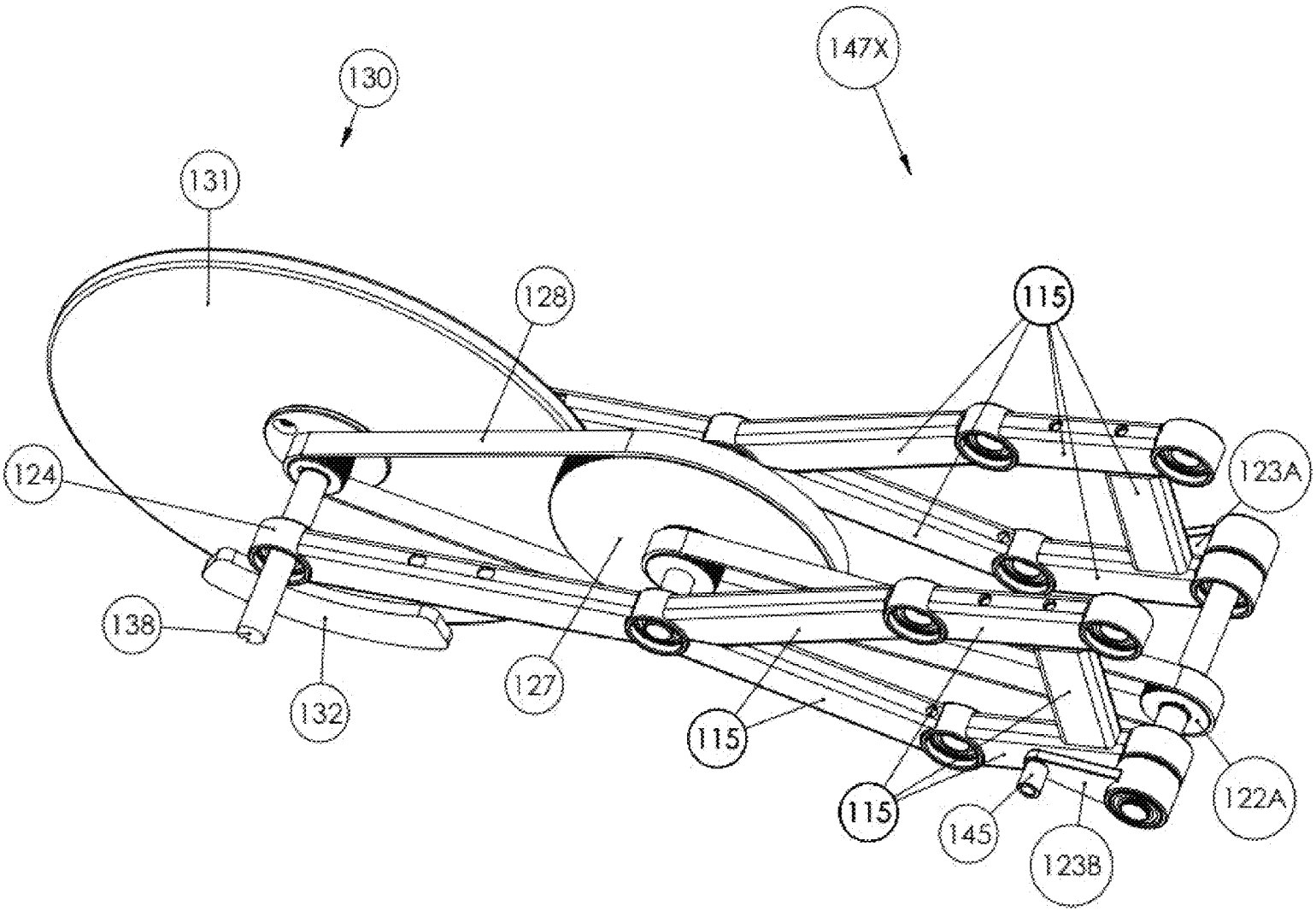
FIG. 6 is another isolated perspective view of the drive train assembly and the resistance assembly of the leg extension and leg curl station embodiment of the invention shown in FIG. 1.
Figure 7:
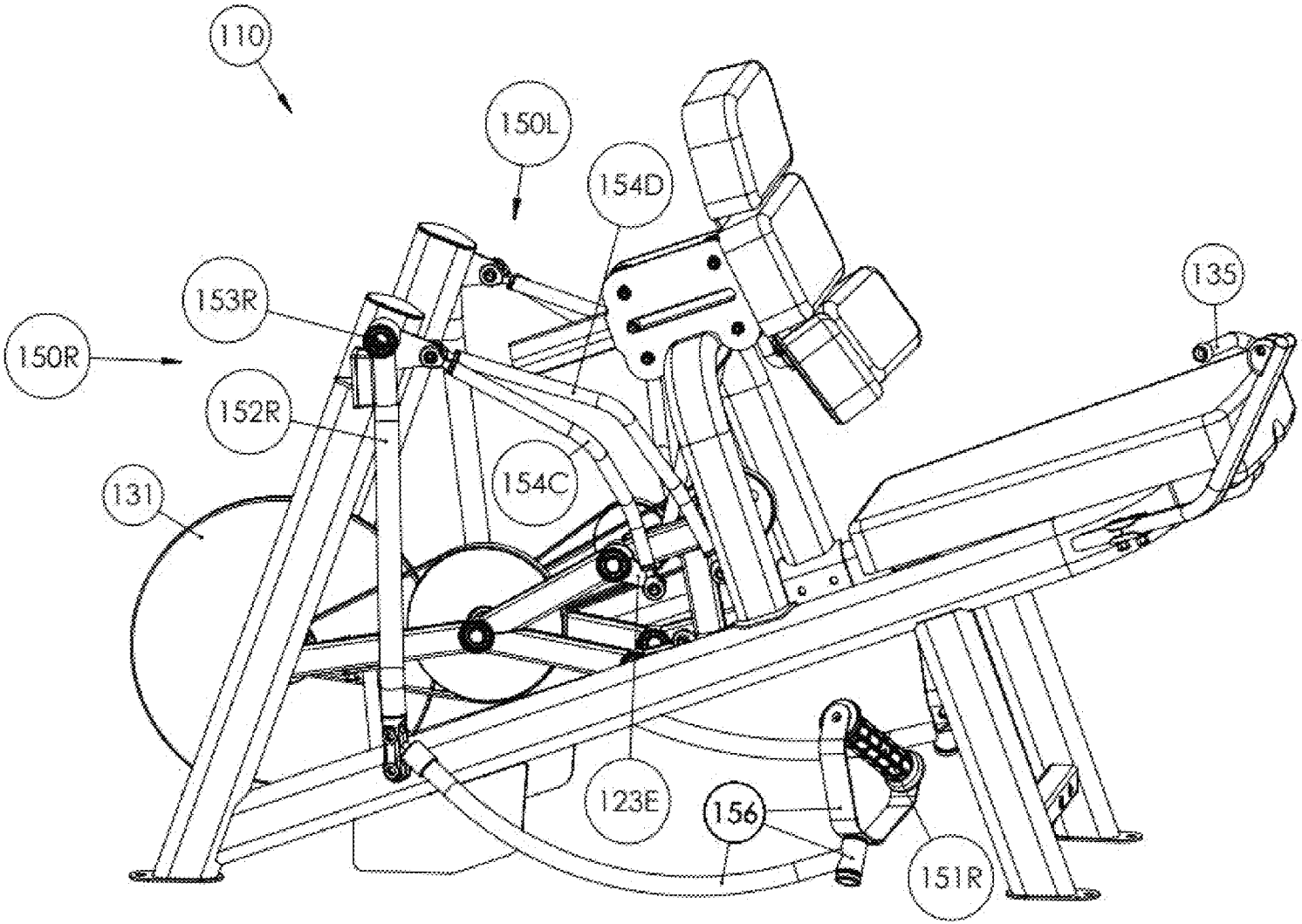
FIG. 7 is a perspective view of a biceps curl and triceps extension station embodiment of the invention.
Figure 8:
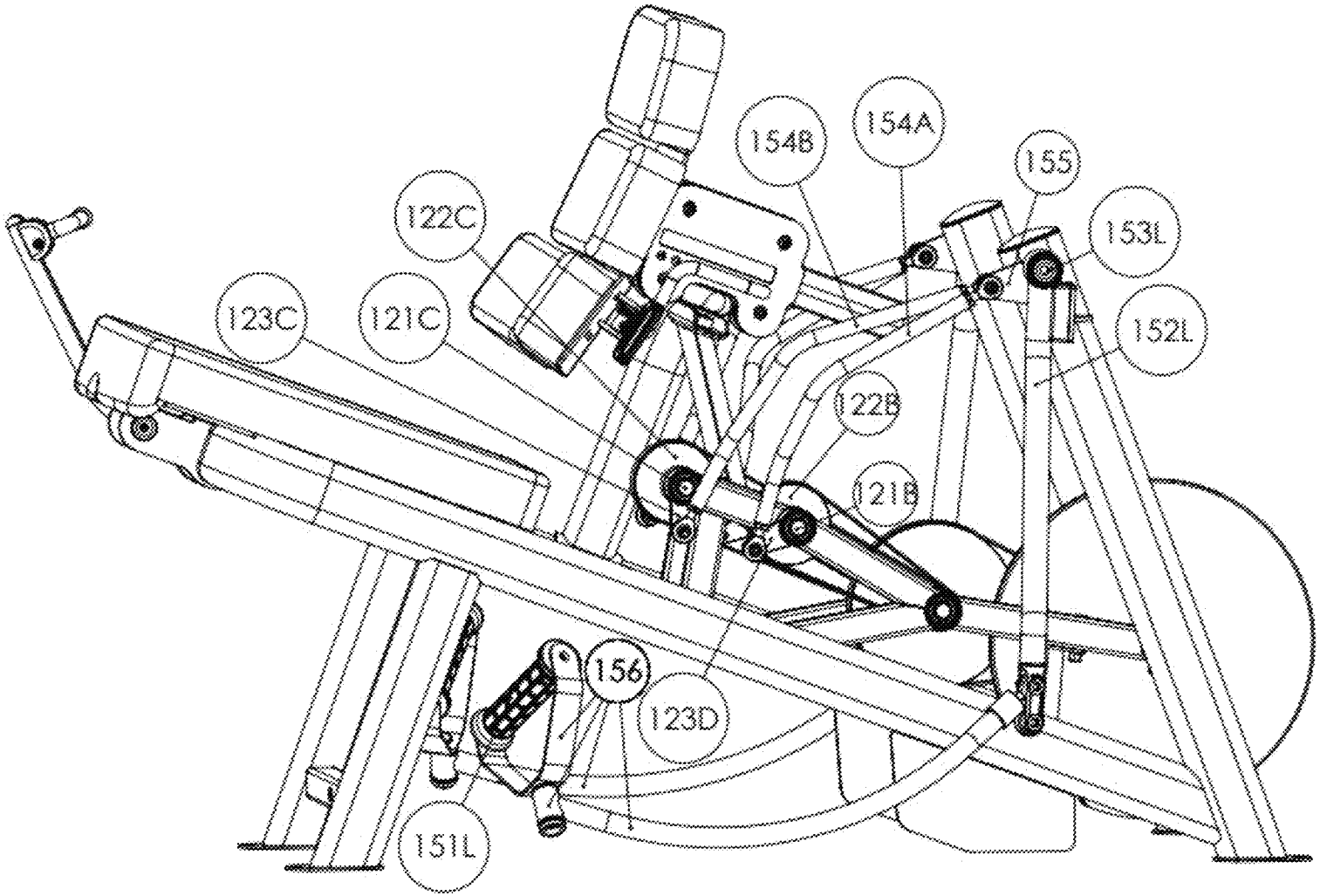
FIG. 8 is another perspective view of the biceps curl and triceps extension station embodiment of the invention shown in FIG. 7.
Figure 9:
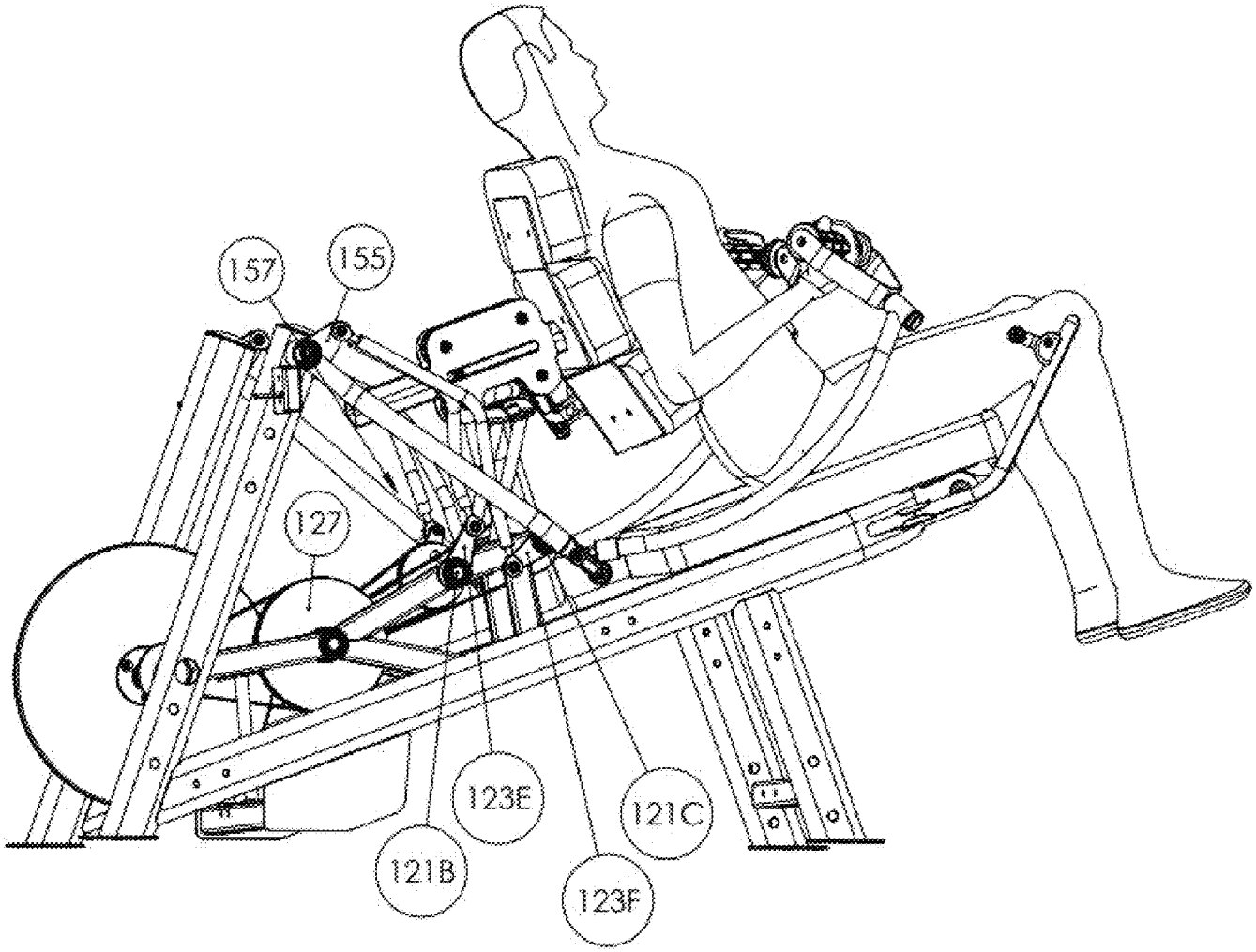
FIG. 9 is another perspective view of the biceps curl and triceps extension station embodiment of the invention shown in FIG. 7.
Figure 10:
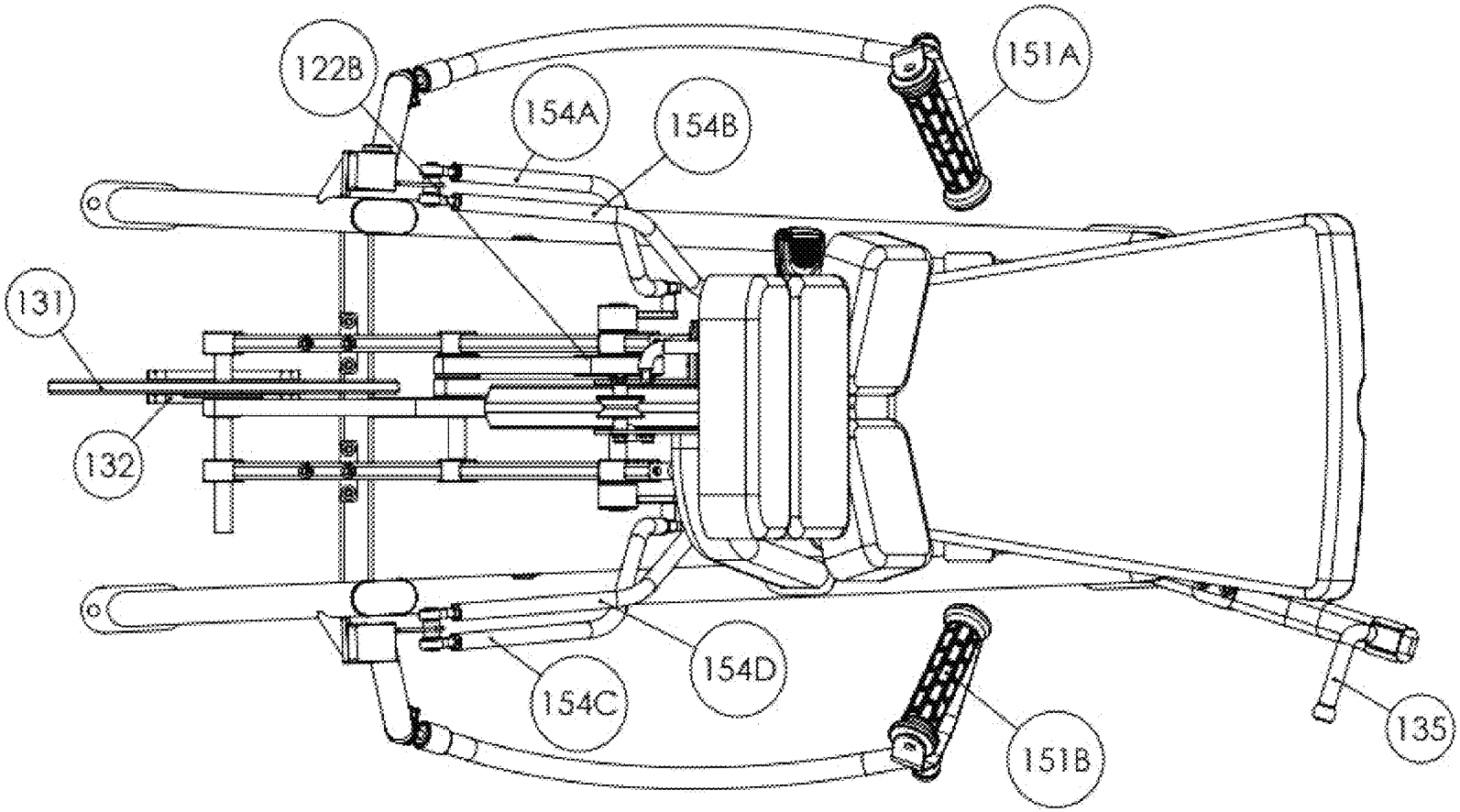
FIG. 10 is an overhead view of the biceps curl and triceps extension station embodiment of the invention shown in FIG. 7.

FIGS. 1-6 illustrate a single exercise station embodiment of the invention wherein machine 110 is configured with a legs station mounted on machine frame 114 for performing leg extension and leg curl exercises. FIGS. 1-4 illustrate the entirety of the machine and FIGS. 5 and 6 illustrate isolated views of the drive train assembly 147X and resistance assembly 130 of this embodiment.

User support pads 116 support a user U in a seated position. Left and right stationary grip handles 118 are rigidly mounted to machine frame 114 on either side of user support pad seat 116. The legs station user engagement actuator assembly 140 includes a set of forward left and right user engagement pads 141 and rearward left and right user engagement pads 141 for being engaged by a user's ankles that are operatively connected to an actuator lever 142 that pivots about actuator lever pivot 143. User engagement actuator assembly 140 is constructed with multiple actuator assembly components 146 that collectively support and guide the motion of user engagement actuator assembly 140.

Rigid drive links 144A and 144B operatively connect user engagement actuator assembly 140 to drive train assembly 147X and resistance assembly 130 as follows. Rigid drive link 144A has a first end and a second end. The first end of rigid drive link 144A is pivotally connected to the lower end of actuator lever 142 with a rigid drive link connector 145 and the second end of rigid drive link 144A is pivotally connected to axle drive flange 123A with a rigid drive link connector 145. Rigid drive link 144B has a first end and a second end. The first end of rigid drive link 144B is pivotally connected to the lower end of actuator lever 142 with a rigid drive link connector 145 and the second end of rigid drive link 144B is pivotally connected to axle drive flange 123B with a rigid drive link connector 145.

FIGS. 5 and 6 are isolated views of legs station drive train assembly 147X, which is configured as follows. A one-direction drive pulley axle 121A has a first end and a second end and is mounted on a forward lower section of drive train frame 115. A first one-direction clutch bearing 125 is mounted on a first end of one-direction drive pulley axle 121A and an axle drive flange 123A is rigidly connected to the first one-direction clutch bearing 125. A second one-direction clutch bearing 125 is mounted on a second end of one-direction drive pulley axle 121A and axle drive flange 123B is rigidly connected to the second one-direction clutch bearing 125. A drive pulley 122A is rigidly mounted on a central section of one-direction drive pulley axle 121A. A one-direction flywheel booster pulley axle 126 is mounted on a central section of drive train frame 115 and a flywheel booster pulley 127 is rigidly mounted on a central section of one-direction flywheel booster pulley axle 126. A guide pulley 129 is also rigidly mounted on a central section of one-direction flywheel booster pulley axle 126. A drive belt 128 connects drive pulley 122A to guide pulley 129 that is rigidly mounted on one-direction flywheel booster pulley axle 126.

A resistance assembly 130 is operatively connected to legs station drive train assembly 147X and mounted on a rearward section of drive train frame 115. Resistance assembly 130 is configured as follows. A one-direction flywheel axle 138 is mounted on a rearward section of drive train frame 115, a flywheel 131 is rigidly mounted on a central section of one-direction flywheel axle 138, and a guide pulley 129 is rigidly mounted on a central section of one-direction flywheel axle 138. A set of resistance magnets 132 are mounted on machine frame 114 proximal to flywheel 131 and resistance magnets 132 are operatively engaged with flywheel 131. A resistance magnets adjustment lever 135 is operatively connected to resistance magnets 132 and resistance magnets adjustment lever 135 is mounted on machine frame 114 within reach of user U. A drive belt 128 connects flywheel booster pulley 127 to a guide pulley 129 that is rigidly mounted on a central section of one-direction flywheel axle 138.

To operate the legs station embodiment of the machine 110 illustrated in FIGS. 1-6, user U enters machine 110, assumes a seated position on user support pads 116, and places user U's legs in a bent knee position with user U's ankles in between the forward and rearward user engagement pads 141. User U can then adjust the amount of resistance to the rotation of flywheel 131 by moving resistance magnets adjustment lever 135 to a preferred fixed setting of resistance.

To begin the push motion exercise, user U extends user U's legs so that user U's ankles and user engagement pads 141 move forward in an upward arc. This causes the collective leg station user engagement actuator assembly components 146 to move forward and upward as actuator lever 142 pivots forward and upward about actuator lever pivot 143. This causes rigid drive links 144A and 144B to move forward, which causes axle drive flange 123A that is connected to a one-direction clutch bearing 125 and axle drive flange 123B that is connected to a one-direction clutch bearing 125 to pivot forward about one-direction drive pulley axle 121A. This causes the one-direction clutch bearing that is connected to axle drive flange 123A to engage and rotate one-direction drive pulley axle 121A and causes the one-direction clutch bearing that is connected to axle drive flange 123B to disengage with one-direction drive pulley axle 121A and rotate passively on one-direction drive pulley axle 121A. This causes drive pulley 122A to rotate, which rotates a drive belt 128 that connects drive pulley 122A to a guide pulley 129 that is rigidly mounted on one-direction flywheel booster pulley axle 126, which rotates flywheel booster pulley 127, which rotates a belt 128 that connects flywheel booster pulley 127 to a guide pulley 129 that is rigidly mounted on one-direction flywheel axle 138, which rotates flywheel 131.

To switch the exercise to the reciprocating pull motion, user U bends user U's legs so that user U's ankles and user engagement pads 141 move rearward in a downward arc. This causes the collective leg station user engagement actuator assembly components 146 to move rearward and downward as actuator lever 142 pivots rearward and downward about actuator lever pivot 143. This causes rigid drive links 144A and 144B to move rearward, which causes axle drive flange 123A that is connected to a one-direction clutch bearing 125 and axle drive flange 123B that is connected to a one-direction clutch bearing 125 to pivot rearward about one-direction drive pulley axle 121A. This causes the one-direction clutch bearings 125 that is connected to axle drive flange 123A to disengage from one-direction drive pulley axle 121A and rotate passively on one-direction drive pulley axle 121A and causes the one-direction clutch bearing 125 that is connected to axle drive flange 123B to engage and rotate one-direction drive pulley axle 121A in the same one direction of rotation. This causes drive pulley 122A to rotate, which rotates a drive belt 128 that connects drive pulley 122A to a guide pulley 129 that is rigidly mounted on one-direction flywheel booster pulley axle 126, which rotates flywheel booster pulley 127, which rotates a belt 128 that connects flywheel booster pulley 127 to a guide pulley 129 that is rigidly mounted on one-direction flywheel axle 138, which continues to rotate flywheel 131 in the same one direction of rotation. User U can continue to perform this reciprocating pushing and pulling legs exercise motion for the desired number of repetitions.

As best illustrated in FIGS. 2-6, the push and pull resistance ratios of this legs station embodiment are achieved by manipulating the location of the connection point of rigid drive link 144A to axle drive flange 123A and the distance of that connection point from one-direction drive pulley axle 121A controls the amount of force required to move the user engagement actuator assembly 140 in a first motion leg extension pushing exercise. The same method is used to manipulate the ratio of resistance to the reciprocating second motion leg curl pulling exercise wherein manipulating the location of the connection point of rigid drive link 144B to axle drive flange 123B and the distance of that connection point from one-direction drive pulley axle 121A controls the amount of force required to move the user engagement actuator assembly 140 in the second motion pull direction. It requires more force to move the user engagement actuator assembly 140 if the connection point of a rigid drive link 144 to an axle drive flange 123 is located a shorter distance from the cooperating one-direction drive pulley axles 121 and it requires less force to move the user engagement actuator assembly 140 if the connection point of a rigid drive link 144 to an axle drive flange 123 is located a longer distance from the cooperating one-direction drive pulley axle 121.

The primary muscle group engaged in a leg extension pushing exercise are the quadriceps and the primary muscle group engaged in a leg curl pulling exercise are the hamstrings. Generally, the quadriceps muscles are approximately 20% stronger than the hamstring muscles, therefore the location of the connection points of rigid drive links 144 to axle drive flanges 123 are sufficiently distanced from the cooperating one-direction drive pulley axles 121 to create resistance ratios that require approximately 20% more force to move user engagement actuator assembly 140 to perform the leg extension pushing exercise than the leg curl pulling exercise. The ratios of the push and pull resistance of this embodiment can also be affected by the connection points of rigid drive links 144 to the user engagement actuator assembly 140, but the preferred method is as described herein.

Figure 11:
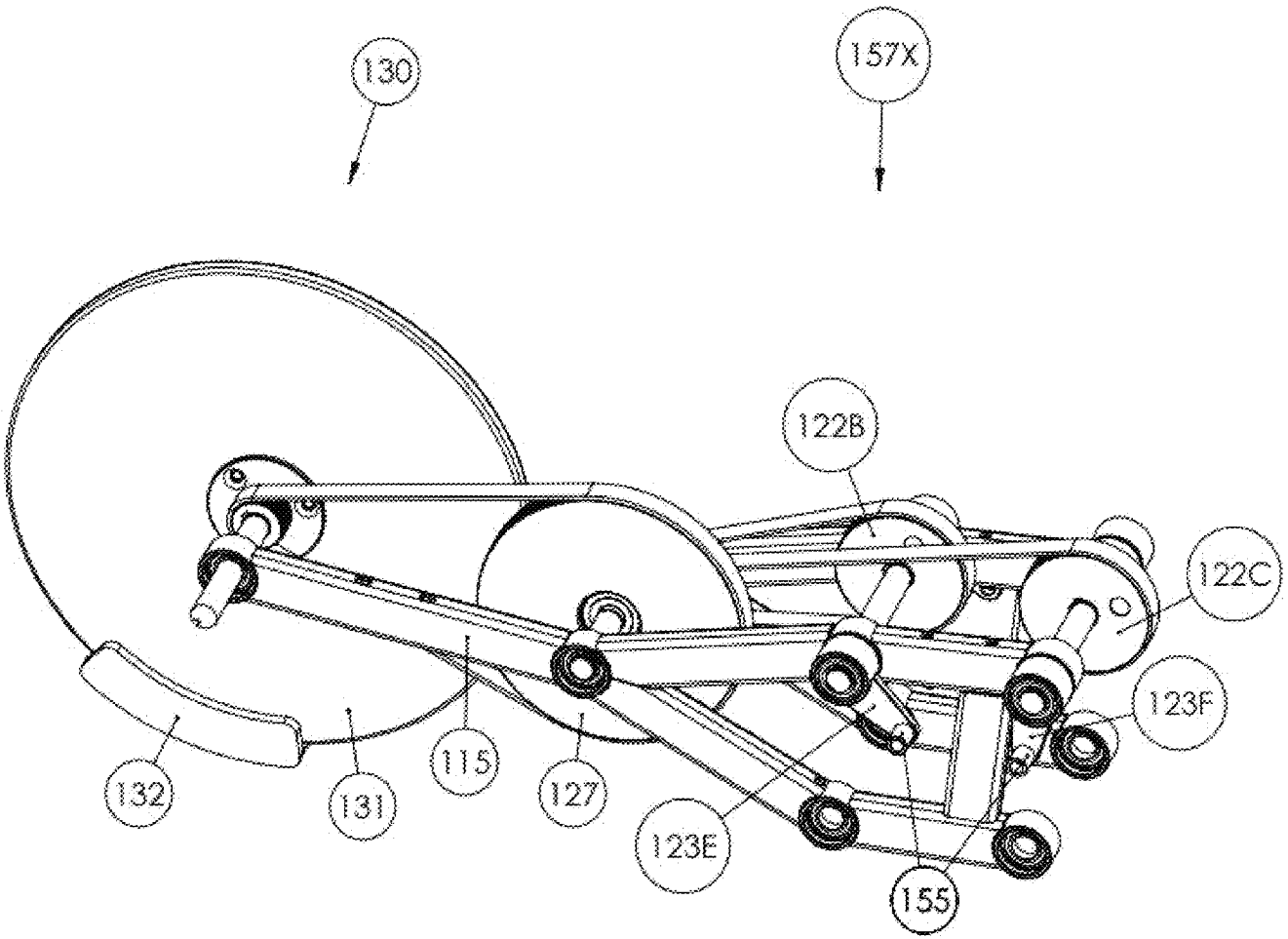
FIG. 11 is an isolated perspective view of the drive train assembly and the resistance assembly of the biceps curls and triceps extension station embodiment of the invention shown in FIG. 7.
Figure 12:
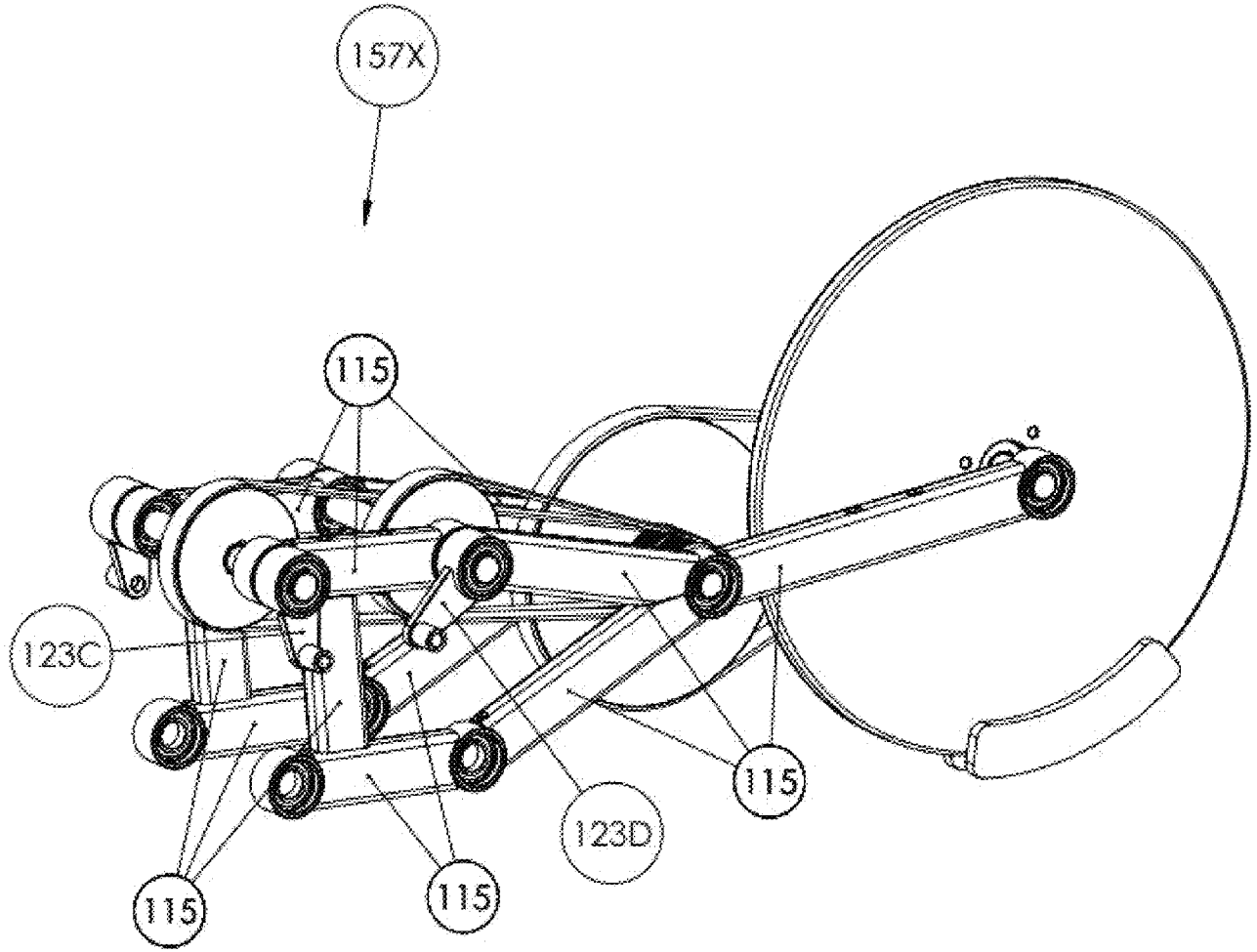
FIG. 12 is another isolated perspective view of the drive train assembly and the resistance assembly of the biceps curls and triceps extension station embodiment of the invention shown in FIG. 7.
Figure 13:
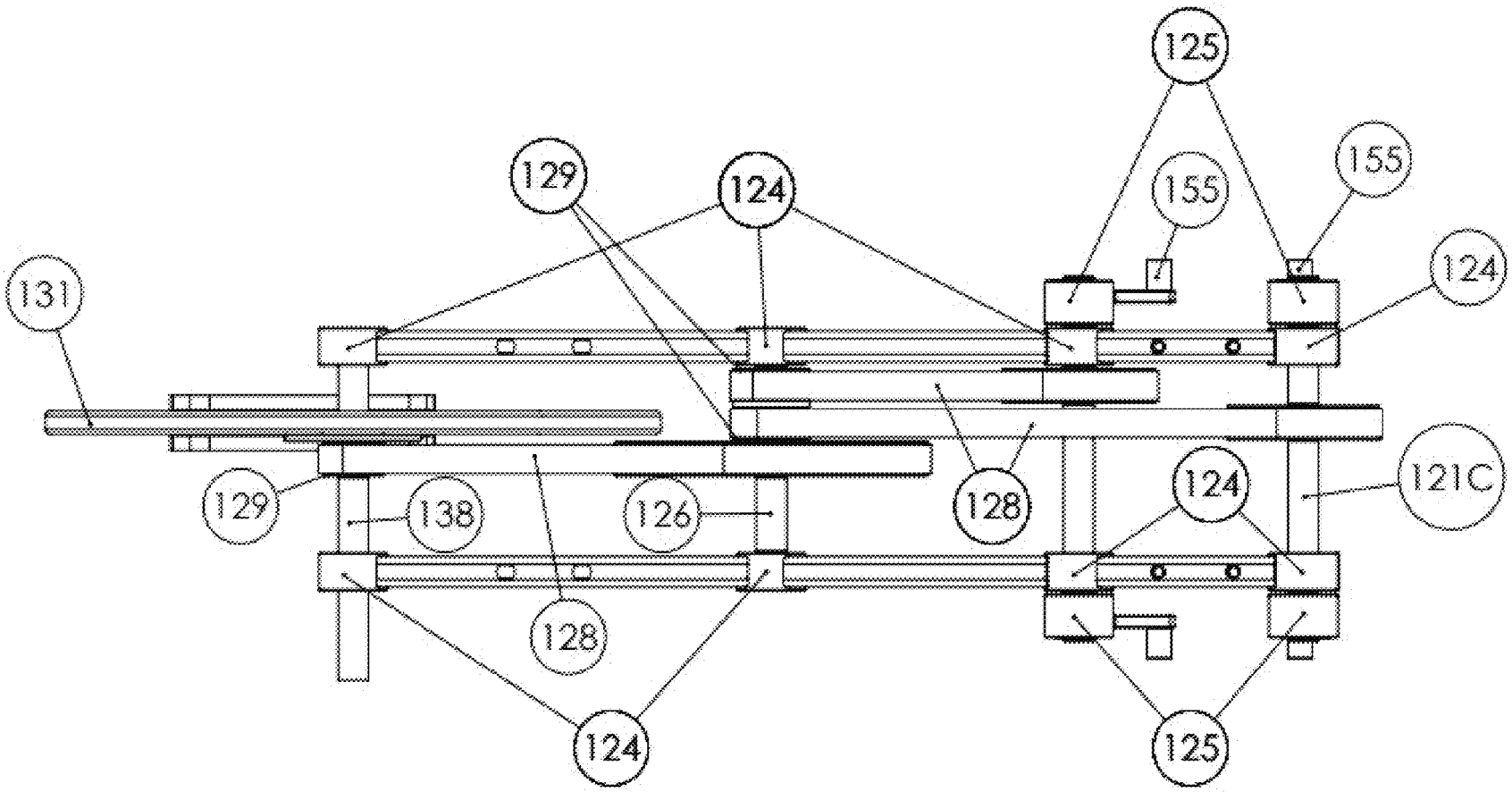
FIG. 13 is an isolated overhead view of the drive train assembly and the resistance assembly of the biceps curls and triceps extension station embodiment of the invention shown in FIG. 7.

FIGS. 7-13 illustrate a single exercise station embodiment of the invention wherein machine 110 is configured with an arms station mounted on machine frame 114 for performing independent left and right biceps curls and triceps extensions. FIGS. 7-10 illustrate the entirety of the machine and FIGS. 11-13 illustrate isolated views of the drive train assembly and resistance assembly of this embodiment.

User support pads 116 support a user U in a seated position. This arms station embodiment features two mostly identical opposing left and right user engagement actuator assemblies 150L and 150R, which each include a left and right gripping handles 151L and 151R that are operatively connected to left and right actuator levers 152L and 152R that pivot about actuator lever pivots 153L and 153R respectively. User engagement actuator assemblies 150L and 150R are constructed with multiple actuator assembly components 156 that collectively support and guide the motion of user engagement actuator assemblies 150L and 150R.

Rigid drive links 154A and 154B operatively connect user engagement actuator assembly 150L to drive train assembly 157X and resistance assembly 130 as follows. Rigid drive link 154A has a first end and a second end. The first end of rigid drive link 154A is pivotally connected to the upper end of actuator lever 152L with a rigid drive link connector 155 and the second end of rigid drive link 154A is pivotally connected to axle drive flange 123D with a rigid drive link connector 155. Rigid drive link 154B has a first end and a second end. The first end of rigid drive link 1546 is pivotally connected to the upper end of actuator lever 152L with a rigid drive link connector 155 and the second end of rigid drive link 154A is pivotally connected to axle drive flange 123C with a rigid drive link connector 155. Rigid drive links 154C and 154D operatively connect user engagement actuator assembly 150R to drive train assembly 157 and resistance assembly 130 as follows. Rigid drive link 154C has a first end and a second end. The first end of rigid drive link 154C is pivotally connected to the upper end of actuator lever 152R with a rigid drive link connector 155 and the second end of rigid drive link 154C is pivotally connected to axle drive flange 123E with a rigid drive link connector 155. Rigid drive link 154D has a first end and a second end. The first end of rigid drive link 154D is pivotally connected to the upper end of actuator lever 152R with a rigid drive link connector 155 and the second end of rigid drive link 154D is pivotally connected to axle drive flange 123F with a rigid drive link connector 155.

FIGS. 11-13 are isolated views of arms station drive train assembly 157X which is configured as follows. A one-direction drive pulley axle 121C has a first end and a second end and is mounted on a forward upper section of drive train frame 115. A first one-direction clutch bearing 125 is mounted on a first end of one-direction drive pulley axle 121C and axle drive flange 123C is rigidly connected to the first one-direction clutch bearing 125. A second one-direction clutch bearing 125 is mounted on a second end of one-direction drive pulley axle 121C and axle drive flange 123F is rigidly connected to the second one-direction clutch bearing 125. A drive pulley 122C is rigidly mounted on a central section of one-direction drive pulley axle 121C.

A one direction drive pulley axle 121B has a first end and a second end and is mounted on an upper forward central section of drive train frame 115. A first one-direction clutch bearing 125 is mounted on a first end of one-direction drive pulley axle 121B and axle drive flange 123D is rigidly connected to the first one-direction clutch bearing 125. A second one-direction clutch bearing 125 is mounted on a second end of one-direction drive pulley axle 121B and axle drive flange 123E is rigidly connected to the second one-direction clutch bearing 125. A drive pulley 122B is rigidly mounted on a central section of one-direction drive pulley axle 121B.

A one-direction flywheel booster pulley axle 126 is mounted on a central section of drive train frame 115 and a flywheel booster pulley 127 is rigidly mounted on a central section of one-direction flywheel booster pulley axle 126. A first guide pulley 129 is also rigidly mounted on a central section of one-direction flywheel booster pulley axle 126 and a second guide pulleys 129 is rigidly mounted on a central section of one-direction flywheel booster pulley axle 126. A drive belt 128 connects drive pulley 122C to first guide pulley 129 that is rigidly mounted on one-direction flywheel booster pulley axle 126 and a drive belt 128 connects drive pulley 122B to second guide pulley 129 that is rigidly mounted on one-direction flywheel booster pulley axle 126.

A resistance assembly 130 is operatively connected to arms station drive train assembly 157X and mounted on a rearward section of drive train frame 115. Resistance assembly 130 is configured as follows. A one-direction flywheel axle 138 is mounted on a rearward section of drive train frame 115, a flywheel 131 is rigidly mounted on a central section of one-direction flywheel axle 138, and a guide pulley 129 is rigidly mounted on a central section of one-direction flywheel axle 138. A set of resistance magnets 132 are mounted on machine frame 114 proximal to flywheel 131 and resistance magnets 132 are operatively engaged with flywheel 131. A resistance magnets adjustment lever 135 is operatively connected to resistance magnets 132 and resistance magnets adjustment lever 135 is mounted on machine frame 114 within reach of user U. A drive belt 128 connects flywheel booster pulley 127 to a guide pulley 129 that is rigidly mounted on a central section of one-direction flywheel axle 138.

To operate the arms station embodiment of the machine 110 illustrated in FIGS. 7-13, user U enters machine 110 and assumes a seated position on user support pads 116. User U can then adjust the amount of resistance to the rotation of flywheel 131 by moving resistance magnets adjustment lever 135 to a preferred fixed setting of resistance. This arms station embodiment is comprised of a left engagement actuator assembly 150L and a right user engagement actuator assembly 150R that can be operated independently of each other. However, for clarity of description, the function will be described as if user engagement actuator assemblies 150L and 150R are being used in unison.

To begin the pull motion exercise, user U grips user engagement handles 151L and 151R with user U's arms extended downward. User U then bends at the elbows to pull the handles in an upward arcing motion while keeping user U's upper arms mostly stationary. This causes the collective arms station user engagement actuator assemblies components 156 to move in an upward arc as actuator levers 152L and 152R pivot upward about actuator lever pivots 153L and 154R respectively. This causes rigid drive links 154A, 154B, 154C, 154D to move upward, which causes axle drive flanges 123C and 123F, which are each rigidly connected to a one-direction clutch bearing 125, to pivot upward about one-direction drive pulley axle 121C and causes axle drive flanges 123D and 123E, which are each rigidly connected to a one-direction clutch bearing 125, to pivot upward about one-direction drive pulley axle 121B. This causes the one-direction clutch bearings 125 that are rigidly connected to axle drive flanges 123C and 123F to engage and rotate one-direction drive pulley axle 121C and causes the one-direction clutch bearings 125 that are connected to axle drive flanges 123D and 123E to disengage from one-direction drive pulley axle 121B and to rotate passively on one-direction drive pulley axle 121B. This causes drive pulley 122C to rotate, which rotates a drive belt 128 that connects drive pulley 122C to a guide pulley 129 that is rigidly mounted on one-direction flywheel booster pulley axle 126, which rotates flywheel booster pulley 127, which rotates a belt 128 that connects flywheel booster pulley 127 to a guide pulley 129 that is rigidly mounted on one-direction flywheel axle 138, which rotates flywheel 131.

To switch the exercise to the reciprocating push motion, user U then extends user U's arms to push the handles in a downward arcing motion while keeping user U's upper arms mostly stationary. This causes the collective arms station user engagement actuator assemblies components 156 to move in a downward arc as actuator levers 152L and 152R pivot downward about actuator lever pivots 153L and 154R respectively. This causes rigid drive links 154A, 154B, 154C, 154D to move downward, which causes axle drive flanges 123C and 123F, which are each rigidly connected to a one-direction clutch bearing 125, to pivot downward about one-direction drive pulley axle 121C and causes axle drive flanges 123D and 123E, which are each rigidly connected to a one-direction clutch bearing 125, to pivot downward about one-direction drive pulley axle 121B. This cause the one-direction clutch bearings 125 that are rigidly connected axle drive flanges 123C and 123F to disengage from one-direction drive pulley axle 121C and passively rotate on one-direction drive pulley axle 121C and causes the one-direction clutch bearings 125 that are rigidly connected to axle drive flanges 123D and 123E to engage and rotate one-direction drive pulley axle 121B. This causes drive pulley 122B to rotate, which rotates a drive belt 128 that connects drive pulley 122C to a guide pulley 129 that is rigidly mounted on one-direction flywheel booster pulley axle 126, which rotates flywheel booster pulley 127, which rotates a belt 128 that connects flywheel booster pulley 127 to a guide pulley 129 that is rigidly mounted on one-direction flywheel axle 138, which continues to rotate flywheel 131 in the same one direction.

User U can also operate a left user engagement actuator assembly 150L and a right user engagement actuator assembly 150R independently and arms station drive train assembly 157 and resistance assembly 130 will function in the same manner as described herein. User U can continue to perform these reciprocating pushing and pulling arms exercise motions for the desired number of repetitions.

As best illustrated in FIGS. 7-10, the push and pull resistance ratios of this arms station embodiment are achieved for left side user engagement actuator assembly 150L by manipulating the location of the connection point of rigid drive link 154B to axle drive flange 123C and the distance of that connection point from one-direction drive pulley axle 121C controls the amount of force required to move the left user engagement actuator assembly 150L in the first motion pull direction. The same method is used to manipulate the ratio of resistance to the reciprocating second motion triceps extension pushing exercise wherein manipulating the location of the connection point of rigid drive link 154A to axle drive flange 123D and the distance of that connection point from one-direction drive pulley axle 121B controls the amount of force required to move the left user engagement actuator assembly 150L in the second motion push direction.

The method for achieving the resistance ratios for the right side user engagement actuator assembly 150R is identical to as described above using right side like components. It requires more force to move the user engagement actuator assembly 150L or user engagement actuator assembly 150R if the connection point of a rigid drive link 154 to an axle drive flange 123 is located a shorter distance from the cooperating one-direction drive pulley axle 121 and it requires less force to move the user engagement actuator assembly 150L or user engagement actuator assembly 150R if the connection point of a rigid drive link 154 to an axle drive flange 123 is located a longer distance from the cooperating one-direction drive pulley axle 121.

The primary muscle group engaged in the pulling motion for this embodiment are the biceps and the primary muscle group engaged in the pushing motion are the triceps. Generally, the biceps muscle are approximately 15% weaker than the triceps muscles; therefore, the location of the connection points of rigid drive links 154 to axle drive flanges 123 are sufficiently distanced from one-direction drive pulley axles 121 to create resistance ratios that require 15% more force to move left and right user engagement actuator assemblies 150L and 150R to perform the pushing triceps extension exercise than the pulling biceps curl exercise. The ratios of the push and pull resistance of this embodiment can also be affected by the connection points of rigid drive links 154A, 154B, 154C, 154D to the user engagement actuator assemblies 150; however, the preferred method is as described herein.

Figure 14:
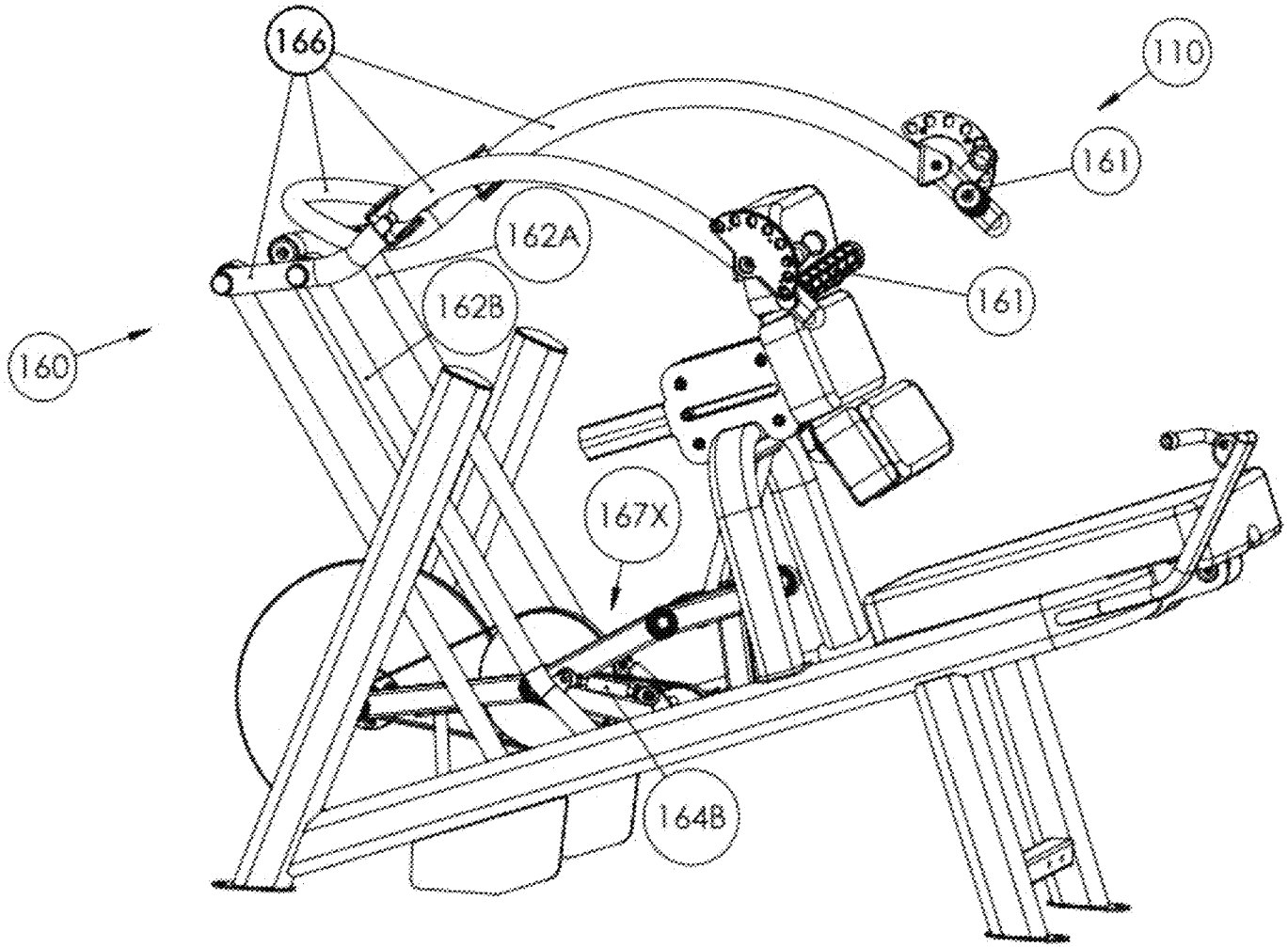
FIG. 14 is a perspective view of a torso station embodiment of the invention.
Figure 15:
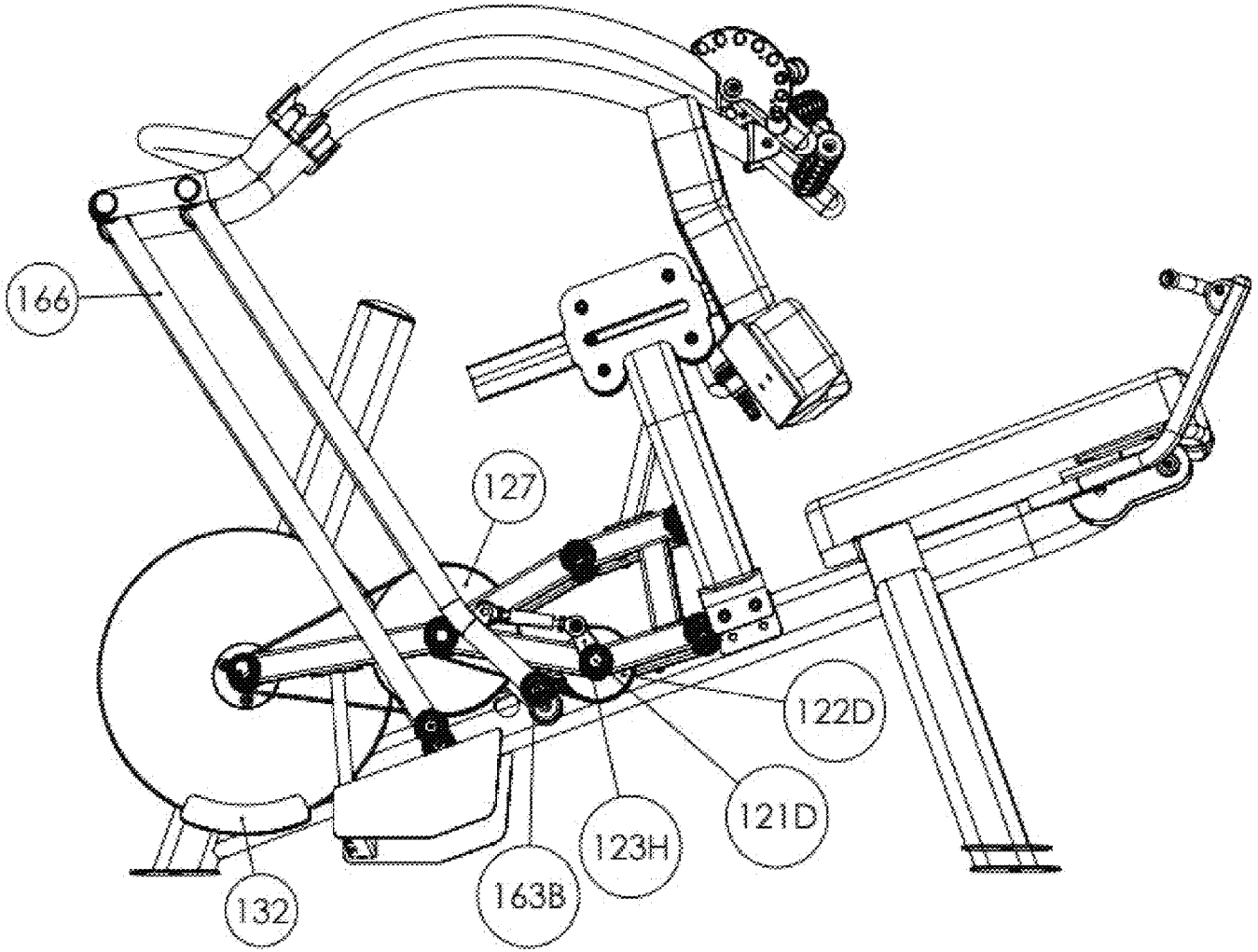
FIG. 15 is a side view of the torso station embodiment of the invention shown in FIG. 14. Some components are removed to provide an unobstructed view of other components.
Figure 16:
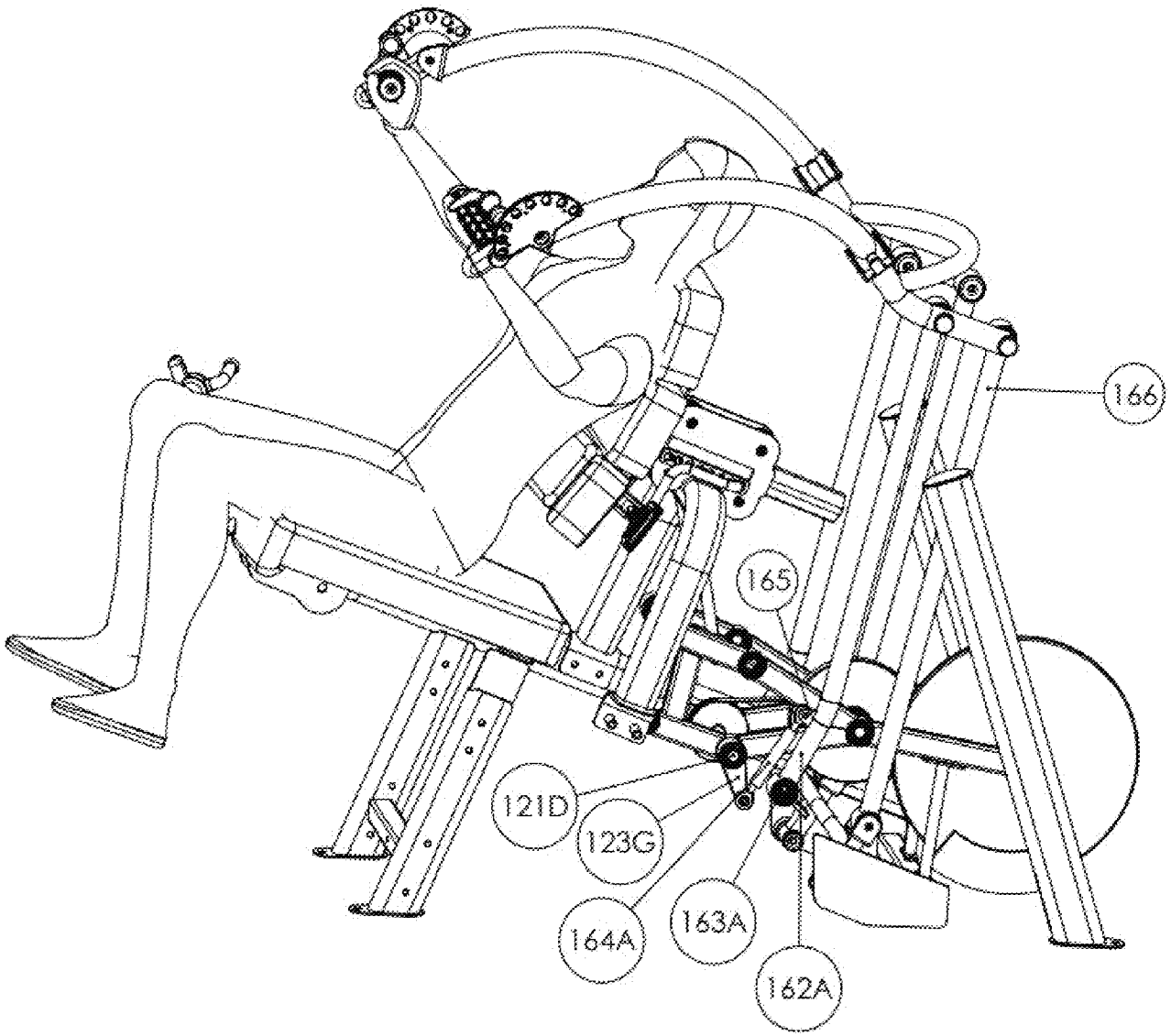
FIG. 16 is a perspective view of the torso station embodiment of the invention shown in FIG. 14. Some components are removed to provide an unobstructed view of other components.
Figure 17:
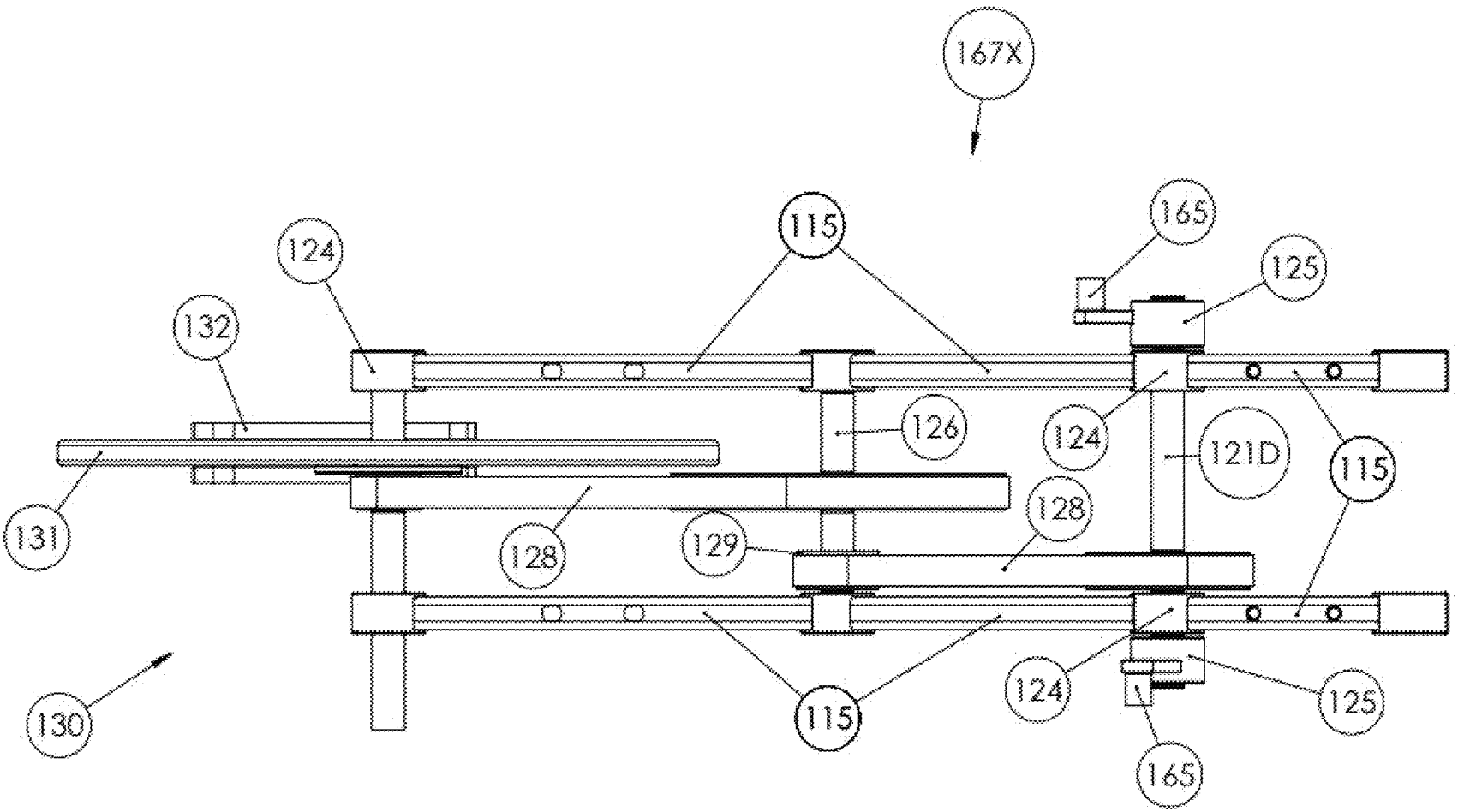
FIG. 17 is an isolated overhead view of the drive train assembly and the resistance assembly of the torso station embodiment of the invention shown in FIG. 14.
Figure 18:
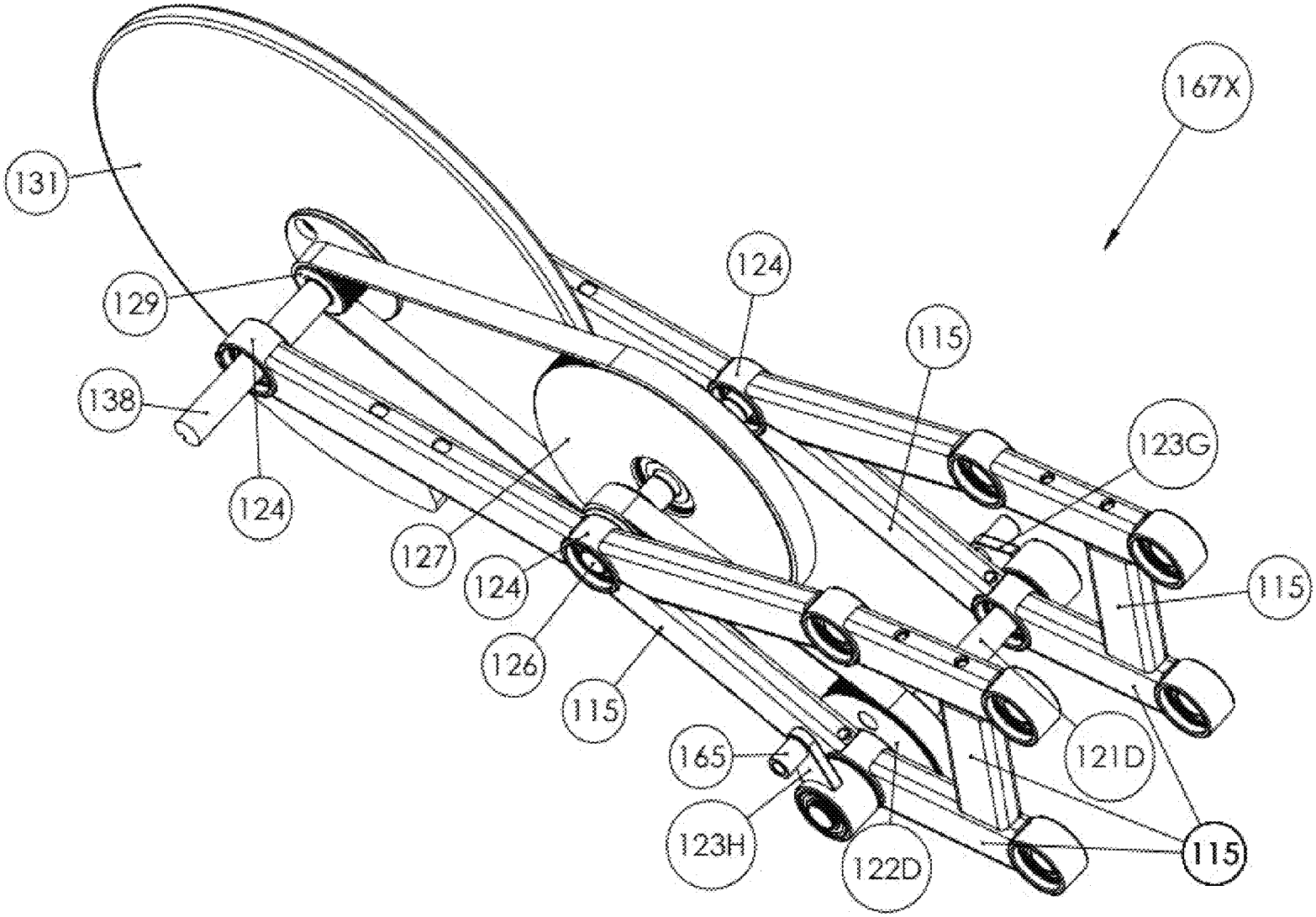
FIG. 18 is another isolated perspective view of the drive train assembly and the resistance assembly of the torso station embodiment of the invention shown in FIG. 14.
Figure 19:
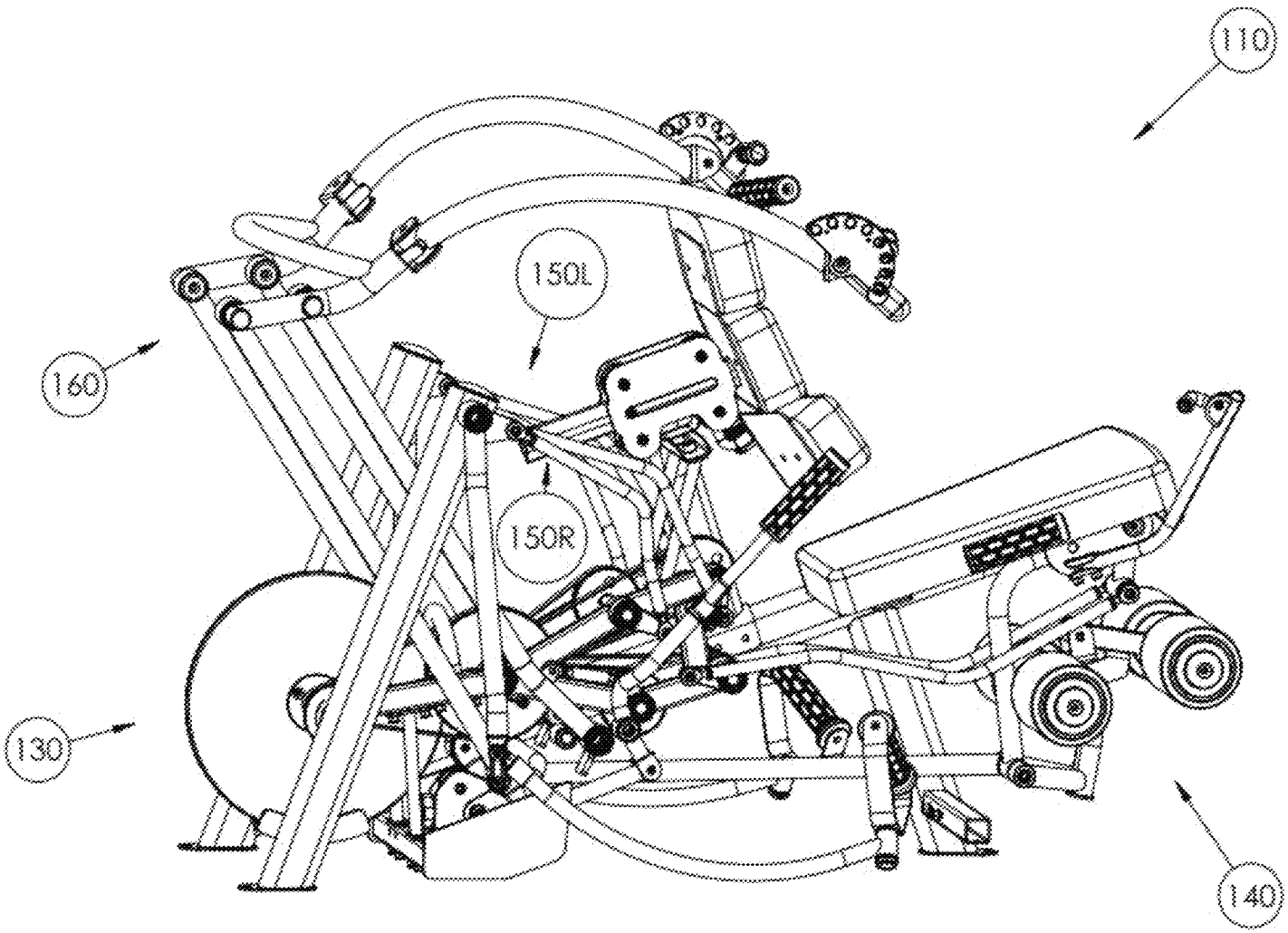
FIG. 19 is a perspective view of a multi-stations embodiment of the invention. Some components are removed to provide an unobstructed view of other components.
Figure 20:
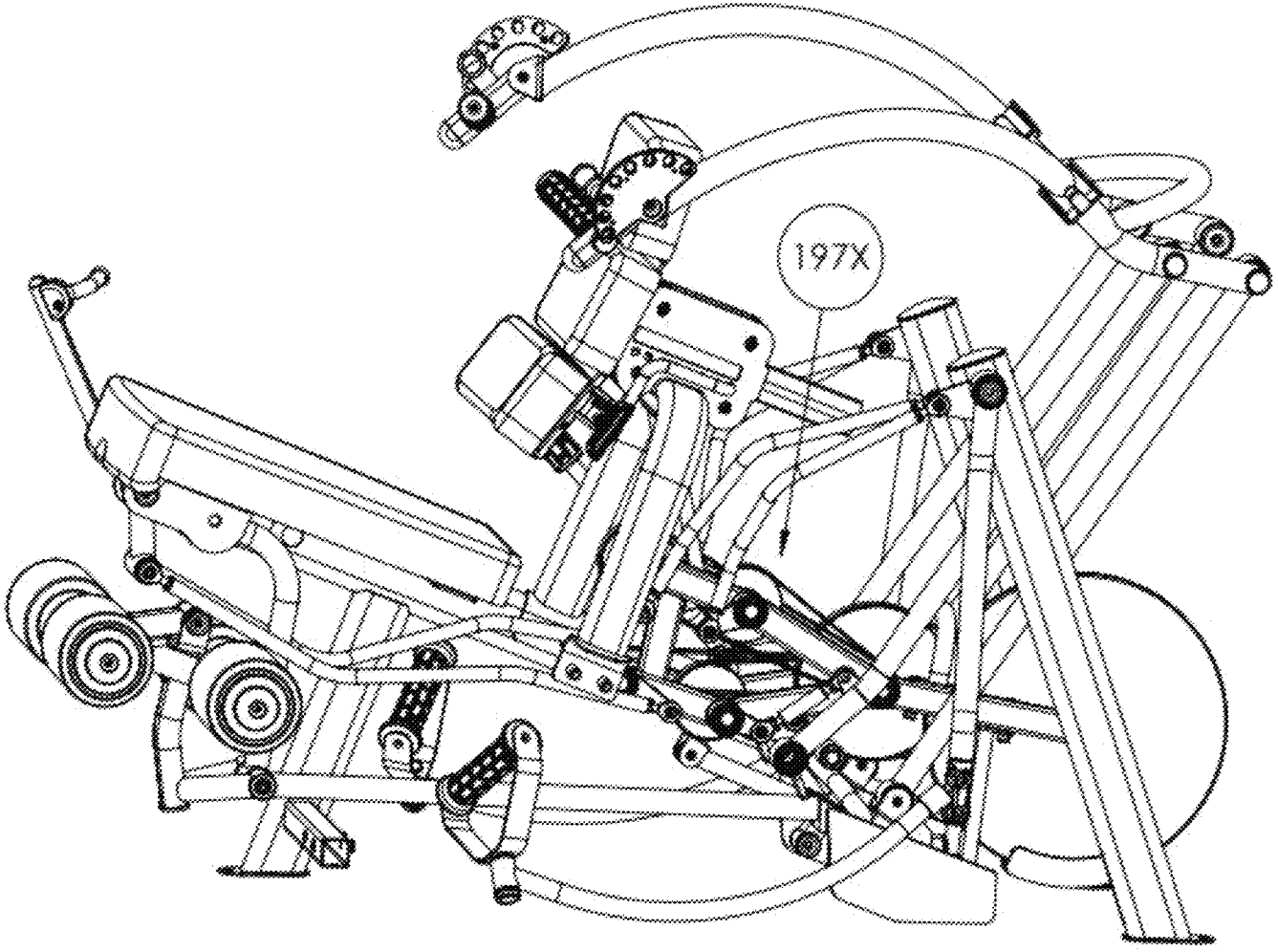
FIG. 20 is a perspective view of the multi-stations embodiment of the invention shown in FIG. 19. Some components are removed to provide an unobstructed view of other components.

FIGS. 14-18 illustrate a single exercise station embodiment of the invention wherein machine 110 is configured with a torso station mounted on machine frame 114 for performing chest press and back row exercises. FIGS. 14-16 illustrate the entirety of the machine and FIGS. 17 and 18 illustrate isolated views of the drive train assembly 167X and resistance assembly 130 of this embodiment. User support pads 116 support a user U in a seated position. The torso station user engagement actuator assembly 160 includes user engagement handles 161 that are operatively connected to an actuator lever 162A that pivots about actuator lever pivot 163A and an actuator lever 162B that pivots about actuator lever pivot 163B. User engagement actuator assembly 160 is constructed with multiple actuator assembly components 166 that collectively support and guide the motion of user engagement actuator assembly 160.

Rigid drive links 164A and 164B operatively connect user engagement actuator assembly 160 to drive train assembly 167X and resistance assembly 130 as follows. Rigid drive link 164A has a first end and a second end. The first end of rigid drive link 164A is pivotally connected to the lower end of actuator lever 162A with a rigid drive link connector 165 and the second end of rigid drive link 164A is pivotally connected to axle drive flange 123G with a rigid drive link connector 165. Rigid drive link 164B has a first end and a second end. The first end of rigid drive link 1646 is pivotally connected to the lower end of actuator lever 162B with a rigid drive link connector 165 and the second end of rigid drive link 164B is pivotally connected to axle drive flange 123H with a rigid drive link connector 165.

FIGS. 17 and 18 are isolated views of torso station drive train assembly 167X which is configured as follows. A one-direction drive pulley axle 121D has a first end and a second end and is mounted on a lower forward central section of drive train frame 115. A first one-direction clutch bearing 125 is mounted on a first end of one-direction drive pulley axle 121D and axle drive flange 123G is rigidly connected to the first one-direction clutch bearing 125. A second one-direction clutch bearing 125 is mounted on a second end of one-direction drive pulley axle 121D and axle drive flange 123H is rigidly connected to the second one-direction clutch bearing 125. A drive pulley 122D is rigidly mounted on a central section of one-direction drive pulley axle 121D. A one-direction flywheel booster pulley axle 126 is mounted on a central section of drive train frame 115 and a flywheel booster pulley 127 is rigidly mounted on a central section of one-direction flywheel booster pulley axle 126. A guide pulley 129 is also rigidly mounted on a central section of one-direction flywheel booster pulley axle 126. A drive belt 128 connects drive pulley 122D to guide pulley 129 that is rigidly mounted on one-direction flywheel booster pulley axle 126.

A resistance assembly 130 is operatively connected to torso station drive train assembly 167X and mounted on a rearward section of drive train frame 115. Resistance assembly 130 is configured as follows. A one-direction flywheel axle 138 is mounted on a rearward section of drive train frame 115, a flywheel 131 is rigidly mounted on a central section of one-direction flywheel axle 138, and a guide pulley 129 is rigidly mounted on a central section of one-direction flywheel axle 138. A set of resistance magnets 132 are mounted on machine frame 114 proximal to flywheel 131 and resistance magnets 132 are operatively engaged with flywheel 131. A resistance magnets adjustment lever 135 is operatively connected to resistance magnets 132 and resistance magnets adjustment lever 135 is mounted on machine frame 114 within reach of user U. A drive belt 128 connects flywheel booster pulley 127 to a guide pulley 129 that is rigidly mounted on a central section of one-direction flywheel axle 138.

To operate the torso station embodiment of the machine 110 illustrated in FIGS. 14-18, user U enters machine 110 and assumes a seated position on user support pads 116. User U can then adjust the amount of resistance to the rotation of flywheel 131 by moving resistance magnets adjustment lever 135 to a preferred fixed setting of resistance. User U then grips handles 161 close to user U's torso with a bent arm position.

To begin the push motion exercise, user U extends user U's arms so that user U's hands and user engagement handles 161 move forward in a mostly linear and mostly perpendicular path from user U's torso. This causes the collective torso station user engagement actuator assembly components 166 to move forward as actuator lever 162A pivots forward about actuator lever pivot 163A and actuator lever 162B pivots forward about actuator lever pivot 163B. This causes rigid drive links 164A and 164B to move forward, which causes axle drive flange 123G that is rigidly connected to a one-direction clutch bearing 125 and axle drive flange 123H that is rigidly connected to a one-direction clutch bearing 125 to pivot forward about one-direction drive pulley axle 121D. This causes the one-direction clutch bearing 125 that is rigidly connected to axle drive flange 123G to engage and rotate one-direction drive pulley axle 121D and causes the one-direction clutch bearing 125 that is connected to axle drive flange 123H to disengage with one-direction drive pulley axle 121D and rotate passively on one-direction drive pulley axle 121D. This causes drive pulley 122D to rotate, which rotates a drive belt 128 that connects drive pulley 122D to a guide pulley 129 that is rigidly mounted on one-direction flywheel booster pulley axle 126, which rotates flywheel booster pulley 127, which rotates a belt 128 that connects one-direction flywheel booster pulley 127 to a guide pulley 129 that is rigidly mounted on one-direction flywheel axle 138, which rotates flywheel 131.

To switch the exercise to the reciprocating pull motion, user U bends user U's arms so that user U's hands and user engagement handles 161 move in a mostly linear and mostly perpendicular path towards user U's torso. This causes the collective torso station user engagement actuator assembly components 166 to move rearward as actuator lever 162A pivots rearward about actuator lever pivot 163A and actuator lever 162B pivots rearward about actuator lever pivot 163B. This causes rigid drive links 164A and 164B to move rearward, which causes axle drive flange 123G that is rigidly connected to a one-direction clutch bearing 125 and axle drive flange 123H that is rigidly connected to a one-direction clutch bearing 125 to pivot rearward about one-direction drive pulley axle 121D. This causes the one-direction clutch bearings 125 that is rigidly connected to axle drive flange 123G to disengage from one-direction drive pulley axle 121D and rotate passively on one-direction drive pulley axle 121D and causes the one-direction clutch bearing 125 that is connected to axle drive flange 123H to engage and rotate one-direction drive pulley axle 121D in the same one direction of rotation. This causes drive pulley 122D to rotate, which rotates a drive belt 128 that connects drive pulley 122D to a guide pulley 129 that is rigidly mounted on one-direction flywheel booster pulley axle 126, which rotates flywheel booster pulley 127, which rotates a belt 128 that connects flywheel booster pulley 127 to a guide pulley 129 that is rigidly mounted on one-direction flywheel axle 138, which continues to rotate flywheel 131 in the same one direction of rotation. User U can continue to perform this reciprocating pushing and pulling torso exercise motion for the desired number of repetitions.

As best illustrated in FIGS. 15-18, the push and pull resistance ratios of this torso station embodiment are achieved by manipulating the location of the connection point of rigid drive link 164A to axle drive flange 123G and the distance of that connection point from one-direction drive pulley axle 121D controls the amount of force required to move the user engagement actuator assembly 160 in a first motion chest press pushing exercise. The same method is used to manipulate the ratio of resistance to the reciprocating second motion back row pulling exercise wherein manipulating the location of the connection point of rigid drive link 1646 to axle drive flange 123H and the distance of that connection point from one-direction drive pulley axle 121D controls the amount of force required to move the user engagement actuator assembly 160 in the second motion pull direction. It requires more force to move the user engagement actuator assembly 160 if the connection point of a rigid drive link 164 to an axle drive flange 123 is located a shorter distance from the cooperating one-direction drive pulley axles 121 and it requires less force to move the user engagement actuator assembly 160 if the connection point of a rigid drive link 164 to an axle drive flange 123 is located a longer distance from the cooperating one-direction drive pulley axles 121.

The primary muscle group engaged in a chest press pushing exercise are the pectorals and the primary muscle group engaged in a back row pulling exercise are the latissimus dorsi. Generally, the pectoral muscles are approximately 20% stronger than the latissimus dorsi muscles; therefore, the location of the connection point of rigid drive links 164A to axle drive flange 123G and the location of the connection point of rigid drive links 1646 to axle drive flange 123H are sufficiently distanced from the one-direction drive pulley axle 121D to create resistance ratios that require approximately 20% more force to move user engagement actuator assembly 160 to perform the chest press pushing exercise than the back row pulling exercise. The ratios of the push and pull resistance of this embodiment can also be affected by the connection points of rigid drive links 164A and 164B to the user engagement actuator assembly 160, but the preferred method is as described herein.

Figure 21:
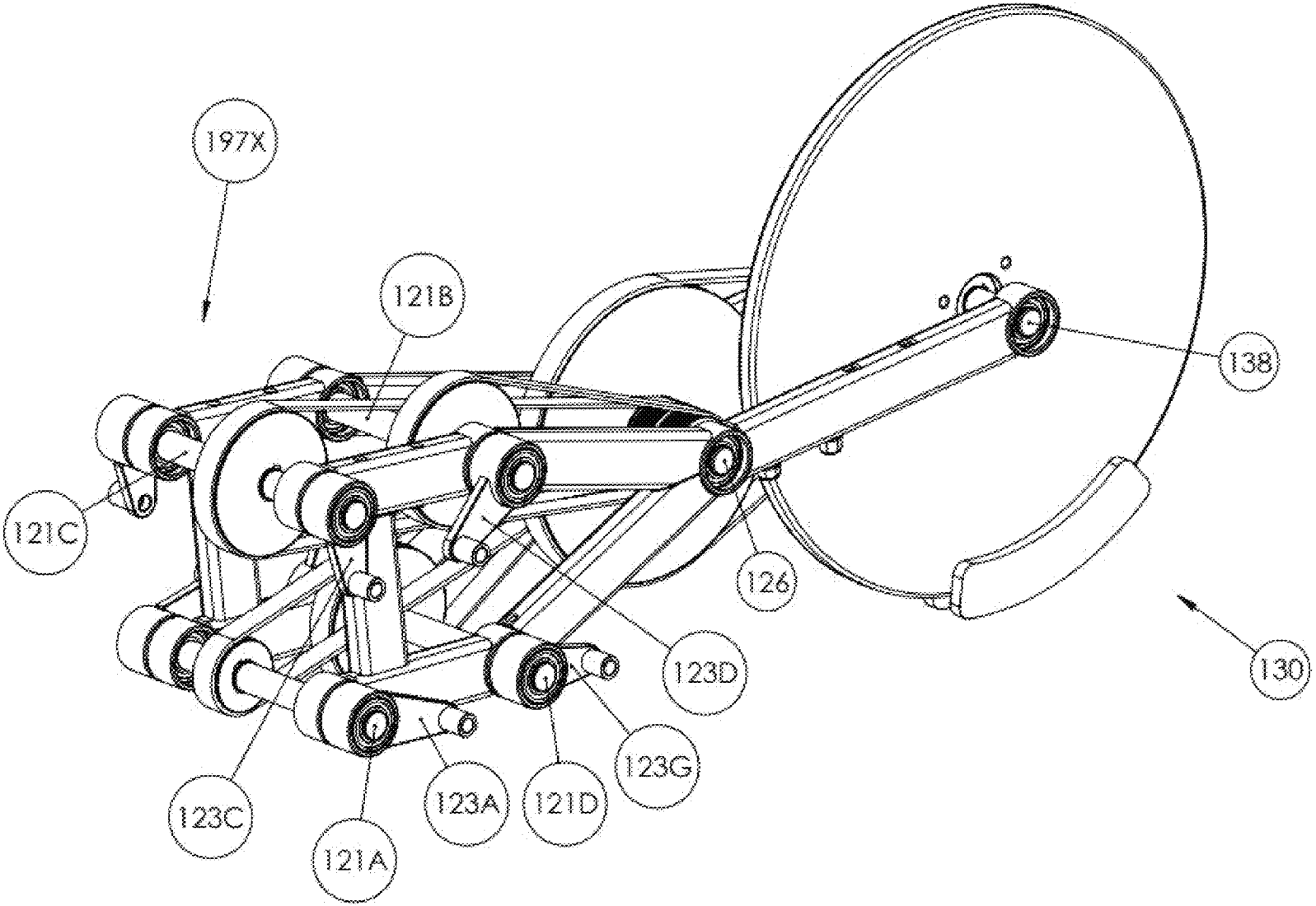
FIG. 21 is an isolated perspective view of the drive train assembly and the resistance assembly of the multi-stations embodiment of the invention shown in FIG. 19.
Figure 22:
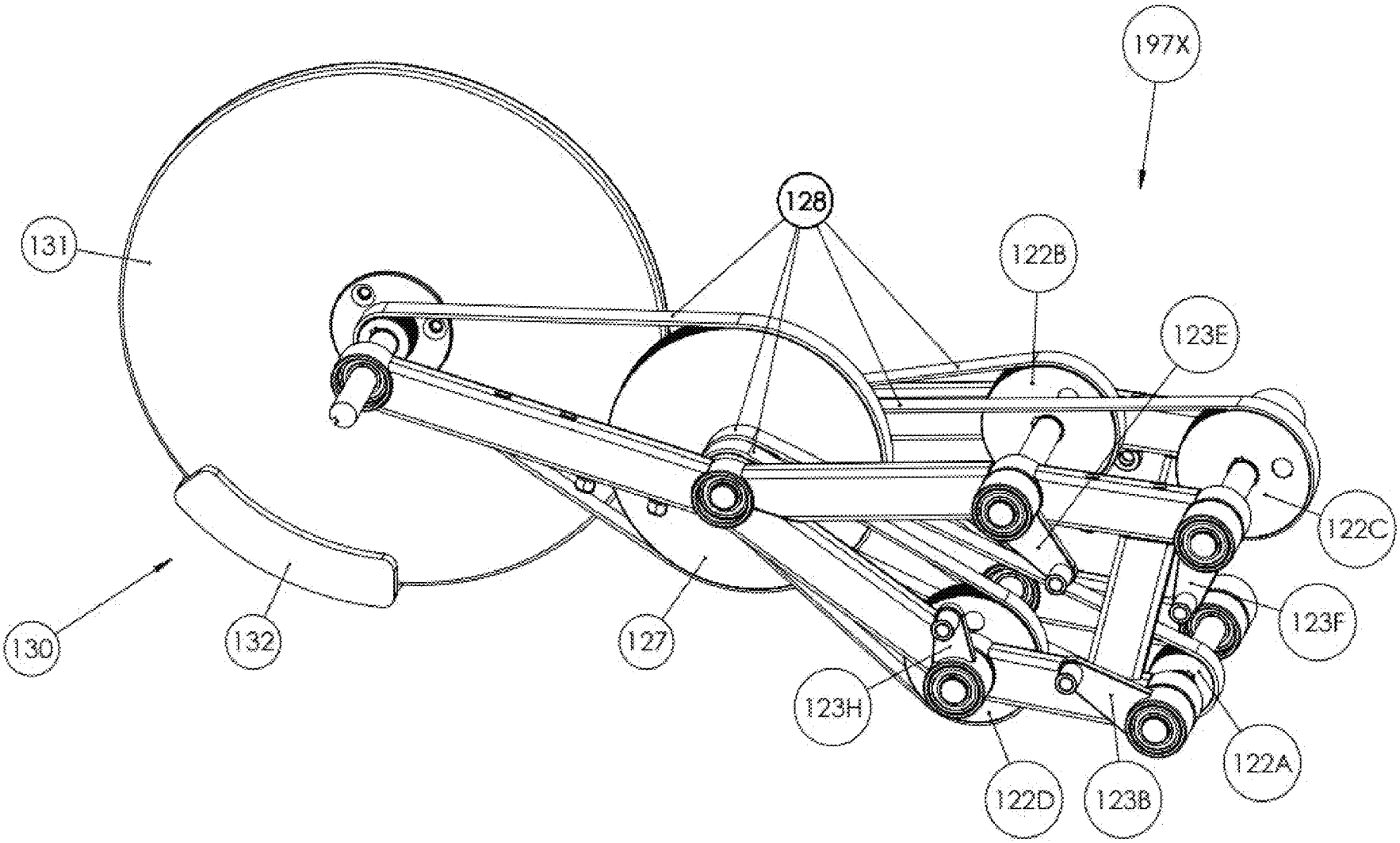
FIG. 22 is another isolated perspective view of the drive train assembly and the resistance assembly of the multi-stations embodiment of the invention shown in FIG. 19.
Figure 23:
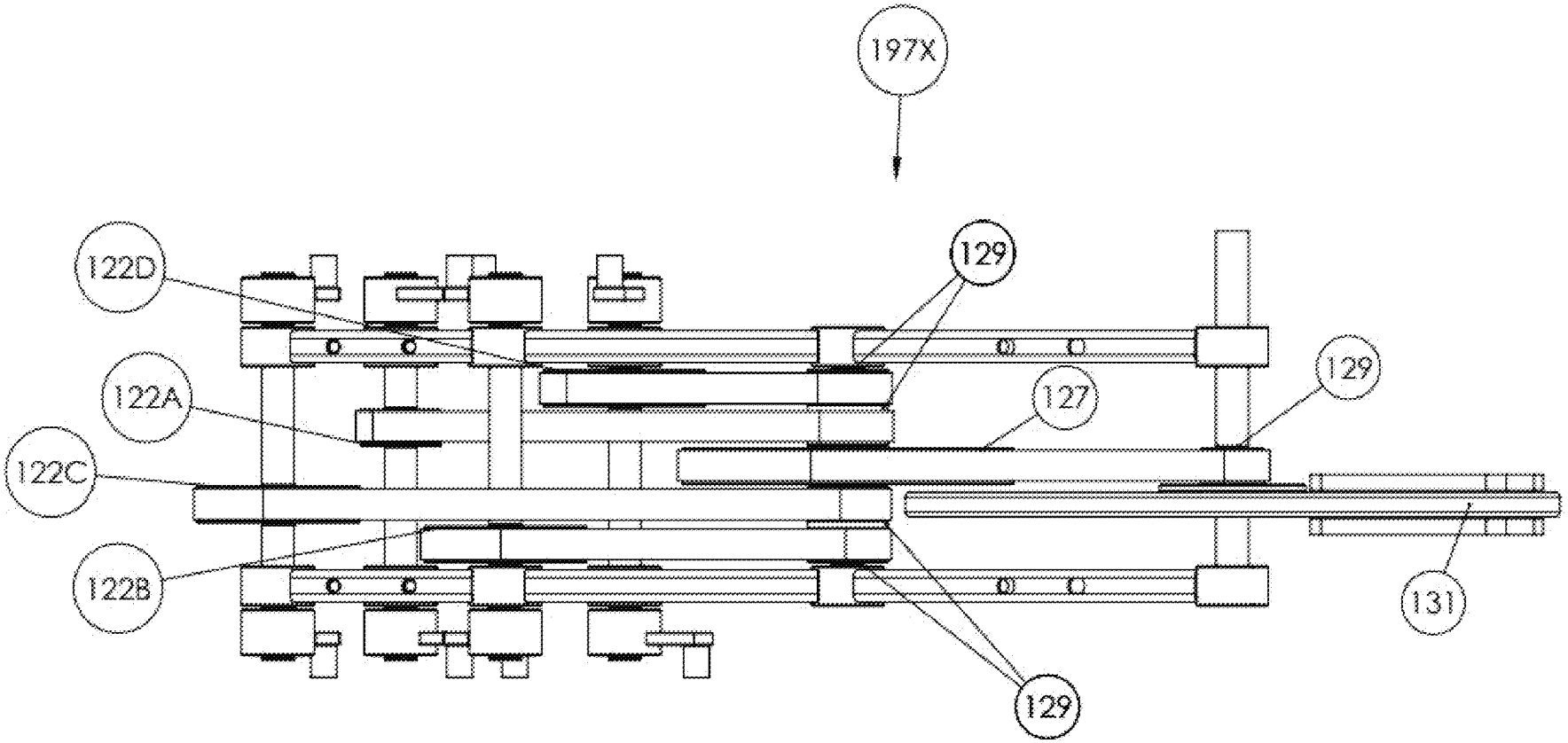
FIG. 23 is another isolated overhead view of the drive train assembly and the resistance assembly of the multi-stations embodiment of the invention shown in FIG. 19.
Figure 24:
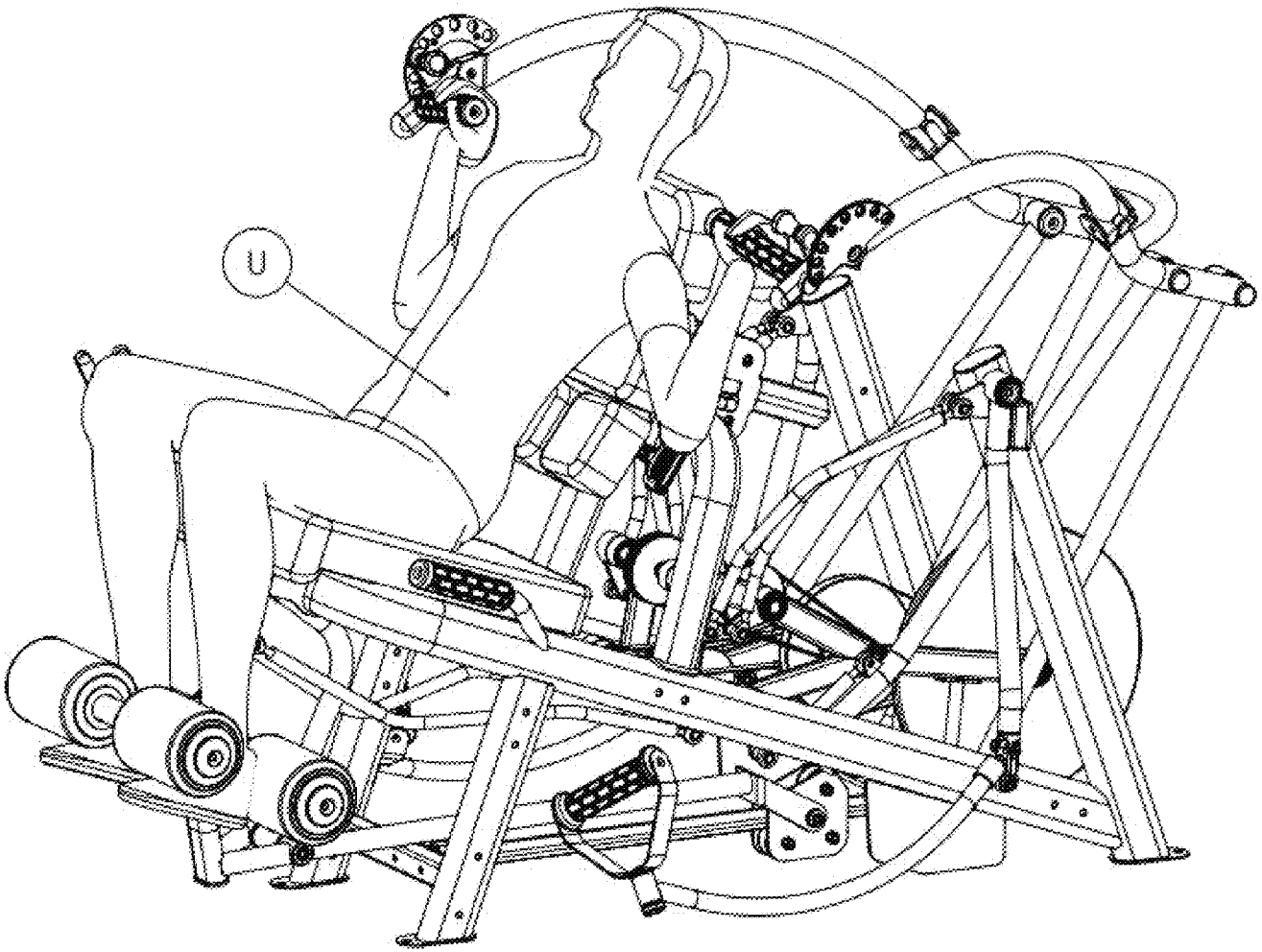
FIG. 24 is a perspective view of the multi-stations embodiment of the invention shown in FIG. 19.
Figure 25:
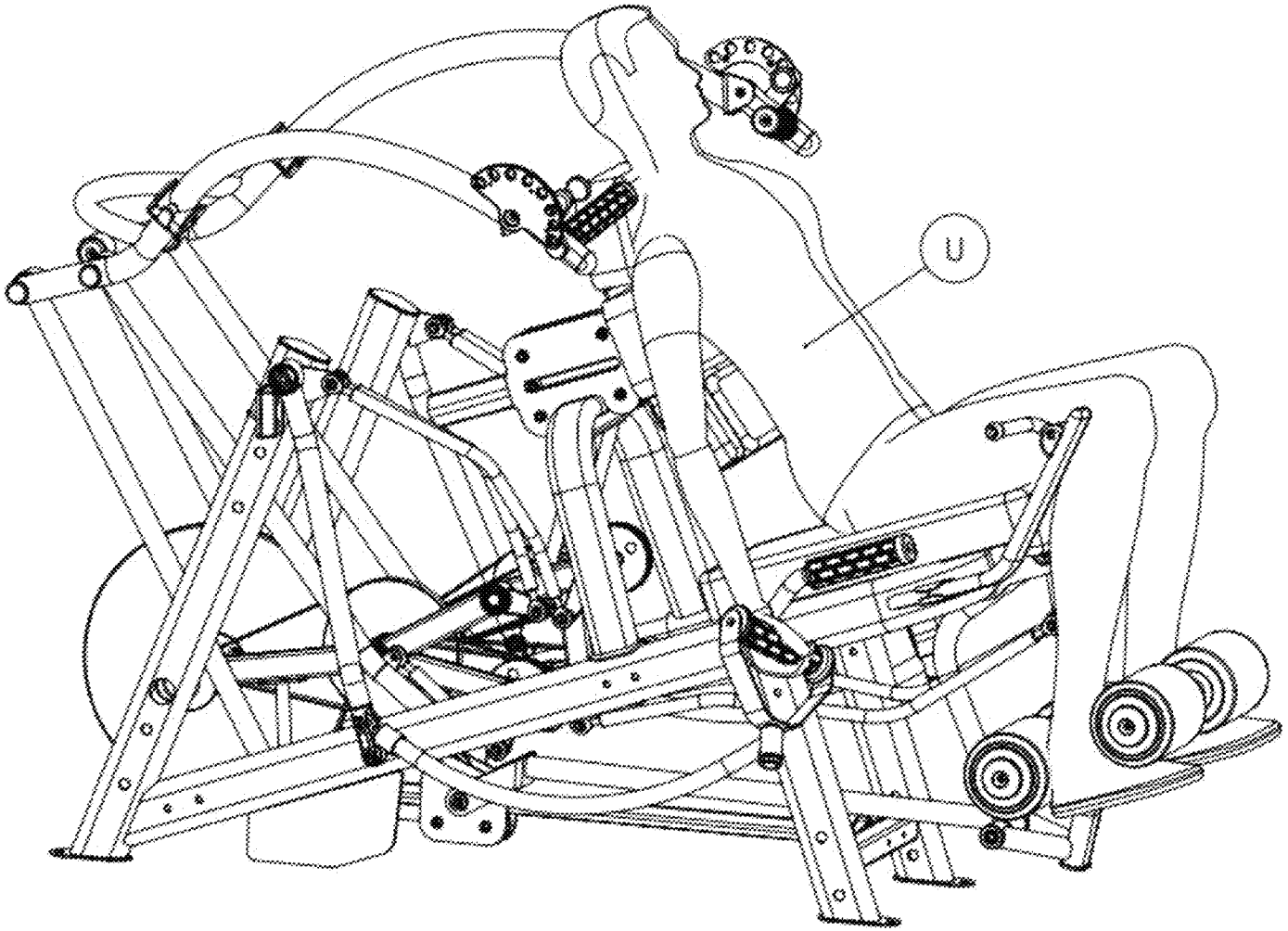
FIG. 25 is another perspective view of a multi-stations embodiment of the invention shown in FIG. 19.

FIGS. 19-26 illustrate a multi-exercise station embodiment of the invention wherein machine 110 is configured with the three exercise stations previously described herein, including a leg station for performing leg extension and leg curl exercises, an arm station for performing independent left and right side biceps curl and triceps extension exercises, and a torso station for performing chest press and back row exercises, all mounted on machine frame 114. FIGS. 19, 20, and 24-26 all illustrate the entirety of the machine and FIGS. 21-23 illustrate isolated views of the drive train assembly 197X and resistance assembly 130 of this embodiment. User support pads 116 support a user U in a seated position. A leg station user engagement actuator assembly 140 as previously described herein is mounted on machine frame 114, left and right arm station user engagement actuator assemblies 150L and 150R are mounted on machine frame 114, and a torso station user engagement actuator assembly 160 is mounted on machine frame 114, wherein all of the exercise stations cooperate with a single drive train assembly 197X and a common resistance assembly 130.

Drive train assembly 197X combines all of the components of the legs station drive train assembly 147X, arms station drive train assembly 157X, and torso station drive train assembly 167X, wherein, one-direction drive pulley axles 121A, 121B, 121C, 121D are all mounted on drive train assembly 197X and drive pulleys 122A, 122B, 122C are each operatively connected to one-direction flywheel booster pulley axle 126. Therefore, drive trains 147X, 157X, 167X each function individually as previously described herein and collectively as drive train assembly 197X.

Resistance assembly 130 is mounted on a rearward portion of drive train assembly 197X and is operatively connected to flywheel booster pulley 127 to function as previously described herein.

Figure 26:
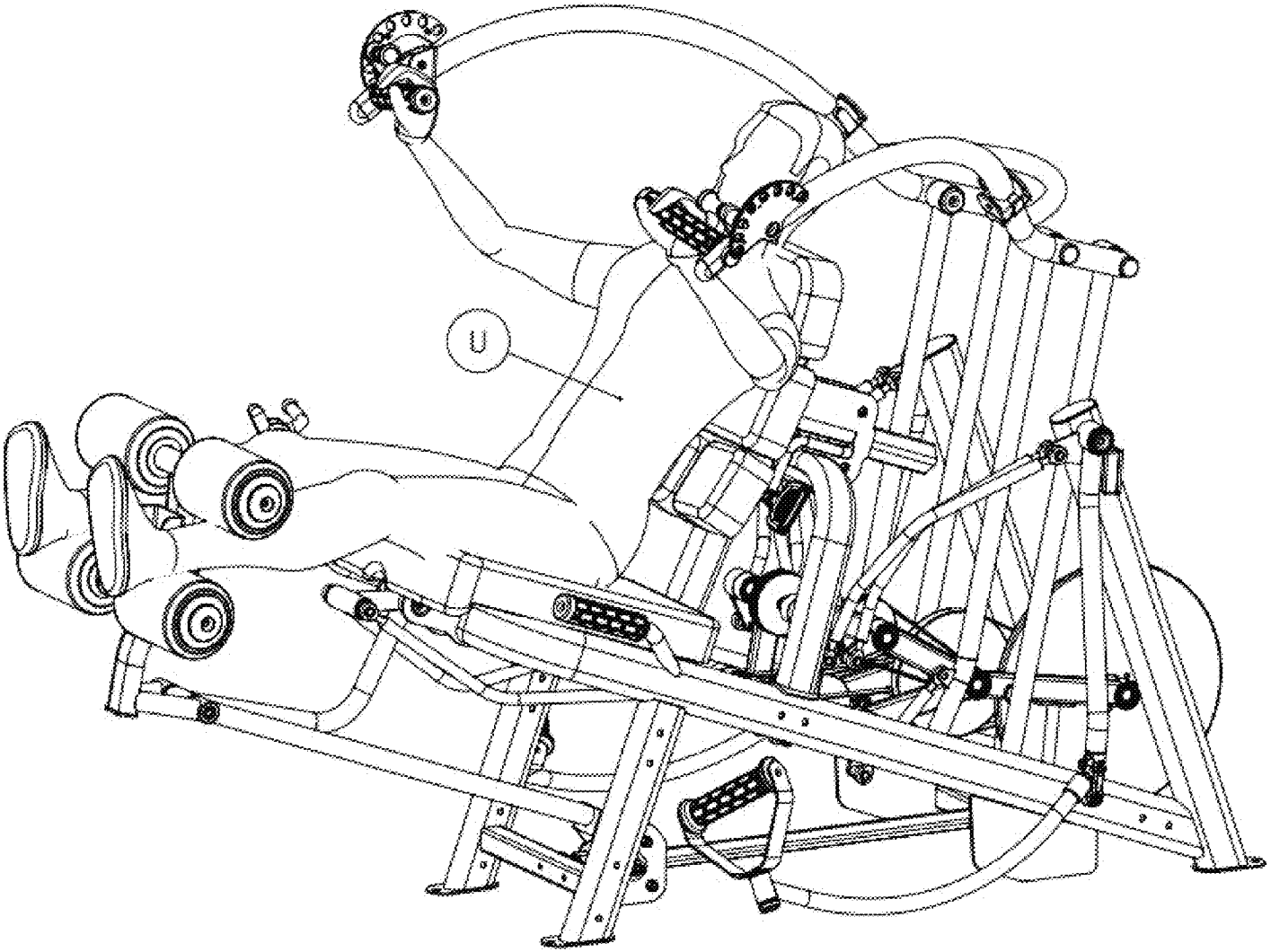
FIG. 26 is another perspective view of a multi-stations embodiment of the invention shown in FIG. 19.

The legs station user engagement actuator assembly 140, arms station user engagement actuator assembly 150L and 150R, and torso station user engagement actuator 160 are each operated by a user U as previously described herein. However, in this multi-stations embodiment of the invention, user U can operate a single exercise station or user U can operate two exercise stations concurrently as best illustrated in FIG. 26 wherein user U is concurrently engaging the legs station user engagement actuator assembly 140 and the torso station user engagement actuator assembly 160.

The resistance ratios of the push and pull motions of legs station user engagement actuator assembly 140, arms station user engagement actuator assemblies 150L and 150R, and torso station user engagement actuator assembly 160 are each mechanically configured and controlled as previously described herein.

FIGS. 30-37 illustrate a single exercise station embodiment of the invention wherein machine 110 is configured with a hip station mounted on a machine frame 114 for performing glute press and hip pull exercises. FIGS. 30-33 illustrate the entirety of the machine and FIGS. 34-37 illustrate isolated views of the drive train assembly 177Z and resistance assembly 130 of this embodiment. User support standing platforms 117 support a user U in a standing position. A plurality of stationary grip handles 118 are rigidly mounted on a forward section of machine frame 114 for securing user U's upper body during operation of machine 110.

The hip station user engagement actuator assembly 170 is engaged by one of the user U's feet and ankles and includes a user engagement foot platform 178 and a user engagement pad 171 that are operatively connected to an actuator lever 172A that pivots about actuator lever pivot 173A, and an actuator lever 172B that pivots about actuator lever pivot 173B. User engagement actuator assembly 170 is constructed with multiple actuator assembly components 176 that collectively support and guide the motion of user engagement actuator assembly 170.

Rigid drive links 174A and 174B operatively connect user engagement actuator assembly 170 to drive train assembly 177Z and resistance assembly 130 as follows. Rigid drive link 174A has a first end and a second end. The first end of rigid drive link 174A is pivotally connected to the upper end of actuator lever 172A with a rigid drive link connector 175 and the second end of rigid drive link 174A is pivotally connected to a forward section drive pulley 122E with a rigid drive link connector 175. Rigid drive link 174B has a first end and a second end. The first end of rigid drive link 174B is pivotally connected to the upper end of actuator lever 172B with a rigid drive link connector 175 and the second end of rigid drive link 174B is pivotally connected to a rearward section of drive pulley 122F with a rigid drive link connector 175.

Figure 37:
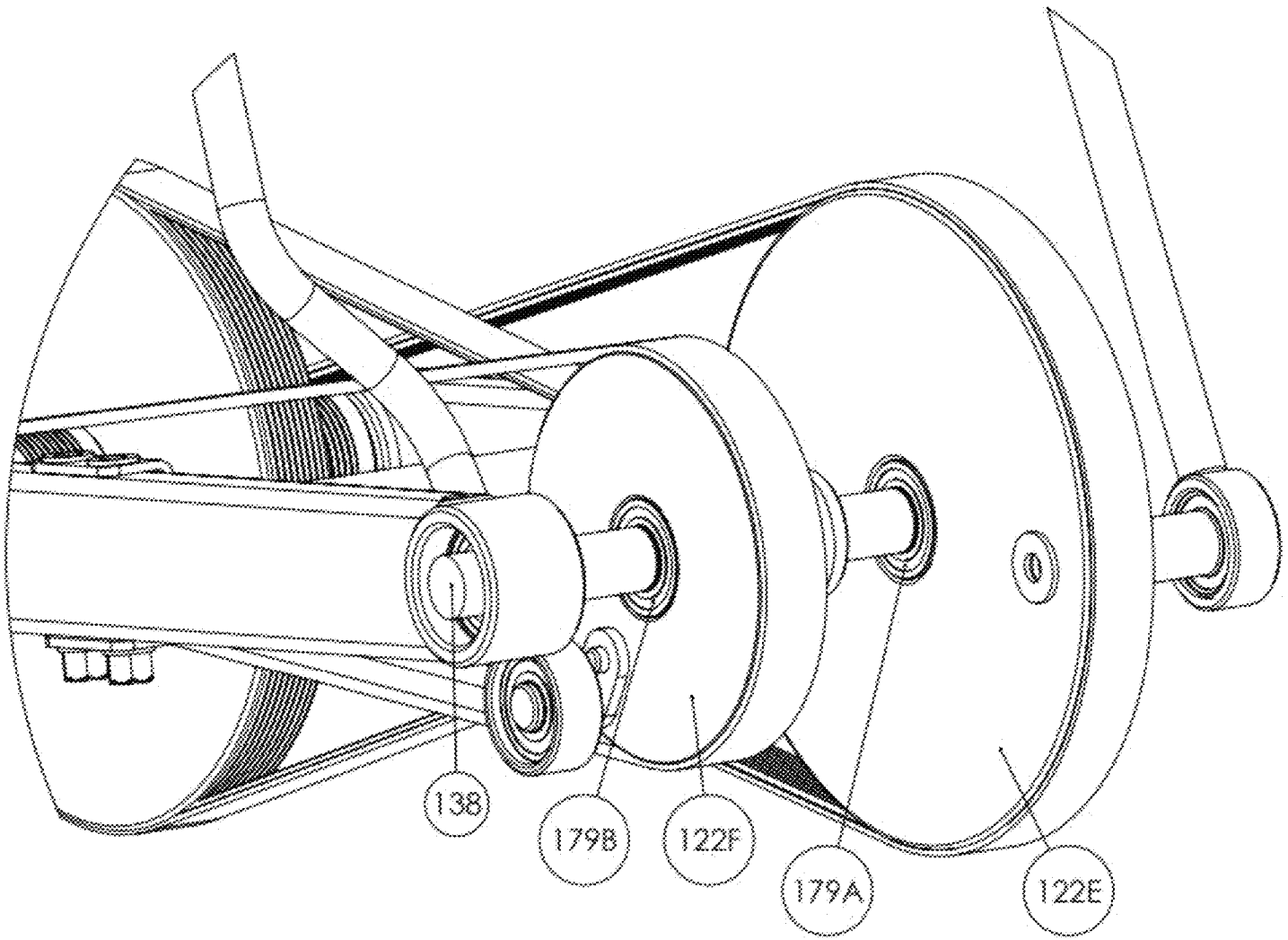
FIG. 37 is close up view of a portion of the drive train assembly and resistance assembly of the glute press and hip pull station embodiment of the invention shown in FIG. 30.

FIGS. 34-37 are isolated views of a hip station drive train assembly 177Z which is configured as follows. A one-direction flywheel booster pulley axle 126 is mounted on a rearward section of drive train assembly 177Z, a flywheel booster pulley 127 is rigidly mounted on one-direction flywheel booster pulley axle 126, a first one-direction clutch bearing pulley 137A is operatively mounted on one-direction flywheel booster pulley axle 126, and a second one-direction clutch bearing pulley 137B is operatively mounted on one-direction flywheel booster pulley axle 126. A one-direction flywheel axle 138 is mounted on a forward section of drive train assembly 177Z, a guide pulley 129 is rigidly mounted on one-direction flywheel axle 138, a drive pulley 122E is rotatably mounted on one-direction flywheel axle 138 with a drive pulley bearing 179A, and a drive pulley 122F is rotatably mounted on one-direction flywheel axle 138 with a drive pulley bearing 1796. As best illustrated in FIG. 37, in this configuration the inner bearing races of drive pulley bearings 179A and 179B rotate with one-direction flywheel axle 138, the outer bearing race of drive pulley bearing 179A rotates with drive pulley 122E in forward and rearward directions, and the outer bearing race of drive pulley bearing 179B rotates with drive pulley 122F in forward and rearward directions. A drive belt 128 connects flywheel booster pulley 127 to guide pulley 129 that is rigidly mounted on one-direction flywheel axle 138. A drive belt 128 connects drive pulley 122E to one-direction clutch bearing pulley 137A and a drive belt 128 connects drive pulley 122F to one-direction clutch bearing pulley 137B.

A resistance assembly 130 is operatively connected to hip station drive train assembly 177Z and mounted on a forward section of drive train frame 115. Resistance assembly 130 is configured as follows. A one-direction flywheel axle 138 is mounted on a forward section of drive train frame 115, a flywheel 131 is rigidly mounted on one-direction flywheel axle 138, and a guide pulley 129 is rigidly mounted on one-direction flywheel axle 138. A set of resistance magnets 132 are mounted on machine frame 114 proximal to flywheel 131 and resistance magnets 132 are operatively engaged with flywheel 131. A resistance magnets adjustment lever 135 is operatively connected to resistance magnets 132 and resistance magnets adjustment lever 135 is mounted on machine frame 114 within reach of user U. A drive belt 128 connects flywheel booster pulley 127 to a guide pulley 129 that is rigidly mounted on one-direction flywheel axle 138.

To operate the hip station embodiment of the machine 110 illustrated in FIGS. 30-37, user U enters machine 110 and assumes a standing position by placing user U's first foot on a user support standing platform 117 and placing user U's second foot on the user engagement foot platform 178 with user U's second foot ankle engaged with user engagement pad 171. User U can then adjust the amount of resistance to the rotation of flywheel 131 with resistance magnets adjustment lever 135 to a preferred fixed setting of resistance. User U then grips a pair of handles 118 to steady user U during the exercise motion.

To begin the push motion exercise, user U pushes rearward with user U's second foot such that user engagement foot platform 178 and user engagement pad 171 move in a rearward and downward motion. This causes the collective hip station user engagement actuator assembly components 176 to move rearward as actuator lever 172A pivots rearward about actuator lever pivot 173A and actuator lever 172B pivots rearward about actuator lever pivot 173B. This causes rigid drive links 174A and 174B to move upward, which causes drive pulley 122E to rotate about the outer bearing race of drive pulley bearing 179A in a first direction and drive pulley 122F to rotate about the outer bearing race of drive pulley bearing 179B in the opposite direction of the rotation of drive pulley 122E. This rotates a drive belt 128 connecting drive pulley 122E to one-direction clutch bearing pulley 137A, causing one-direction clutch bearing pulley 137A to engage and rotate one-direction flywheel booster pulley axle 126, and also rotates a drive belt 128 connecting drive pulley 122F to one-direction clutch bearing pulley 137B, causing one-direction clutch bearing pulley 137B to disengage from one-direction flywheel booster pulley axle 126 and rotate passively on one-direction flywheel booster pulley axle 126. This causes flywheel booster pulley 127 to rotate, which rotates a belt 128 connecting flywheel booster pulley 127 to a guide pulley 129 that is rigidly mounted on one-direction flywheel axle 138, which causes one-direction flywheel pulley axle 138 to rotate, which rotates flywheel pulley 131.

To switch to the pull direction of the exercise motion, user U pulls forward with user U's second foot such that user engagement foot platform 178 and user engagement pad 171 move in a forward and upward motion. This causes the collective hip station user engagement actuator assembly components 176 to move forward as actuator lever 172A pivots forward about actuator lever pivot 173A and actuator lever 172B pivots forward about actuator lever pivot 173B. This causes rigid drive links 174A and 174B to move downward, which causes drive pulley 122E to rotate about the outer bearing race of drive pulley bearing 179A in a second direction and drive pulley 122F to rotate about the outer bearing race of drive pulley bearing 179B in the opposite direction of the rotation of drive pulley 122E. This rotates a drive belt 128 connecting drive pulley 122E to one-direction clutch bearing pulley 137A, causing one-direction clutch bearing pulley 137A to disengage from one-direction flywheel booster pulley axle 126 and rotate passively on one-direction flywheel booster pulley axle 126, and also rotates a drive belt 128 connecting drive pulley 122F to one-direction clutch bearing pulley 137B, causing one-direction clutch bearing pulley 137B to engage and rotate one-direction flywheel booster pulley axle 126. This causes flywheel booster pulley 127 to rotate, which rotates a belt 128 connecting flywheel booster pulley 127 to a guide pulley 129 that is rigidly mounted on one-direction flywheel axle 138, which causes one-direction flywheel pulley axle 138 to rotate, which continues to rotate flywheel pulley 131 in the same one-direction.

User U can continue to perform this reciprocating pushing and pulling hip exercise motion for the desired number of repetitions of the second foot. User U can then move user U's second foot to a user support standing platform and place user U's first foot on user engagement platform 178 and engage user U's first foot ankle with user engagement pad 171. User U can then perform the reciprocating pushing and pulling hip exercise motion with user U's first foot as described herein for the desired number of repetitions.

As best illustrated in FIGS. 34-37, the push and pull resistance ratios of this hip station embodiment are achieved by manipulating a combination of geometric features. The primary feature that controls the resistance ratios of the push and pull motions of this drive train assembly 177Z is the diameter sizes of the drive pulleys 122. A larger diameter drive pulley 122 requires more force to move the user engagement actuator and a smaller diameter drive pulley 122 requires less for to move the user engagement actuator. A secondary feature that helps control the resistance ratios of the push and pull motions of drive train assembly 177Z is the location of the connection point of rigid drive links 174 to the drive pulleys 122 and the distance of that connection point from one-direction flywheel axle 138. It requires more force to move the user engagement actuator assembly 170 if the connection point of a rigid drive link 174 to a drive pulley 122 is located a shorter distance from one-direction flywheel axle 138 and it requires less force to move the user engagement actuator assembly 170 if the connection point of a rigid drive link 174 to a drive pulley 122 is located a longer distance from one-direction flywheel pulley 138.

The primary muscle group engaged in a glute press pushing exercise is the gluteus maximus and the primary muscle group engaged in a hip pull pulling exercise are the hip flexors. Generally, the gluteus maximus muscles are approximately 40% stronger than the hip flexors muscles; therefore, the diameter size of drive pulley 122E combined with the distance of the location of the connection point of rigid drive link 174A to drive pulley 122E from one-direction flywheel axle 138 should require 40% more force to move user engagement actuator assembly 170 in a first motion push direction than the combined features of the diameter size of drive pulley 122F with the distance of the location of the connection point of rigid drive link 174A to drive pulley 122E from one-direction flywheel axle 138 in a second motion pull direction. The ratios of the push and pull resistance of this embodiment can also be affected by the connection points of rigid drive links 174A and 174B to the user engagement actuator assembly 170, but the preferred method is as described herein.

FIGS. 38, 39, and 40 illustrate an alternative single exercise station embodiment of the invention wherein machine 110 is configured to function as a hip exercises station mounted on a machine frame 114 for performing glute presses and hip pull exercises as previously described herein. However, in this embodiment, the drive train has been eliminated and the user engagement actuator assembly 170 cooperates directly with resistance assembly 130. FIG. 40 illustrates the entirety of the machine and FIGS. 38 and 39 illustrate isolated views of the resistance assembly 130.

This embodiment of the machine 110 is configured as follows. User support standing platforms 117 support a user U in a standing position. A plurality of stationary grip handles 118 are rigidly mounted on a forward upper section of machine frame 114 for securing user U's upper body during operation of machine 10. The hip station user engagement actuator assembly 170 is engaged by one of the user's feet and ankles and includes a user engagement foot platform 178 and a user engagement pad 171 that are operatively connected to an actuator lever 172A that pivots about actuator lever pivot 173A and an actuator lever 172B that pivots about actuator lever pivot 173B. User engagement actuator assembly 170 is constructed with multiple actuator assembly components 176 that collectively support and guide the motion of user engagement actuator assembly 170.

Rigid drive links 174A and 174B operatively connect user engagement actuator assembly 170 to resistance assembly 130 as follows. Rigid drive link 174A has a first end and a second end. The first end of rigid drive link 174A is pivotally connected to the upper end of actuator lever 172A with a rigid drive link connector 175 and the second end of rigid drive link 174A is pivotally connected to an axle drive flange 123I with a rigid drive link connector 175. Rigid drive link 174B has a first end and a second end. The first end of rigid drive link 174B is pivotally connected to the upper end of actuator lever 172B with a rigid drive link connector 175 and the second end of rigid drive link 174B is pivotally connected to an axle drive flange 123J with a rigid drive link connector 175.

A resistance assembly 130 is operatively connected to hip station user engagement actuator assembly 170 and mounted on a forward section of machine frame 114. Resistance assembly 130 is configured as follows. A one-direction flywheel axle 138 is mounted on a forward section of machine frame 114, a flywheel 131 is rigidly mounted on one-direction flywheel axle 138, a first one-direction clutch bearing 125 is operatively mounted on one-direction flywheel axle 138, and a second one-direction clutch bearing 125 is operatively mounted on one-direction flywheel axle 138. An axle drive flange 123I is rigidly connected to the first one-direction clutch bearing 125 such that axle drive flange 123I extends away from a forward side of one-direction flywheel axle 138 and an axle drive flange 123J is rigidly connected to the second one-direction clutch bearing 125 such that axle drive flange 123J extends away from a rearward side of one-direction flywheel axle 138. A set of resistance magnets 132 are mounted on machine frame 114 proximal to flywheel 131 and resistance magnets 132 are operatively engaged with flywheel 131. A resistance magnets adjustment lever 135 is operatively connected to resistance magnets 132 and resistance magnets adjustment lever 135 is on machine frame 114 within reach of user U.

To operate the alternative embodiment of the hip station machine 110 illustrated in FIGS. 38-40, user U enters machine 110 and assumes a standing position by placing user U's first foot on a user support standing platform 117 and placing user U's second foot on the user engagement foot platform 178 with user U's second foot ankle engaged with user engagement pad 171. User U can then adjust the amount of resistance to the rotation of flywheel 131 by moving resistance magnets adjustment lever 135 to a preferred fixed setting of resistance. User U then grips a pair of handles 118 to steady user U during the exercise motion.

To begin the push motion exercise, user U pushes rearward with user U's second foot such that user engagement foot platform 178 and user engagement pad 171 move in a rearward and downward motion. This causes the collective hip station user engagement actuator assembly components 176 to move rearward as actuator lever 172A pivots rearward about actuator lever pivot 173A and actuator lever 172B pivots rearward about actuator lever pivot 173B. This causes rigid drive links 174A and 174B to move upward, which causes the one-direction clutch bearing that is rigidly connected to axle drive flange 123I to engage and rotate one-direction flywheel axle 138, which rotates flywheel 131. This upward movement of rigid drive links 174A and 174B also causes the one-direction clutch bearing that is rigidly connected to axle drive flange 123J to disengage from one-direction flywheel axle 138 and rotate passively on one-direction flywheel axle 138.

To switch to the pull direction of the exercise motion, user U pulls forward with user U's second foot such that user engagement foot platform 178 and user engagement pad 171 move in a forward and upward motion. This causes the collective hip station user engagement actuator assembly components 176 to move forward as actuator lever 172A pivots forward about actuator lever pivot 173A and actuator lever 172B pivots forward about actuator lever pivot 173B. This causes rigid drive links 174A and 174B to move downward, which causes the one-direction clutch bearing that is rigidly connected to axle drive flange 123I to disengage from one-direction flywheel axle 138 and rotate passively on one-direction flywheel axle 138. This downward movement of rigid drive links 174A and 174B also causes the one-direction clutch bearing that is rigidly connected to axle drive flange 123J to engage and rotate one-direction flywheel axle 138, which continues to rotate flywheel pulley 131 in the same one-direction.

User U can continue to perform this reciprocating pushing and pulling hip exercise motion for the desired number of repetitions of the second foot. User U can then move user U's second foot to a user support standing platform and place user U's first foot on user engagement platform 178 and engage user U's first foot ankle with user engagement pad 171. User U can then perform the reciprocating pushing and pulling hip exercise motion with user U's first foot as described herein for the desired number of repetitions.

As best illustrated in FIGS. 38-39, the push and pull resistance ratios of this alternative hip station embodiment of machine 110 are achieved by manipulating the location of the connection point of rigid drive link 174A to axle drive flange 123I and the distance of that connection point from one-direction flywheel axle 138 controls the amount of force required to move the user engagement actuator assembly 170 in a first motion glute press pushing exercise. The same method is used to manipulate the ratio of resistance to the reciprocating second motion hip pull pulling exercise wherein manipulating the location of the connection point of rigid drive link 174B to axle drive flange 123J and the distance of that connection point from one-direction flywheel axle 138 controls the amount of force required to move the user engagement actuator assembly 170 in the second motion pull direction. It requires more force to move the user engagement actuator assembly 170 if the connection point of a rigid drive link 174 to an axle drive flange 123 is located a shorter distance from the one-direction flywheel axle 138 and it requires less force to move the user engagement actuator assembly 170 if the connection point of a rigid drive link 174 to an axle drive flange 123 is located a longer distance from the one-direction flywheel axle 138.

The primary muscle group engaged in a glute press pushing exercise are the gluteus maximus and the primary muscle group engaged in a hip pull pulling exercise are the hip flexors. Generally, the gluteus maximus muscles are approximately 40% stronger than the hip flexors muscles; therefore, the location of the connection point of rigid drive links 174A to axle drive flange 1231 and the location of the connection point of rigid drive links 174B to axle drive flange 123J are sufficiently distanced from one-direction flywheel axle 138 to create resistance ratios that require approximately 40% more force to move user engagement actuator assembly 170 to perform the glute press pushing exercise than the hip pull pulling exercise. The ratios of the push and pull resistance of this embodiment can also be affected by the connection points of rigid drive links 174A and 174B to the user engagement actuator assembly 170, but the preferred method is as described herein.

Features and components of preferred embodiments of the present invention include a machine frame, a user support, at least one user engagement actuator assembly, a mechanical drive train assembly, and a mechanical resistance assembly. Each user engagement actuator assembly creates a unique exercise station and the mechanical drive train transfers the force of the user from the user engagement actuator assembly to the mechanical resistance assembly such that the user engagement actuator assembly is resisted in both the push direction and the pull direction of each exercise station. Each exercise station can be mechanically configured such that greater, less, or equal force is required to move the user engagement actuator assembly in a push direction relative to the reciprocating pull direction at a fixed resistance setting. One or multiple exercise stations can be mounted on a single machine of the invention and one exercise station can be operated by a user or multiple exercise stations can be operated by a user concurrently.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

NUMERALS AND LETTERS REFERENCE LIST

110 Machine
114 Machine frame
115 Drive train frame
116 User support pad
117 User support standing platform
118 Stationary grip handle
121 One-direction drive pulley axle
122 Drive pulley
123 Axle drive flange
124 Axle bearing
125 One-direction clutch bearing
126 One-direction flywheel booster pulley axle
127 Flywheel booster pulley
128 Drive belt

129 Guide pulley
130 Resistance assembly
131 Flywheel
132 Resistance magnets
135 Resistance magnets adjustment lever
137 One-direction clutch bearing pulley
138 One-direction flywheel axle
139 Drive train support tube
140 Leg station user engagement actuator assembly
141 User engagement pad
142 Actuator lever
143 Actuator lever pivot
144 Rigid drive link
145 Rigid drive link connector
146 Leg station actuator assembly component
147 Leg station drive train assembly
150 Arm station user engagement actuator assembly
151 User engagement handle
152 Actuator lever
153 Actuator lever pivot
154 Rigid drive link
155 Rigid drive link connector
156 Arm station actuator assembly component
157 Arm station drive train assembly
160 Torso station user engagement actuator assembly
161 User engagement handle
162 Actuator lever
163 Actuator lever pivot
164 Rigid drive link
165 Rigid drive link connector
166 Torso station actuator assembly component
167 Torso station drive train assembly
170 Hip station user engagement actuator assembly
171 User engagement pad
172 Actuator lever
173 Actuator lever pivot
174 Rigid drive link
175 Rigid drive link connector
176 Hip station actuator assembly component
177 Hip station drive train assembly
178 User engagement foot platform
179 Hip station drive pulley bearing
197 Multi-station drive train assembly
U User
X Drive train frame type
Y Drive train frame type
Z Drive train frame type

What is claimed is:

1. A multi-function exercise machine with mechanical push and pull resistance comprising:

a) a structural frame;

b) a user support;

c) a user engagement actuator assembly including a user engagement means selected from the group consisting of handles, pads, foot platforms, and combinations thereof, that is operatively connected to a pivotable actuator lever;

d) a one-direction drive pulley axle operatively connected to the user engagement actuator assembly;

e) a drive pulley rigidly mounted on the one-direction drive pulley axle;

f) a first one-direction clutch bearing and a second one-direction clutch bearing operatively mounted on the one-direction drive pulley axle;

g) a first drive flange rigidly mounted on the first one-direction clutch bearing and extending away from the center of the one-direction drive pulley axle, and a second drive flange rigidly mounted on the second one-direction clutch bearing and extending away from the center of the one-direction drive pulley axle;

h) a first rigid drive link having a first end and a second end and the first end is pivotally connected to the first drive flange and the second end is pivotally connected to the user engagement actuator assembly, and a second rigid drive link having a first end and a second end and the first end is pivotally connected to the second drive flange and the second end is pivotally connected to the user engagement actuator assembly;

i) a one-direction booster pulley axle with a booster pulley rigidly mounted on the one-direction booster pulley axle;

j) a one-direction flywheel axle with a flywheel rigidly mounted on the one direction flywheel axle;

k) a braking mechanism operatively engaged with the flywheel for providing resistance to the one-directional rotation of the flywheel; and l) a first flexible component operatively connecting the drive pulley to the one-direction flywheel axle;

m) a second flexible component operatively connecting the booster pulley to the one-direction flywheel axle, wherein movement of the user engagement actuator assembly in a first motion push direction causes movement in a first direction of the first rigid drive link, the second rigid drive link, the first drive flange, and the second drive flange, which causes rotation of the drive pulley, the booster pulley, and the flywheel, wherein movement of the user engagement actuator assembly in a second motion pull direction causes movement in a second direction of the first rigid drive link, the second rigid drive link, the first drive flange, and the second drive flange, which causes rotation of the drive pulley, the booster pulley, and the flywheel, and wherein the flywheel and the braking mechanism create resistance to any motion of the user engagement actuator.

2. The exercise machine of claim 1 wherein the braking mechanism has a force that is manually adjusted to multiple fixed settings of force and resistance to rotation of the flywheel and is created by a resistance means selected from the group consisting of a magnetic field, contact friction, air displacement, fluid displacement, and combinations thereof.

3. The exercise machine of claim 2, wherein the user engagement actuator assembly is configured as a push and pull exercise station consisting of an exercise station selected from the group consisting of a chest press and back row station, an incline chest press and high back row station, a shoulder press and back pulldown station, a biceps curl and triceps extension station, a leg extension and leg curl station, a glute press and hip pull station, an abdominal crunch and back extension station, a leg press and abdominal leg pull station, and a hip abductor and hip adductor station.

4. The exercise machine of claim 3, wherein at a fixed resistance setting of the flywheel braking mechanism, equal amounts of force are required to move the user engagement actuator assembly in a first motion push direction or in a second motion pull direction.

5. The exercise machine of claim 3, wherein a distance of a connection location of the first end of the first rigid drive link with the first drive flange relative to the one-direction drive pulley axle is different than a distance of a connection location of the first end of the second rigid drive link with the second drive flange relative to the one-direction drive pulley axle, and/or the distance of a connection location of the second end of the first rigid drive link with the user engagement actuator assembly relative to the actuator lever pivot is different than a distance of a connection location of the second end of the second rigid drive link with the user engagement actuator assembly relative to the actuator lever pivot.

6. The exercise machine of claim 5, wherein at a fixed resistance setting of the flywheel braking mechanism, a first amount of force is required to move the user engagement actuator assembly in a first motion push direction and a second amount of force is required to move the user engagement actuator assembly in a second motion pull direction that is greater or less than the first amount of force required to move the user engagement actuator in the first motion push direction.

7. The exercise machine of claim 4, comprising at least two of the user engagement actuator assemblies mounted on the machine and operatively connected to the one-direction flywheel axle, the flywheel, and the flywheel braking mechanism, and wherein the at least two user engagement actuator assemblies are operated from the user support.

8. The exercise machine of claim 6, comprising at least two of the user engagement actuator assemblies mounted on the machine and operatively connected to the one-direction flywheel axle, the flywheel, and the flywheel braking mechanism, and wherein the at least two user engagement actuator assemblies are operated from the user support.

9. The exercise machine of claim 7, wherein each of the at least two user engagement actuator assemblies are operated independently or the at least two user engagement actuator assemblies are operated concurrently to collectively rotate the one-direction flywheel axle and the flywheel.

10. The exercise machine of claim 8, wherein each of the at least two user engagement actuator assemblies are operated independently or the at least two user engagement actuator assemblies are operated concurrently to collectively rotate the one-direction flywheel axle and the flywheel.

11. The exercise machine of claim 3 wherein the exercise station comprises opposing and identically functioning left and right user engagement actuator assemblies that operate independently of each other such that a left and right side of a user's body independently exercise identical left and right side muscle groups.

12. A multi-function exercise machine with mechanical push and pull resistance comprising:

a) a structural frame;

b) a user support;

c) a user engagement actuator assembly including a user engagement means selected from the group consisting of handles, pads, foot platforms, and combinations thereof, that is operatively connected to a pivotable actuator lever;

d) a one-direction flywheel axle with a flywheel rigidly mounted on the one-direction flywheel axle;

e) a braking mechanism operatively engaged with the flywheel for providing resistance to the one-directional rotation of the flywheel;

f) a first one-direction clutch bearing and a second one-direction clutch bearing each operatively mounted on the one-direction flywheel axle;

g) a first drive flange rigidly mounted on the first one-direction clutch bearing and extending away from the center of the one-direction flywheel axle, and a second drive flange rigidly mounted on the second one-direction clutch bearing and extending away from the center of the one-direction flywheel axle;

h) a first rigid drive link having a first end and a second end and the first end is pivotally connected to the first drive flange and the second end is pivotally connected to the user engagement actuator assembly, and a second rigid drive link having a first end and a second end and the first end is pivotally connected to the second drive flange and the second end is pivotally connected to the user engagement actuator assembly;

wherein movement of the user engagement actuator assembly in a first motion push direction causes movement in a first direction of the first and second rigid drive links and the first and second drive flanges, which cause rotation of the flywheel, and wherein movement of the user engagement actuator assembly in a second motion pull direction causes movement in a second direction of the first and second rigid drive links and the first and second drive flanges, which causes rotation of the flywheel, and wherein the flywheel and the braking mechanism create resistance to any motion of any of the user engagement actuator.

13. The exercise machine of claim 12 wherein the braking mechanism has a force that is manually adjusted to multiple fixed settings of force and the resistance to rotation of the flywheel and is created by a resistance means selected from the group consisting of a magnetic field, contact friction, air displacement, and fluid displacement, and combinations thereof.

14. The exercise machine of claim 13, wherein the user engagement actuator assembly is configured as a push and pull exercise station consisting of an exercise station selected from the group consisting of a chest press and back row station, an incline chest press and high back row station, a shoulder press and back pulldown station, a biceps curl and triceps extension station, a leg extension and leg curl station, a glute press and hip pull station, an abdominal crunch and back extension station, a leg press and abdominal leg pull station, and a hip abductor and hip adductor station.

15. The exercise machine of claim 14, wherein at a fixed resistance setting of the flywheel braking mechanism, equal amounts of force are required to move the user engagement actuator assembly in a first motion push direction or a second motion pull direction.

16. The exercise machine of claim 14, wherein a distance of a connection location of the first end of the first rigid drive link with the first drive flange relative to the one-direction flywheel axle is different than a distance of a connection location of the first end of the second rigid drive link with the second drive flange relative to the one-direction flywheel axle, and/or the distance of a connection location of the second end of the first rigid drive link with the user engagement actuator assembly relative to the actuator lever pivot is different than a distance of a connection location of the second end of the second rigid drive link with the user engagement actuator assembly relative to the actuator lever pivot.

17. The exercise machine of claim 16, wherein at a fixed resistance setting of the flywheel braking mechanism, a first amount of force is required to move the user engagement actuator assembly in a first motion push direction and a second amount of force is required to move the user engagement actuator assembly in a second motion pull direction that is greater or less than the first amount of force required to move the user engagement actuator in the first motion push direction.

18. A multi-function exercise machine with mechanical push and pull resistance comprising:

a) a structural frame;

b) a user support;

c) a user engagement actuator assembly including a user engagement means selected from the group consisting of handles, pads, foot platforms, and combinations thereof, that is operatively connected to a pivotable actuator lever;

d) a one-direction flywheel axle with a flywheel rigidly mounted on the one-direction flywheel axle;

e) a braking mechanism operatively engaged with the flywheel for providing resistance to the one-directional rotation of the flywheel;

f) a first drive pulley rotatably mounted on the one-direction flywheel axle for rotation independent of the one-direction flywheel axle, and a second drive pulley rotatably mounted on the one-direction flywheel axle for rotation independent of the one-direction flywheel axle;

g) a one-direction booster pulley axle with a booster pulley rigidly mounted on the one-direction booster pulley axle, wherein the booster pulley is operatively connected to the one-direction flywheel axle with a first flexible component;

h) a first one-direction clutch bearing pulley operatively mounted on the one-direction booster pulley axle and a second one-direction clutch bearing pulley operatively mounted on the one-direction booster pulley axle, wherein the first one-direction clutch bearing pulley is connected to the first drive pulley with a second flexible component and the second one-direction clutch bearing pulley is connected to the second drive pulley with a third flexible component;

i) a first rigid drive link having a first end and a second end and the first end is pivotally connected to the first drive pulley and the second end is pivotally connected to the user engagement actuator assembly, and a second rigid drive link having a first end and a second end and the first end is pivotally connected to the second drive pulley and the second end is pivotally connected to the user engagement actuator assembly;

wherein movement of the user engagement actuator assembly in a first motion push direction causes movement in a first direction of the first and second rigid drive links and the first and second drive pulleys, which causes rotation of the booster pulley and the flywheel, wherein movement of the user engagement actuator assembly in a second motion pull direction causes movement in a second direction of the first and second rigid drive links and the first and second drive pulleys, which causes rotation of the booster pulley and the flywheel, and wherein the flywheel and the braking mechanism create resistance to any motion of the user engagement actuator.

19. The exercise machine of claim 18 wherein the braking mechanism has a force that is manually adjusted to multiple fixed settings of force and resistance to rotation of the flywheel and is created by a resistance means selected from the group consisting of a magnetic field, contact friction, air displacement, fluid displacement, and combinations thereof.

20. The exercise machine of claim 19, wherein the rotation of the booster pulley multiplies the rotational speed of the one-direction flywheel axle relative to the rotational speed of each of the drive pulleys.

21. The exercise machine of claim 20, wherein the user engagement actuator assembly is configured as a push and pull exercise station consisting of an exercise station selected from the group consisting of a chest press and back row station, an incline chest press and high back row station, a shoulder press and back pulldown station, a biceps curl and triceps extension station, a leg extension and leg curl station, a glute press and hip pull station, an abdominal crunch and back extension station, a leg press and abdominal leg pull station, and a hip abductor and hip adductor station.

22. The exercise machine of claim 21, wherein at a fixed resistance setting of the flywheel braking mechanism, equal amounts of force are required to move the user engagement actuator assembly in a first motion push direction or in a second motion pull direction.

23. The exercise machine of claim 21, wherein the diameter of the first drive pulley is different than the diameter of the second drive pulley, and/or the distance of the connection location of the first end of the first rigid drive link with the first drive pulley relative to the one-direction flywheel axle is different than the distance of the connection location of the first end of the second drive link with the second drive pulley relative to the one-direction flywheel axle, and/or the distance of the connection location of the second end of the first drive link with the user engagement actuator assembly relative to the actuator lever pivot is different than the distance of the connection location of the second end of the second drive link with the user engagement actuator assembly relative to the actuator lever pivot.

24. The exercise machine of claim 23, wherein, at a fixed resistance setting of the flywheel braking mechanism, a first amount of force is required to move the user engagement actuator assembly in the first motion push direction and a second amount of force is required to move the user engagement actuator assembly in the second motion pull direction that is greater or less than the first amount of force required to move the user engagement actuator in the first motion push direction.

* * * * *